US006267168B1

(12) United States Patent
Davies et al.

(10) Patent No.: US 6,267,168 B1
(45) Date of Patent: Jul. 31, 2001

(54) SCREEN CASSETTE AND COMPATIBLE FRAMING SECTION THEREFOR

(75) Inventors: John Robert Davies; Sean Davies; Sinnathamby Kupenthirarajan, all of Vaughan (CA)

(73) Assignee: 420820 Ontario Limited, Vaughan (CA)

( * ) Notice: Subject to any disclaimer, the term of this patent is extended or adjusted under 35 U.S.C. 154(b) by 0 days.

(21) Appl. No.: 09/184,029

(22) Filed: Nov. 2, 1998

Related U.S. Application Data

(63) Continuation-in-part of application No. 09/035,152, filed on Mar. 5, 1998, which is a continuation-in-part of application No. 08/962,263, filed on Oct. 31, 1997, which is a continuation-in-part of application No. 08/362,995, filed on Dec. 23, 1994, now Pat. No. 5,682,710, which is a continuation-in-part of application No. 08/281,620, filed on Jul. 28, 1994, now Pat. No. 5,687,506.

(51) Int. Cl.[7] ..... E04F 10/06
(52) U.S. Cl. ..... 160/23.1; 160/27
(58) Field of Search ..... 160/26, 23.1, 31, 160/32, 33, 271, 273.1, DIG. 903, 27; 49/403

(56) References Cited

U.S. PATENT DOCUMENTS

| | | | | |
|---|---|---|---|---|
| 1,113,721 | * | 10/1914 | Watson | 160/23.1 |
| 1,172,800 | * | 2/1916 | Johnson | 160/23.1 |
| 1,355,608 | * | 10/1920 | Knapp | 160/23.1 |
| 4,234,032 | * | 11/1980 | Stark | 160/26 |
| 4,282,919 | * | 8/1981 | Teno | 160/23.1 |
| 4,947,937 | * | 8/1990 | Searer et al. | 160/26 |
| 5,048,245 | * | 9/1991 | Bresson et al. | 160/26 |
| 5,464,052 | * | 11/1995 | Wieczorek et al. | 160/23.1 |
| 5,711,568 | * | 1/1998 | Diem et al. | 160/23.1 |
| 5,860,466 | * | 1/1999 | Kao | 60/23.1 |

* cited by examiner

*Primary Examiner*—Daniel P. Stodola
*Assistant Examiner*—Curtis A. Cohen
(74) *Attorney, Agent, or Firm*—Neil H. Hughes; Ivor M. Hughes; Marcelo K. Sarkis

(57) ABSTRACT

A roll screen cassette for installation in a closure assembly having a frame for moveably retaining a closure member, the frame including a header, sill, and vertical jamb sections, at least one of the sections including a pocket formed within the interior thereof, the pocket having a first predetermined configuration defined by the interior of the section and for receipt of the roll screen, the roll screen comprising a pair of brackets from which the roll screen is pivotally supported, the pair of brackets having a second predetermined configuration compatible with the pocket of the frame section having the first predetermined configuration, the pair of brackets utilized for removeably retaining the roll screen within the pocket in use, the pair of brackets and roll screen being removeably held in position with respect to said frame only by the pocket having the first predetermined configuration and the pair of brackets having a second predetermined configuration compatible with the pocket and being located in the pocket in use, wherein the compatible shapes of the pair of brackets and the pocket when installed in the frame section cooperate to prevent the pair of brackets from rotating with respect to the pocket and the frame when the roll screen is let out or taken in use.

9 Claims, 63 Drawing Sheets

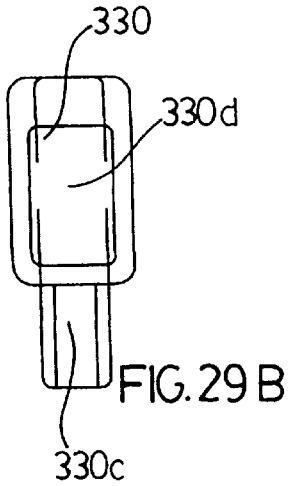
FIG. 29B
FIG. 29A
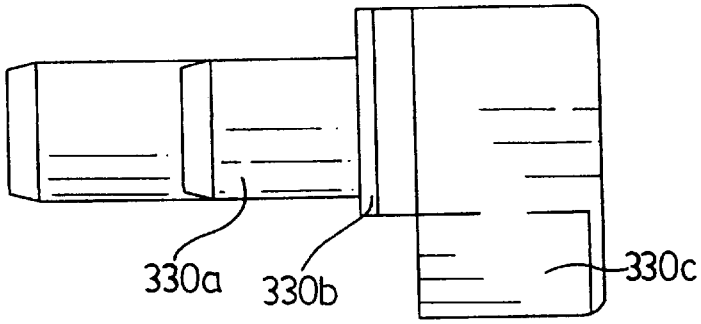
FIG. 29C
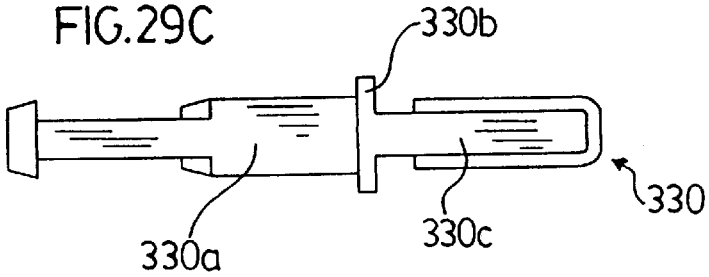

H'
H'1
311'
A
305'a
302'
S'1
300'a
10b'
P'
H'2
Sx
301'
10c'
330'
S'
10a'
Sy
330'a
322'
10'
320'
312'
350'
305'
B'11b'
312'
A
340'
311'
330'a
S'2
S'2
330'
S'

S'3

H
H'2
330'
350'
340'
330'
H'2

SCREEN CASSETTE AND COMPATIBLE FRAMING SECTION THEREFOR

This application is a continuation in part of U.S. patent application Ser. No. 09/035,152 filed Mar. 5, 1998 which is a continuation in part of U.S. patent application Ser. No. 08/962,263 filed Oct. 31, 1997 which is a continuation in part of U.S. patent application Ser. No. 08/362,995 filed Dec. 23, 1994 now U.S. Pat. No. 5,682,710 which is a continuation in part of U.S. patent application Ser. No. 08/281,620 filed Jul. 28, 1994 now U.S. Pat. No. 5,687,506 from which priority is claimed.

FIELD OF INVENTION

This invention relates to a retractable screen system for a closure assembly and improvements thereof which allows the secure sliding and subsequent retraction of the screen from an operative position to a retracted position. The invention is preferably embodied in a window assembly but finds application also in large pivoting windows and patio doors. In the improvements described herein the retractable screen is provided in a cassette which is easily installed and maintained in a framing section.

BACKGROUND OF THE INVENTION

The reader is referred to Applicants Co-pending Applications abovementioned for teachings in relation to improvements to closure assemblies and retractable screen systems contained therein, the teachings thereof which are hereby incorporated by reference.

Screens are generally provided for doors, patio doors, and windows. One particular type of screen utilized for patio doors, for example, includes a metal frame having a groove disposed around its edges. The screen is affixed to the frame by using a spline, a long extended piece of flexible material, which is forced into the groove capturing the edges of the screen. The screen is then slid in front of the opening when the patio door is moved to an opened position. The screen therefore permanently blocks the view of the occupant of the dwelling. The same is true for screens provided with double-hung windows, tilt and slide windows, and casement windows. The screen generally is always in position whether the window is opened or closed.

Various examples therefore have been developed by inventors to address this problem.

For example, U.S. Pat. No. 5,505,244 to Thumann describes a retractable covering for a door including a housing containing a roll of screen as best seen in FIGS. 2, 5, 6A and 6B thereof. The cover may be affixed to a door adjacent the frame thereof as an after-market product.

Another example of an after-market type of product is found in U.S. Pat. No. 4,821,786 as best seen in relation to FIG. 6 therein, the structure is adapted to be mounted on one side of a door jamb to be releaseably connected to the other. The assembly is quite complicated and complex and may be considered as an add-on structure.

Similarly, U.S. Pat. No. 3,911,990 provides a screen in combination with a sliding door. The screen is disposed upon a spring-loaded roller installed on the exterior of the framing sections of the opening adjacent to the window frame.

U.S. Pat. No. 4,757,852 describes a box-like housing carrying a tube for paying out and taking up a mesh screen. The housing is fastened over a window or door and is not part of the framing section of the door.

U.S. Pat. No. 4,651,797 describes a roll-up screen door included in a narrow housing containing a conventional spring-biased roll onto which flexible screen material is taken up and paid out. The housing is mounted adjacent one side of a vertical curved strip along one side of the door casement opening. The front vertical edge portion of the screen material is anchored within a vertical groove of the anchoring strip as best seen in FIGS. 3 and 5. Again, the housing extends from the framing section and is not part thereof. A more complex arrangement is found in U.S. Pat. No. 4,359,081 and U.S. Pat. No. 4,261,524.

Referring now to U.S. Pat. No. 1,150,000 to Matthews, there is described a window screen coiled on a roller for installation on a window frame. The roller for the window is illustrated in FIG. 5 including a hook portion for hooking a complementary hook portion on the screen. The other edge of the screen includes a hook portion for engaging with the trim portion 34.

U.S. Pat. No. 1,141,996 to Vanasdale describes another type of roller screen which may be attached to the sill or lintel portion of the frame by mounting brackets as best seen in relation to FIGS. 1 through 6.

None of the above-mentioned references teach or even infer the installation of a screen within the framing sections of a closure assembly such as a jamb. Each of the products may be considered as an after-market product which is installed upon, adjacent to, on or butting up against the framing section of the appropriate closure member. In essence, some of the installations are unsightly with a housing extending from the general plane of the home or window, extending either outwardly away from or inwardly toward the interior being closed by the closure member. It would therefore be advantageous to solve this problem by providing a screen assembly which may be contained within the framing sections of a closure assembly and which retracts into the frame member and which is substantially invisible until such time as needed.

U.S. Pat. No. 4,825,921 describes a screen assembly having supporting elements secured along the edge of the material as best seen in relation to FIGS. 4 and 7. The structure also includes a spring-biased element which rides in a track. As best seen in FIGS. 9 through 11, the screen is considered to be an add-on, after-market device as well.

U.S. Pat. No. 3,842,890 to Kramer describes a coilable closure device as best seen in FIGS. 1 and 18 which includes a frame including a side jamb and a storage jamb, 34 and 36 respectively. The coilable closure device does not include a post and includes a multiplicity of sections as best seen in FIGS. 1 and 6 which sections include elements extending up into and down into respective track areas provided with the frame. The material which coils upon itself is particularly plastic sheet including reinforcing ribs which also act as guiding elements for the sheet. However, nowhere within the reference does it teach the use of such a structure for a screen, but merely as a closure to replace a door between adjacent rooms, for example. Nowhere within the reference does it teach the combination of a closure member such as a window or patio door and a screen. This is simply not described. Therefore, one would not be motivated to solve the problem of combinations of closure members and screens by the reading of the Kramer reference.

There are a number of manufacturers producing a style of screen in a kit form to be assembled onto the exterior of a housing on existing windows as an after-market product.

Known roll screen fastening technologies fastens the screen cloth to the drum with tape, glue, and other bonding methods. The handle may have the screen cloth affixed thereto by using conventional attachment methods such as utilizing a semi-flexible bead pressed into a groove as described above or by sandwiching the screen between a two part mechanical handle profile which may be fastened by screws, rivets or the like. Preferred Engineering has made attempts at crimping the screen into a metal edge and inserting the edge into the drum and the handle as described in the parent application. Although this is a reasonable approach, it has been determined that no flexibility is achieved by such a joint and the screen still had a tendency to tear.

Nowhere therefore within the prior art is there taught improvements to screen assemblies, wherein the entire screen assembly is contained within the framing sections found adjacent to a closure member in a closure assembly, for example a window assembly. Further, nowhere within the art is there found a roll-out screen assembly embodied in a cassette which may be readily inserted within the hollow of a framing section sized to receive said cassette or screen assembly. Further, nowhere within the art is there found a roll-out screen assembly embodied in a cassette having mounting brackets of a predetermined shape which may be readily inserted within the hollow or pocket of the same shape as the bracket disposed within a framing section and sized to receive said cassette or screen assembly. Further, nowhere in the prior art is there manufactured a screen having an abutment on one edge thereof for engaging with a cooperative abutment on the roller of a screen assembly which may be cut to size as desired to repair a roller screen assembly. Further, nowhere within the prior art is there found various improvements to roll-up screen assemblies to simplify their installation, adjustment and replacement.

Nowhere within the prior art is such a simplified improved screen assembly provided which retracts into the jamb, sill or header of the frame portion of a window assembly in the retracted position and which is preferably guided to its operative position in guides provided with the jamb, sill or header, and which allows for the manufacture of more durable screens in larger sections without continuously covering of the window and particularly when the window is in the closed position.

It is therefore an object of this invention to overcome many of the deficiencies in the prior art stated above which allows for smooth and simple operation of a retractable screen which is capable of both sliding within a guide channel between the retracted and the operative positions and which at the retracted position is fully contained within the jamb, sill or header section of the closure assembly.

It is a further object of the invention to provide a retractable screen assembly of appropriate size and construction to replace existing retractable screen assemblies for casement, double hung and/or tilt and slide windows as well as patio doors.

It is further a primary object of this invention to provide a roll-up screen embodied in the frame of a closure assembly which is retractable into the frame itself without requiring an additional housing.

It is a further object of the invention to provide a roll-up screen assembly in the form of a cassette which may be mounted within the hollow of a framing section, which cassette may or may not include a front fascia portion to close the framing section. When said cassette does not include a front fascia portion a clip on supplementary portion may be provided if required to close the framing section It is yet a further object of this invention to provide a continuous roll of screen manufactured so as to be cut at a predetermined width and include an anchoring element disposed adjacent one edge of the screen so as to allow ease of installation of the original or replacement screen so formed.

It is yet a further object of the invention to provide a method of manufacturing a screen.

It is yet a further object of the invention to provide a cassette which may be side mounted into an opening of the framing section and closed by an exterior fascia element.

It is yet a further object of the invention to provide a closure assembly including a roll-up screen contained with one of its framing sections adjacent the closure member.

It is yet a further object of the invention to provide improvements in mounting brackets, fascia elements, and screens.

It is a further object of this invention to develop a product that provides parallelism to opposing screen and handle edges which provides accurate paying out and accumulating on the roller so that the screen winds up precisely without twisting or binding.

It is a further object of the invention to provide a screen assembly having high strength and resistance to tearing which will not tear or peel from the corners and is easily able to accept dimensional variation in the window opening being covered.

It is a further object of the invention to provide a screen assembly which facilitates ease of manufacture, and replacement.

It is yet a further object of the invention to provide a screen cassette for a closure assembly which includes compatibly shaped pockets and brackets disposed with the closure frame and screen respectively to provide simple installation and maintenance.

It is yet a further object of the invention to provide improvements to the aesthetics of a screen cassette for a the closure assembly.

It is yet a further object of the invention to provide improvements to a screen cassette for any closure assembly regardless of the materials of manufacture used, for example wood, plastic, aluminum, and fiberglass or the like.

Further and other objects of this invention will become apparent to a man skilled in the art when considering the following summary of the invention and the more detailed description of the preferred embodiments illustrated herein.

SUMMARY OF THE INVENTION

This invention relates to a retractable screen system for a closure assembly and improvements thereof which allows the secure sliding and subsequent retraction of the screen from an operative position to a retracted position. The invention is preferably embodied in a window assembly but finds application also in large pivoting windows and patio doors. The closure member may further comprise a window sash being a casement, double hung, or tilt and slide installation or, a door or a patio door.

There is therefore provided improvements to screen assemblies, wherein the entire screen assembly is contained within the framing sections found adjacent to a closure member in a closure assembly, for example a window assembly. Further a roll-out screen assembly is embodied in a cassette which may be readily inserted within the hollow of a framing section sized to receive said cassette or screen assembly. The screen material has an abutment on one edge thereof for engaging with a cooperative abutment on the roller of a screen assembly which may be cut to size as desired to repair a roller screen assembly which simplifies their installation, adjustment and replacement.

There is also provided a simplified improved screen assembly which retracts into the jamb, sill or header of the frame portion of a window assembly in the retracted position and which is preferably guided to its operative position in guides provided with the jamb, sill or header, and which allows for the manufacture of heavier screens in larger sections without continuously covering of the window.

In a tilt and slide, casement or double hung window a retractable screen is provided disposed within the header, sill or jamb of the assembly which screen accumulates on and pays out from a spring biased roll disposed within said header, sill or jamb, the screen being retractable for egress or cleaning purposes, and available as desired by providing a detent on the opposing framing member engageable with a detent provided with the screen when in its operable position.

According to yet another aspect of the invention there is provided a window assembly comprising a retractable screen disposed within a framing portion of the assembly, the screen accumulating on and paying out from a spring biased roll disposed within said frame portion, the screen being retractable for egress or cleaning purposes, and available as desired by providing a detent on the opposite frame portion engageable with the screen when in its operable position.

According to yet another aspect of the invention there is provided a closure assembly comprising a retractable screen disposed within a framing portion of the assembly, said framing portion providing a pocket within which the screen is contained in use, said pocket being bound by three sides of said framing portion thereby forming said pocket, said pocket being closed by a separate cover closing said framing portion, preferably said retractable screen being mounted on said cover and being positioned in said pocket when the cover closing the pocket is installed preferably by clipping a detent provided with said cover in a channel provided with one of the sides of said framing portion providing the pocket, the screen accumulating on and paying out from a spring biased roll disposed within said frame portion, the screen being retractable for egress or cleaning purposes, and available as desired by providing a detent on the opposite frame portion engageable with the screen when in its operable position.

According to yet another aspect of the invention there is provided a continuous screen formed as a continuous web and adapted to be utilized for a retractable screen for windows, doors and the like having a predetermined width of screen determined by the width or length of the closure member frame, said width of said screen having two ends, preferably each of the ends having an anchor or key shaped element fixed thereto adapted to engage a detent on a handle proximate one end of the screen and adapted to engage a detent of a preferably spring biased, preferably hollow, roller utilized for taking up and letting out the screen in a coil upon said roller, alternatively the handle end of the screen alternatively having a tape or continuous strip of adhesive applied thereto so as to engage and be captured by a handle portion of said screen when utilized in a closure assembly, said screen and said anchor or key shaped elements being cut at a predetermined length to fit said roller when assembled and being installed with said closure assembly and preferably within a hollow of one of said frame sections, wherein said screen may be utilized as an original installation or as a replacement screen for an original installation.

According to yet another aspect of the invention, there is provided a retractable screen assembly for a closure assembly, said closure assembly including a closure member surrounded by framing portions from which the closure member is supported, said closure member including framing sections, one of said framing sections providing a pocket within which said screen assembly is retained in use, said screen assembly comprising a cassette engageable with the interior of a cover utilized for closing the framing portion and pocket of the closure assembly, preferably said pocket being located proximate the sealing end of the closure member, said retractable screen including a handle portion affixed thereto including a first detent, the opposite jamb from said pocket including a latching portion including a second detent which engages the first detent of the handle portion when the screen is in the fully open position, wherein said cassette may be installed within any convenient pocket disposed within the framing portions of a closure assembly and fixed in position once the cover covering the pocket is installed. In a preferred embodiment, brackets are provided having channels which capture preferably T-shaped guides on the interior of said cover which allow for the fixing of the brackets in relation to the specific screen assembly being installed, said screen assembly also including a hollow tube to which said screen is anchored via a detent on the tube and via a detent on one end of said screen, the other end of said screen including another detent for engaging with the detent of a handle portion of said assembly, said tube having inserted within the ends thereof a pin assembly which will not rotate in relation to said tube as a result of rib portions disposed with said assembly engaging rib portions disposed within the hollow of said tube, each of said pin assemblies including a pin for engaging a pin-receiving opening disposed with each of said brackets, wherein said brackets may be fixed with respect to the interior of said cover thereby fixing the entire screen assembly as a cassette, one of said brackets being adjustable in relation to said torque tube in order to allow for adjustment and variations from installation to installation, preferably said handle portion including telescoping guides which capture the ends of said screen and are retained within a hollow within said handle, said guides for riding within a channel disposed with opposite or opposing framing sections to guide the screen across the opening defined by said closure member when desired. In an alternative embodiment, the brackets may include a box-like element which rests at the bottom of a framing section and being locked in position because of the compatible dimension of the bracket with the pocket of said framing section and adjustable in position in relation to the bottom of the framing section in order to provide for variations in manufacturing.

According to yet another aspect of the invention, there is provided a method of assembling a retractable screen cassette comprising:

(1) providing a tube upon which said screen will coil up in use, (2) providing a pin assembly insertable into the open ends of said hollow tube and being prevented from rotating with respect to said tube as ribs disposed with said tube, engaged ribs disposed with said pin assembly, (3) providing a torsion spring having ends which are engageable with at least one of said pin assembly ends for providing the correct torsion and tensioning of said spring, (4) inserting said spring within the hollow tube and inserting said pin assemblies within said hollow tube and fixing the preferred one end of said pin assembly to the tyne portions of said torsion spring, (5) providing brackets from which said pin assemblies will be adjustably inserted, said brackets being locked in place with respect to the assembly, preferably either by engaging with a detent provided with a flexible cover or alternatively by engaging with the bottom pocket of the framing section, (6) adjusting said brackets in relation to the distance from one another so as to correctly tension and carry the screen assembly, (7) fixing said screen on said screen assembly by anchoring said screen to said tube via a detent, preferably a T-shaped detent or key for engaging with a key slot on the tube or alternatively by using welding or adhesive, and coiling said screen upon said tube, (8) fixing said opposite end of said screen to a handle portion either preferably by a T-shaped detent engaging a T-shaped detent with said handle, or by welding or an adhesive, (9) coiling said screen upon said tube,

(10) preferably engaging said cover portion with said brackets,

(11) inserting said screen assembly within a pocket of said closure assembly in one of the framing portions thereof,

(12) covering said pocket with a flexible cover.

According to yet another aspect of the invention, there is provided a continuous roll of screen which may be payed out from said roll by an installer or manufacturer to a required predetermined window size, or alternatively patio door size, said screen comprising a free end which allows the installer to pay the screen off of the roll upon which the screen is accumulated course upon course, one end of said screen being disposed at the end of the courses accumulated on the roll from which the screening is payed off and the other end being a free end, said screen having side edges and preferably being manufactured from preferably vinyl-coated fiberglass, the edges of said screen having affixed thereto a generally preferably T-shaped key manufactured from a flexible material, for example polyvinyl chloride, which is affixed preferably by radio frequency welding (or RF welding) with the edges and preferably each of the edges, and in one embodiment at least one edge of said screen, wherein the vinyl coating provided on the screen melds with the polyvinyl chloride key to form a resilient anchor for the screen device within any screen roller assembly. Preferably the polyvinyl chloride preferably generally T-shaped key has a head extending from a leg in the shape of a preferred T, or alternatively a Y, or any other convenient shape so long as said shape is compatible with the receiving groove on the handle and roller tube, the leg of said key preferably including two separable portions within which the edges of a screen interfit prior to RF welding. The screen is payed off of the roll upon which it is accumulated to the desired dimension of the window or closure such as a patio door wherein the screen will be installed, said screen being cut at that predetermined length cutting also the key proximate at least one end of said screen, said screen thereafter being installed in the screen assembly or alternatively replacing the existing screen in a convenient quick replaceable format. Preferably the generally key-shaped edge portion of the screen having the two legs which capture the screen therebetween prior to RF welding includes an extension portion between the head of the preferably T-shaped key and the two portions capturing the screen and said extension not being RF welded to the screen. This extension portion is utilized to provide a flexible zone and accommodates flexing in the screen assembly in a zone other than the screen. This zone is designed to stretch a predetermined amount and thereby minimize tearing of the screen when subjected to a tensioning load. In a preferred embodiment, the screen which is cut to size for the assembly is installed in a screen assembly with one of the keys being installed in a preferably spring-biased roller upon which the screen will accumulate, and the keyed edge remote said roller is attached to a handle, said roller and said handle each having a compatibly-shaped groove, channel or recess disposed therein to capture the key portion proximate the edges of said screen. In a preferred embodiment, the screen is included in a screen roller assembly embodying a cassette which is installed within a pocket defined in a closure assembly of any of the closure assemblies defined above in any of the apparent applications which are hereby incorporated by reference. The screen assembly may also be utilized in known conventional window assemblies. The pocket provided in the window frame is sized of a predetermined shape to accept the roller screen assembly which includes all of the necessary mounting pivots and preferably the mounting brackets to mount the roller screen assembly within the pocket in the window frame and preferably proximate the inside corner of the jamb or sill or header, depending on whether the window is a tilt-and-slide window or a double-hung window. For example, a jamb pocket would comprise two inside sides of a jamb of a window or patio door frame assembly, said jamb provides a pocket between said sides within which said roller assembly may be installed utilizing a corner bracket installed where the two sides of the jambs meet, or substantially at that point. The jamb sections or alternatively the sill and header also include recesses proximate the distal ends thereof for each of the sides thereof to accommodate a snap-fit cover. In this way, the roller assembly can be proofed, that is to say installed and tried and proven prior to installing the cover unlike the previous embodiment which described the roller cassette being installed on the cover and being snapped into place. It has been discovered that it is much more efficient and convenient to install the roller assembly separately in the pocket utilizing a corner bracket and a snap cover.

In another embodiment, the roller assembly is installed within a casement window assembly. In a further embodiment, the roller assembly is installed within a tilt-and-slide window assembly. In another embodiment, the roller assembly is installed within a double-hung window assembly. In another embodiment, the roller assembly is installed within a patio door assembly.

In a preferred embodiment, any of the aforementioned window assemblies may further comprise grooves disposed adjacent to the sill and header, or alternatively the vertical jambs depending on the window type to receive an extension portion of the handle of the screen assembly also engaged with the keyed edges of the screen assembly described above and at the same time engaging the grooves (or channels or the like) to maintain the parallelism of the top and bottom or side portions in motion depending again on the window type as the screen is payed out and accumulated on the screen roller contained with the pocket provided in the frame.

In a preferred embodiment of the invention, the handle portion disposed proximate one edge of said screen assembly includes a latch portion, which is preferably disposed centrally in the handle portion, said latch portion for engaging a compatible detent disposed proximate the edge of a window sash and moveable between a position wherein said latch engages said detent of said window sash whereat when said window sash is slid within its track, said screen will pay out from said roller automatically, and when said window is returned to its closed position said screen will accumulate on said roller automatically, wherein at an unlatched position said window will move between its opened and closed position without the screen, wherein should it ever be required to re-engage the screen with the detent on the window sash, the user merely slides the window to the closed position wherein the latch of said screen will engage with the detent of said window sash automatically. Preferably the leading edge of said detent provided with said window sash has a chamfered edge to cause the latch including a hook portion to ride up on said chamfered edge and engage with a compatible hook portion disposed with said detent of said window sash.

According to yet another aspect of the invention, there is provided a method of manufacturing a screen roller assembly comprising the following steps:

1) forming a screen from suitable screen material such as fiberglass and preferably coating said screen with vinyl,
2) forming a generally key-shaped anchor for said screen preferably from polyvinyl chloride, preferably said key having a head and a leg comprising two portions and a connector connecting said leg to said head, preferably said head being generally T-shaped,
3) separating the two leg portions for receiving the edges of said screen,
4) radio frequency welding said leg portions capturing said edges of said screen and preferably melding said vinyl of said screen with the PVC of said key,
5) forming a continuous screen to be accumulated on a roll as roll stock to be supplied to the window manufacturer or repair organization, wherein at any time a predetermined amount of screen may be payed off the roll stock roll sized to a predetermined window opening size which may be easily assembled with the spring-biased roller upon which the screen will accumulate by a manufacturer or by a repair person and which also may be engaged with the handle portion proximate the other edge of said screen, both said roller and said screen handle including a compatibly shaped generally key-shaped receiving portion to receive the head of said key for easy installation or replacement thereof.

In a preferred embodiment, the screen may be installed in any assembly as a replacement screen.

It is important that the legs of the key portion be separated from the head portion by a flexible extension to allow for the accommodation of stretching in the screen assembly at that particular location when assembled without destroying the screen. It has been found that the screen when melded together with the PVC key has considerably more strength than the known methods of taping and gluing screen edges to rollers and handle portions. The flexibility is provided by the flexible key shape and material. Any suitable material can be utilized including those materials which readily accept hot welding. However, radio frequency welding is preferred because one does not have to allow for creeping of the material and the allowances of temperature differentials. Cold dies may be provided which come together to provide a reliable joint which may be accurately controlled.

The present invention advantageously fits into any existing frame design thereby reducing cost, easing assembly and improving appearance. It is only necessary to provide a pocket with the jamb, header or sill of any window design within which the screen roller assembly is placed preferably as a cassette.

According to the latest aspect of the invention a roll of improved continuous screening is provided comprising a preferably "T" shaped edge preferably formed from tough flexible material fused to the screen material along the edges of the screen to which a handle and roller drum are to be fixed, preferably said "T" edge being provided proximate both edges of a continuous roll of mesh. Since any excess screen material is stored on a screen roller making up the screen assembly as previously described one may only need as little as one or two standard widths of screen size to service the industry. The other dimension is cut to length and need not be accurate as it rides in a track in the window assembly.

To produce a screen one cuts from roll stack the "T" edge screen to fit inside the frame opening of the window allowing for the guiding track depth less any clearances required. The roller drum and handle are cut to screen length providing for clearance as required. The "T" edge of the cloth is slid into the drum slot and the other "T" end being slid into the handle slot thereby fixing the screen to the critical components. A telescoping glide with its own "T" slot groove supports the screen in the guide track at each end thereof and allows the glide the freedom to move back and forth on the "T" edge of the screen taking up the opening tolerance.

Because the "T" edge is flexible and able to stretch, any local load on the screen cloth will distribute itself over a wide range of fibers of the screen thus improving the impact and tear resistance of the system. In the event that screen was pushed it would pay out the stored material to the end limit reducing dramatically the stress forces on the system. With the high tensile capability of the "T" edge system, the risk of failure of the system is greatly reduced. In servicing a screen that is already installed on site, a bolt of screen cloth carried by the service person need only be cut to the right length, the cover removed from the system to give access, the old screen cloth slide out and the new screen cloth rethreaded. There is no need for any other component replacement if they are sound.

In a preferred embodiment the "T" shaped key may further comprise a "T" head, which will hold the screen into a compatible substantially dovetail-like groove disposed with the roller and/or the handle, a fusing zone where the screen is fused to the "T" with the head being preferably a min. 0.375 inches, and a body zone between the head and the fusing zone with no screen material for providing the flex and stretching of the screen. It is important that the screen cloth be integrally fused to the key over some distance to achieve maximum strength.

The screen is self storing within the frame of the window by virtue of accumulating on a roller similar to the operation of a roller blind. It is payed out by pulling on a full length handle which is guided by a rail at each end. The window frame includes a guide channel for the screen which tracks and covers the free edges of the screen. The handle provided with the screen engages the adjacent sash frame section with latch detents provided which will maintain the screen under tension from the dispensing drum and covers the opening created when the sash is opened by sliding in the track wrinkle free and bug tight.

According to yet another aspect of the invention there is provided a closure assembly comprising a retractable screen disposed within a framing portion of the assembly, said framing portion providing a pocket within which the screen is contained in use, said pocket being bound by at least two sides of said framing portion thereby forming said pocket, said pocket being closed by a separate cover closing said framing portion, being positioned with respect to said pocket prior to the cover closing the pocket is installed preferably by clipping detents provided with said cover clipping into in a channel provided with at least one of the sides of said framing portion providing the pocket, the screen accumulating on and paying out from a spring biased roll disposed within said frame portion, the screen being retractable for egress or cleaning purposes, and available as desired by providing a detent on the opposite frame portion engageable with the screen when in its operable position.

In one of the alternative embodiment described above, the mounting brackets may include a box-like element which rests at the bottom of a framing section and being locked in position because of the compatible dimension of the bracket with the shape of the pocket of said framing section and adjustable in position in relation to the bottom of the framing section in order to provide for variations in manufacturing. Applicant has focused on this approach in relation to the latest cassette embodiments for roll screen installations requiring no fasteners as described in relation to the brackets of most of the previous embodiments. Although the invention is described in relation to screens its is implied that the structures defined herein equally apply to other materials which accumulate on a roller such as blinds, window shades and the like.

According to a primary aspect of the improvements to the aforementioned inventions, there is provided a closure assembly comprising a frame for moveably retaining a closure member, said frame comprising a header, sill, and vertical jamb sections, at least one of said sections including at least one pocket formed within the interior thereof, said at least one pocket having a first predetermined configuration defined by the interior of the section and for receipt of a roll screen pivotally supported upon at least one bracket having a second predetermined configuration compatible with said at least one pocket having a first predetermined configuration, said at least one bracket utilized with a second bracket and preferably like in kind to said at least one bracket for removeably retaining the roll screen, said at least one bracket and preferably said second bracket being removeably held in position with respect to said frame only by said at least one pocket having a first predetermined configuration and said at least one bracket having a second predetermined configuration compatible with said at least one pocket and being located in said at least one pocket in use, wherein the compatible shapes of said at least one pocket and said at least one bracket cooperate to prevent the at least one bracket from rotating with respect to the at least one pocket and said frame when said roll screen is let out or taken in.

According to a another aspect of the invention, there is provided a closure assembly comprising a frame for moveably retaining a closure member, said frame comprising a header, sill, and vertical jamb sections, at least one of said sections including a pocket formed within the interior thereof, said pocket having a first predetermined configuration defined by the interior of the section and for receipt of a roll screen pivotally supported upon a pair of brackets having a second predetermined configuration compatible with said pocket having a first predetermined configuration, said pair of brackets utilized for removeably retaining the roll screen, said pair of brackets and being removeably held in position with respect to said frame only by said pocket having a first predetermined configuration and said pair of brackets having a second predetermined configuration compatible with said pocket and being located in said pocket in use, wherein the compatible shapes of said pocket and said pair of brackets cooperate to prevent the pair of brackets from rotating with respect to the pocket and said frame when said roll screen is let out or taken in.

In a preferred embodiment an edge of said section having said pocket and forming the frame may further comprise a supplementary portion in use preferably being snap fit into a retaining portion provided with the section for closing the section. In a preferred embodiment the frame is made up of standardized sections which all include pockets. This feature allows for ease of manufacture and minimum inventories.

According to a yet another aspect of the invention, there is provided a roll screen cassette for installation in a closure assembly having a frame for moveably retaining a closure member, said frame including a header, sill, and vertical jamb sections, at least one of said sections including a pocket formed within the interior thereof, said pocket having a first predetermined configuration defined by the interior of the section and for receipt of the roll screen, said roll screen comprising a pair of brackets from which said roll screen is pivotally supported, said pair of brackets having a second predetermined configuration compatible with said pocket of said frame section having the first predetermined configuration, said pair of brackets utilized for removeably retaining the roll screen within said pocket in use, said pair of brackets and roll screen being removeably held in position with respect to said frame only by said pocket having the first predetermined configuration and said pair of brackets having a second predetermined configuration compatible with said pocket and being located in said pocket in use, wherein the compatible shapes of said pair of brackets and said pocket when installed in said frame section cooperate to prevent the pair of brackets from rotating with respect to the pocket and said frame when said roll screen is let out or taken in use.

In a preferred embodiment the first and second configurations for the pockets and brackets respectively are arc shaped (portions of an arc of a circle). Alternative embodiments may be of any compatible geometry (for example, rectangular, hexagonal and triangular or the like). Installation of the screen for example in a tilt and slide window is as follows. Other window installations are similarly installed with the exception that, for example with double hung windows the upper and lower brackets are left and right brackets.

The header frame section of the frame housing the upper screen bracket includes a void positioned above the jamb section pocket for temporary receipt of the bracket to allow for the bottom bracket to be positioned so as to avoid contact with the sill section by raising the upper bracket into said void providing a temporary clearance for the bottom bracket to allow it to be rotated and positioned in the pocket of the jamb. The bottom sill portion of the frame which houses the bottom bracket includes a supporting shelf for the bottom screen bracket. The roll screen carrying the top and bottom screen brackets is positioned to engage the upper portion of the frame firstly with the upper bracket extending into the pocket. The bracket is subsequently raised into the void provided with the header so that the bottom bracket clears the sill and the support shelf therein. The screen is then pivoted around the top bracket so as to be parallel to the supporting jamb frame and the bottom bracket is subsequently dropped into position so that the upper and lower brackets with predetermined shapes engage with compatible shapes of the pockets of the jamb section. No further assembly is required with the exception of the option of the snap fit supplementary portions. The screen and screen support components and the method of manufacturing the screen and assembly of the screen and screen support components are otherwise identical in makeup and function to previous embodiments described.

According to still yet another aspect of the invention there is provided a closure assembly comprising a retractable screen disposed within a framing portion of the assembly, said framing section including a pocket having a predetermined shape, the screen accumulating on and paying out from a spring biased roll pivoting on brackets having the same predetermined shape as the pocket, said screen and brackets being constrained within the pocket of said frame portion without the need of fasteners, wherein the screen is retractable for egress or cleaning purposes, and available as desired, preferably by providing a detent on the opposite frame portion engageable with the screen when in its operable position.

BRIEF DESCRIPTION OF THE DRAWINGS

FIGS. 29A through 29C are side, top and end views of the guide portion illustrated in FIG. 19 and shown here in a preferred embodiment of the invention.

DETAILED DESCRIPTION OF THE PREFERRED EMBODIMENTS

Figure 1:
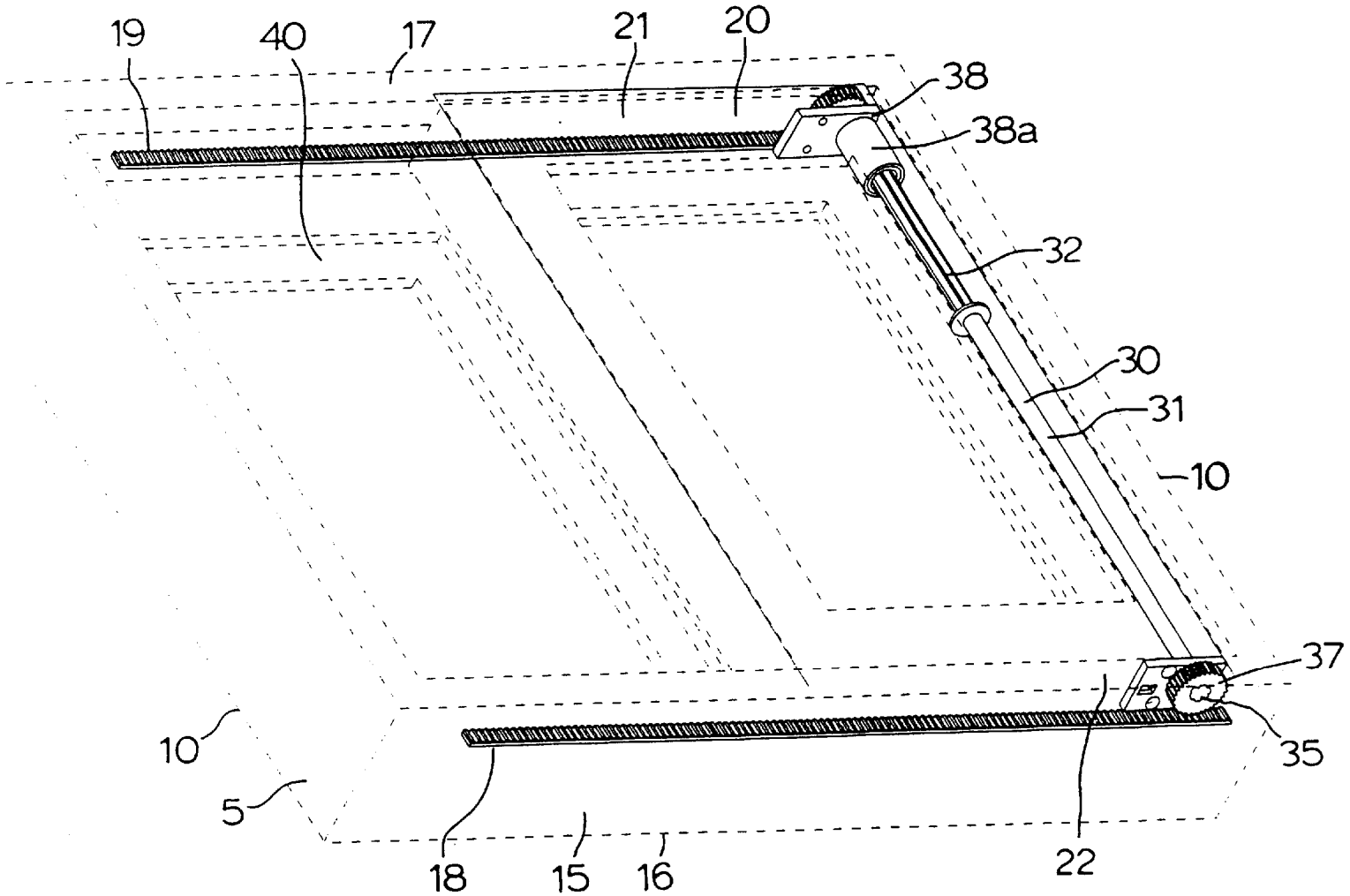
FIG. 1 is a schematic perspective view of a tilt and slide window, wherein said windows move in a horizontal direction, illustrated in a preferred embodiment of the invention.
Figure 2:
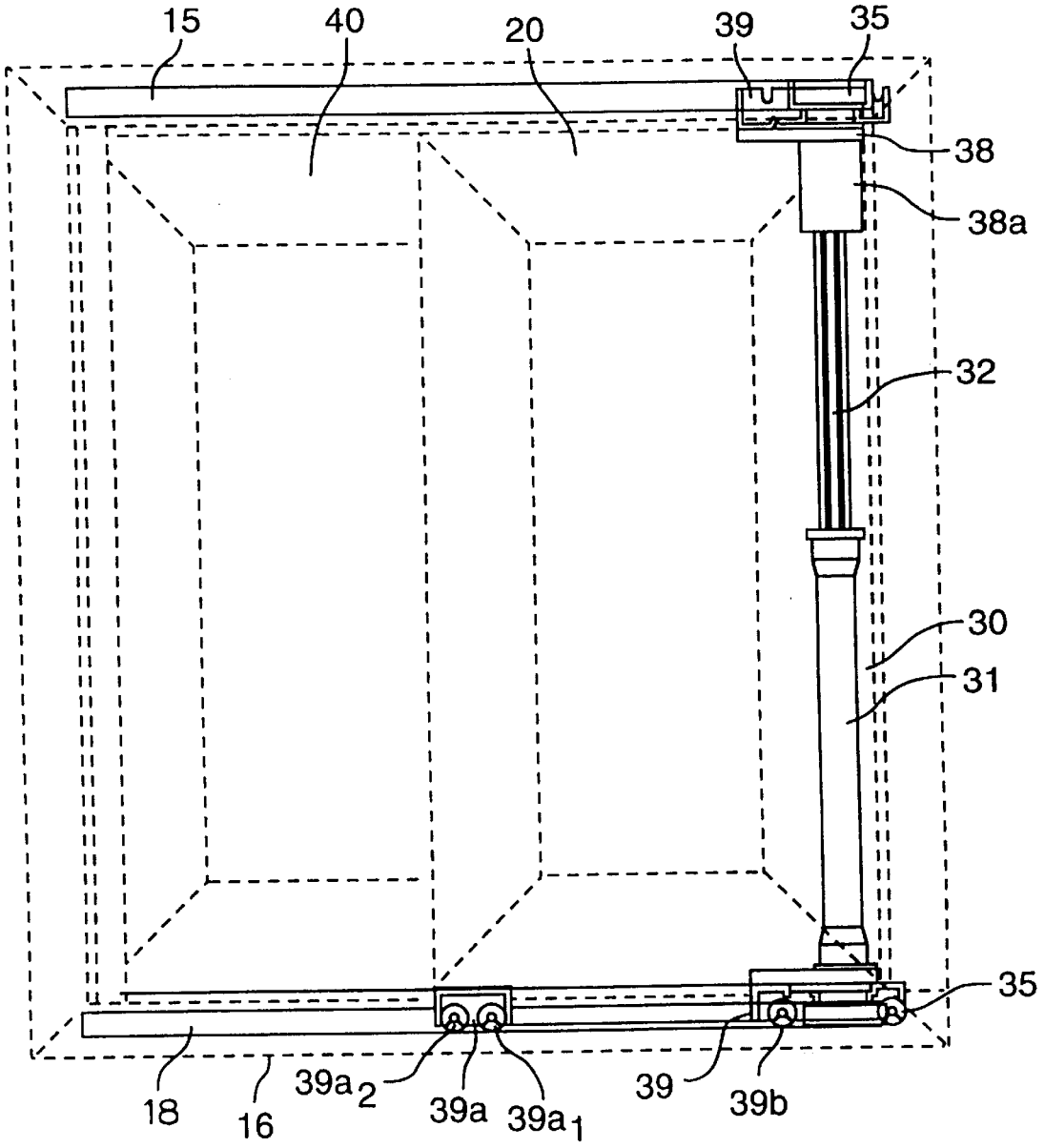
FIG. 2 is a front view of the window of FIG. 1.
Figure 2A:
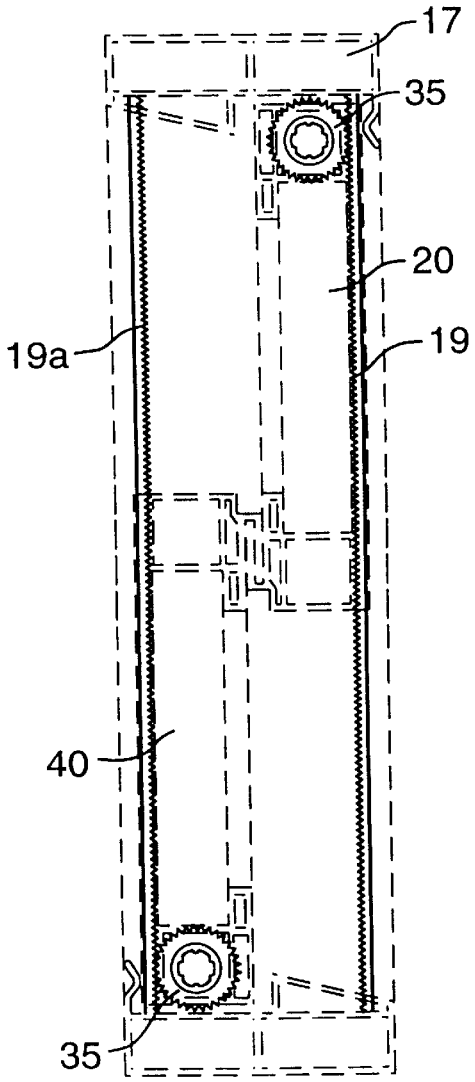
FIG. 2A is a top view of the window of FIG. 1.
Figure 2B:
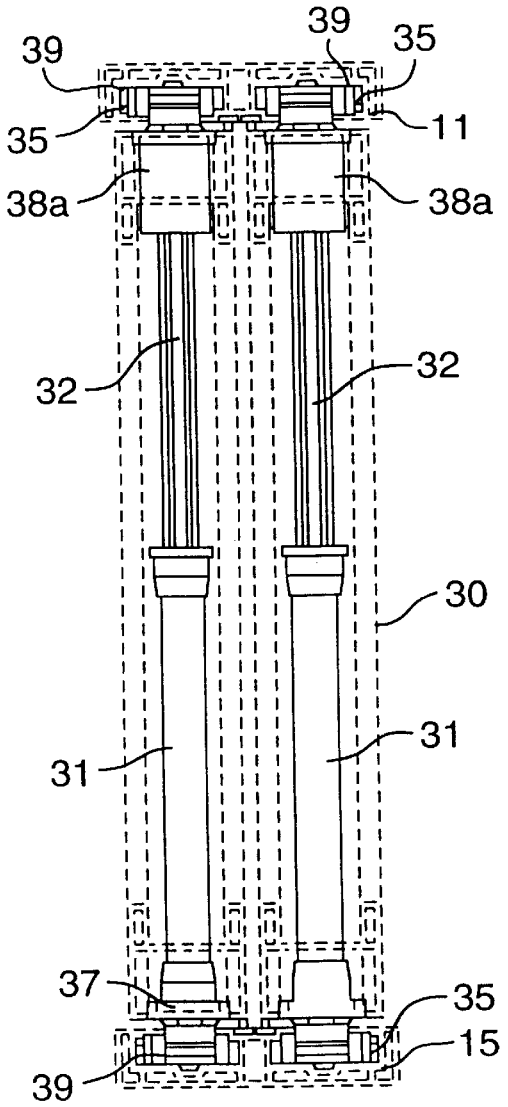
FIG. 2B is a end view of the window of FIG. 1.
Figure 2C:
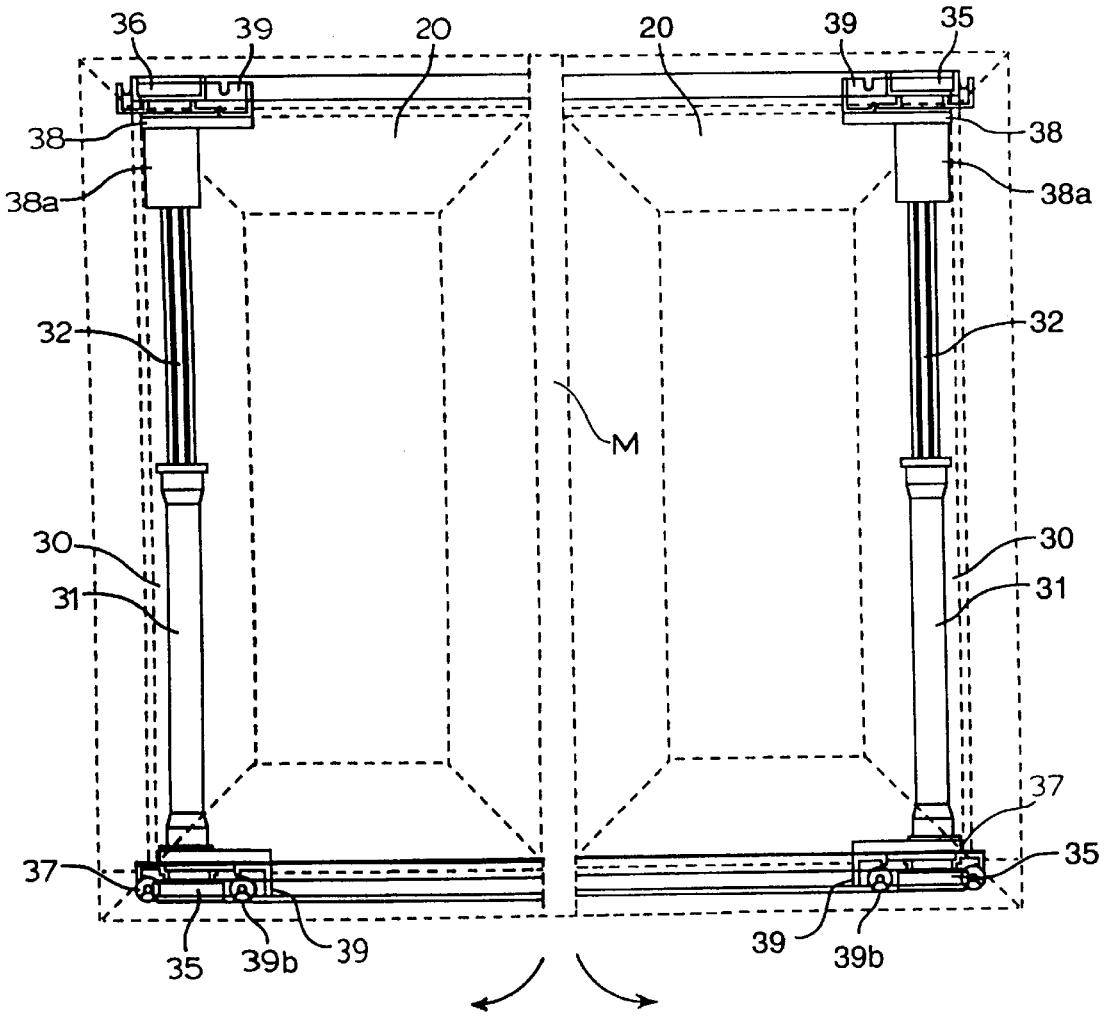
FIG. 2C illustrates the invention used with a casement window.

Referring now to FIGS. 1, 2 through 2C there is illustrated a tilt and slide window assembly. Therefore the assembly 5 includes an outer frame portion 10 which is normally hung within an opening established in a building (not shown). Normally nailing flanges are provided for this purpose attached to the outer frame 10. The frame 10 includes top portion 17 and bottom portions 16 having tracks disposed therein, as best seen in relation to FIG. 2. Within the tracks are contained a pivot assembly which will be hereinafter described.

Primarily the pivot assembly includes a pinion 35 and carriers 38 and 37 interconnected by interconnecting portions 32 and 31 making up an interconnecting member 30. The pinions move, as the window 20 is slide in the track portion by the movement of the pinion 35 with respect to the rack 18 or 19 respectively. In this way the pinions 35 being interconnected remain parallel at all times in their motion along the track within which the rack 19 or 18 is disposed. The hardware is shown in normal view while the window assembly is shown in dotted lines, to illustrate the essence of the assembly.

Referring now to FIG. 2 there is illustrated the window of FIG. 1, wherein a window 20 and 40 is slidable within a track 15 and 17 upon a shoe 39. The lower shoe 39 also is connected to a secondary show 39*a* for carrying the window which includes rollers 39*b*, 39*a*1 and 39*b*2 on the bottoms thereof respectively for ease of movement within track 17. The pinion 35 rests within the shoe 39 as will be described hereinafter. The arrangement of the interconnecting portion 30 will also be described hereinafter. Window 40 therefore has its own interconnected system as can be best seen in relation to FIGS. 2*a* and 2*b*.

Referring now to FIG. 2A there is illustrated the sash elements 20 and 40 and the rack portions 19 and 19*a* which accommodate the motion of the pinion 35 along a full length of the track, as best in FIG. 2B.

Referring to FIGS. 1, 2 to 2B clearly the track portion 17 and 15 cooperate with the rack portions 19 and 19*a* to provide for the pinion 35 and its motion when the window remain slidable within the track. By interconnecting the two pinion portions and hence the two pivot shoes, by interconnecting means 30, the shoes remain in a substantially parallel position in relation to one another at all times. This overcomes the problem described in the background of the prior art. By remaining parallel it is almost impossible for the window therefore to come out of the track when the window is pivoted to be cleaned and therefore is no longer necessary to provide braking portions as in previously described inventions of Canadian Thermo Windows, as referred to in the background of the invention.

Figure 1A:
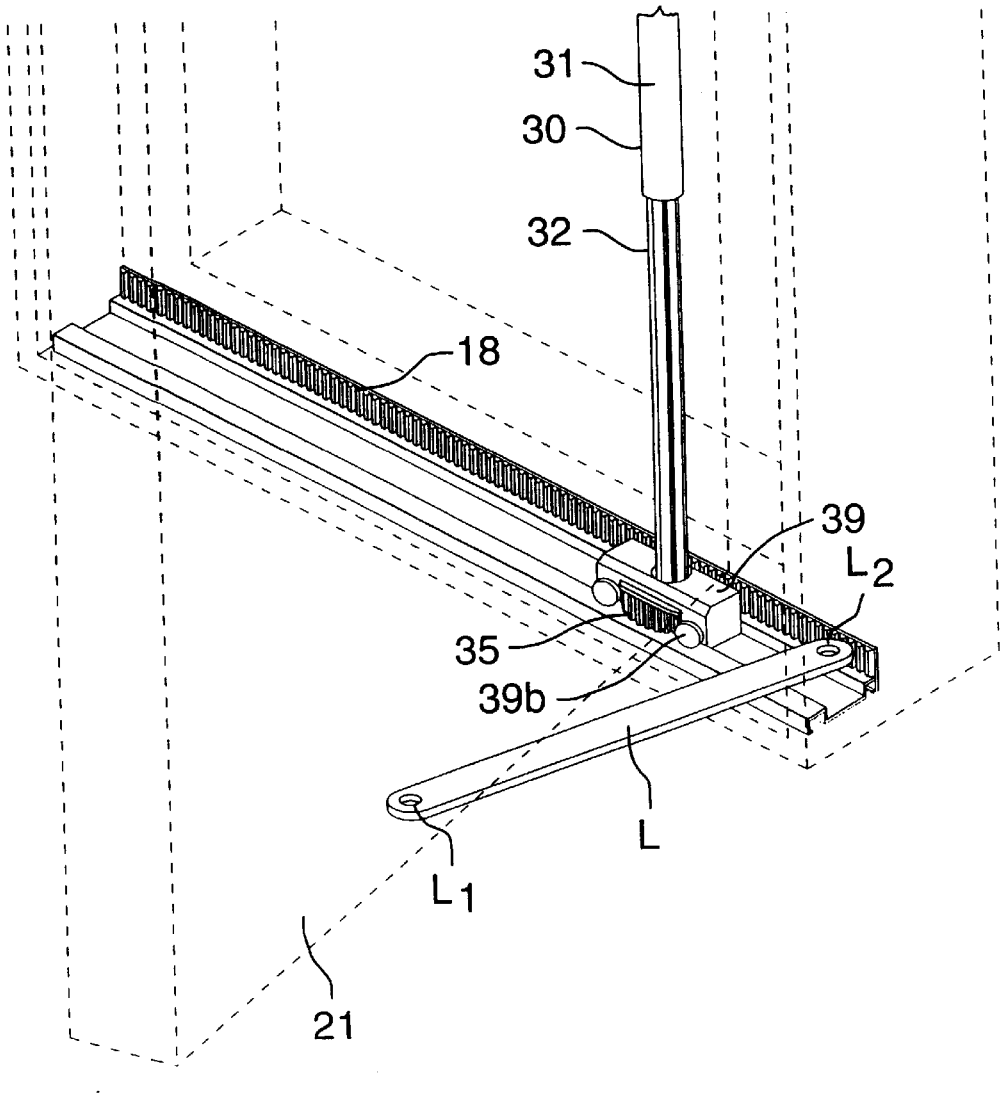
FIGS. 1A and 1B are partial schematic perspective views of casement style windows embodying the invention and depicting the motion thereof and illustrated in a preferred embodiment of the invention.
Figure 1B:
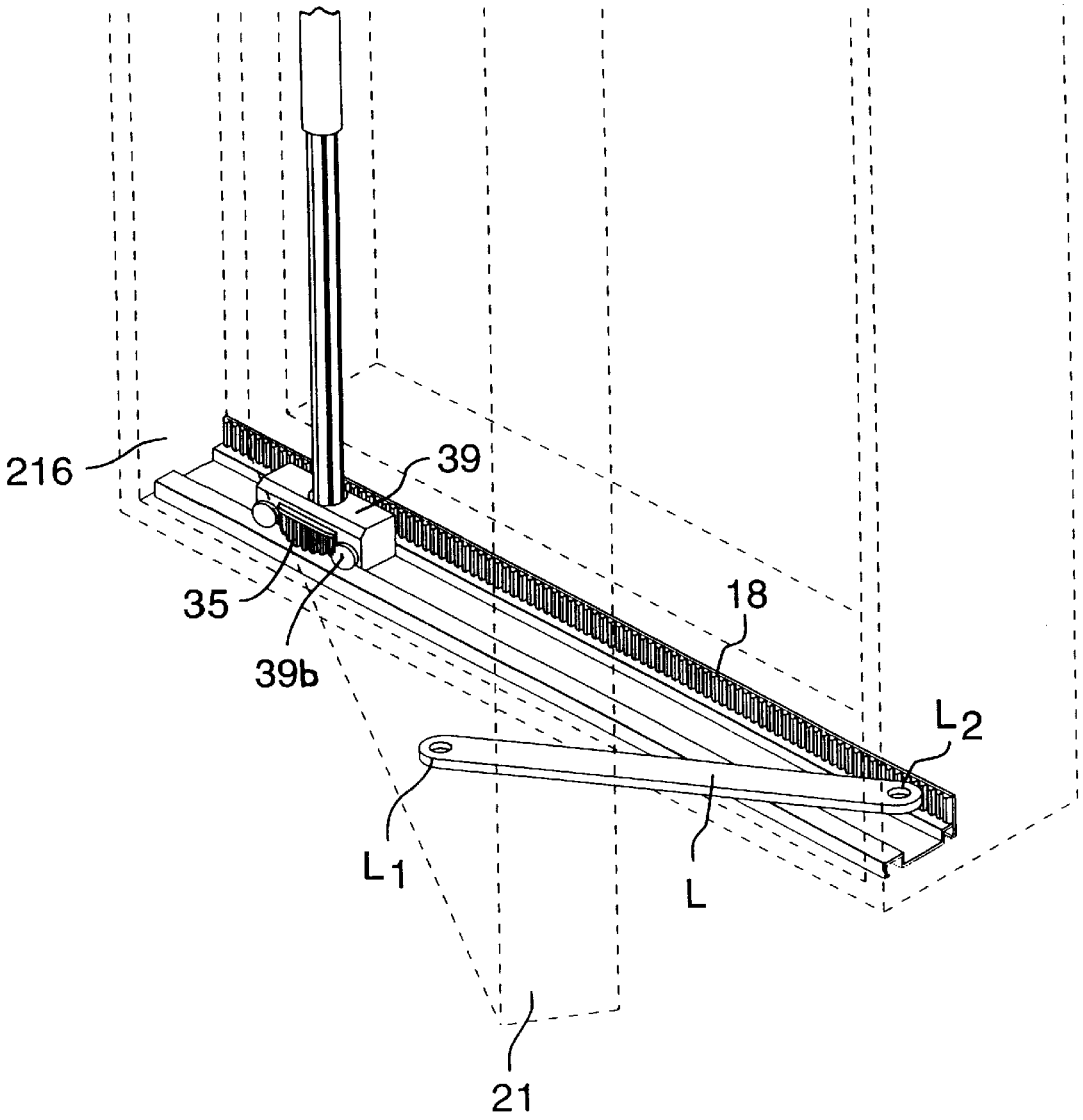

Referring to FIGS. 1A and 1B there is illustrated a casement style window having similar components to that found in relation to FIG. 1 with the exception of only one sash being provided being secured on shaft assembly 30 including portions 31 and 32. A link L is provided secured proximate ends L1 adjacent the center of the sash 21 proximate the bottom thereof and adjacent the track 18 adjacent the opening end of the window sash 21. By positioning the sash in this manner a full range of pivoting motion is available. If the link end L1 is removable than the window sash may be moved totally to the opposite end remote the pivoting end 21*b* on shoe 39. As with the case of the tilt and slide window a shoe 39 containing a pinion is provided. The pinion is connected to the shaft 30 and engages the rack 18 as it moves along the window sill and header in parallel arrangement between the upper and lower pivots maintained in parallel by the shaft 30. In this manner the casement style window may be pivoted as normal to an open position, and the pivoting end may be moved to the other end of the window frame away from side 21*b* to allow ease of cleaning. By supplying the hardware described without a casement sash the casement window may be assembled without the need for expensive pivots and linkages and without a great deal of assembly labour. As best seen in FIG. 1D for the casement style window in particular a rollaway screen S may be provided which is housed in jamb 17*a* as illustrated. The screen S pulls across to engage detent D1 with detent D2 in jamb 16*a*, whereat it may be locked. This allows a user to clean the glass of sash 21 on the inside without removing the screen.

Figure 1C:
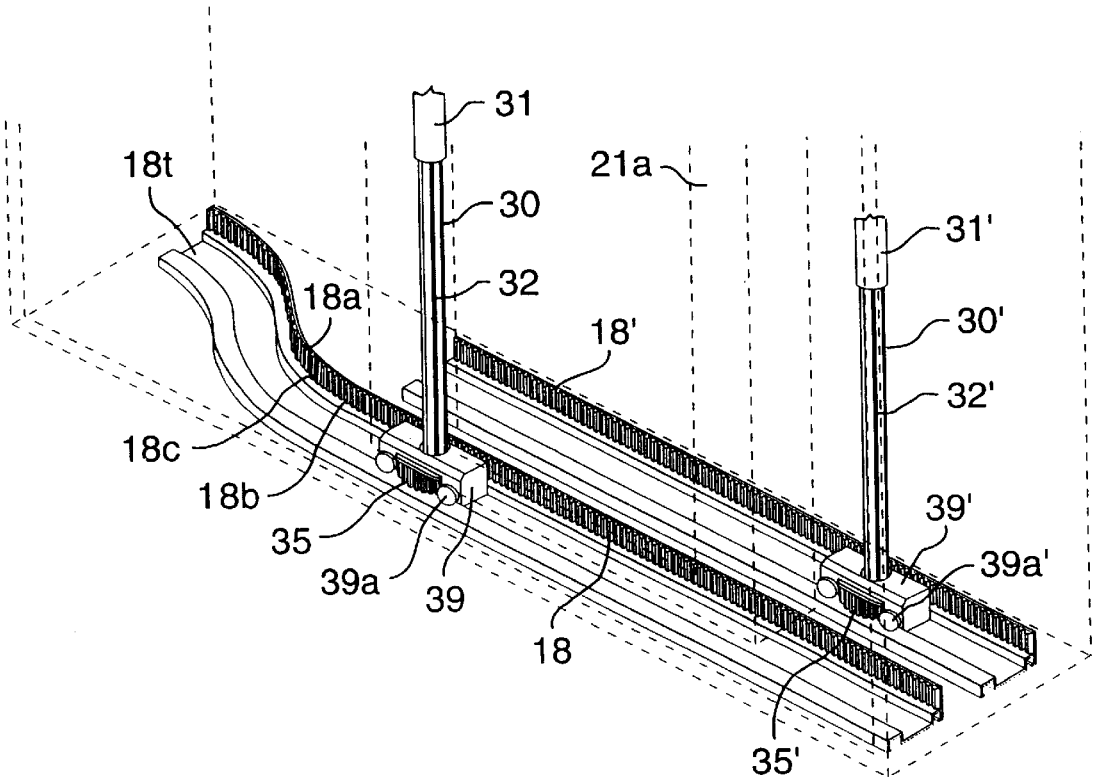
FIGS. 1C is a partial schematic perspective view of straight line windows embodying the invention and depicting the motion thereof and illustrated in a preferred embodiment of the invention.
Figure 1D:
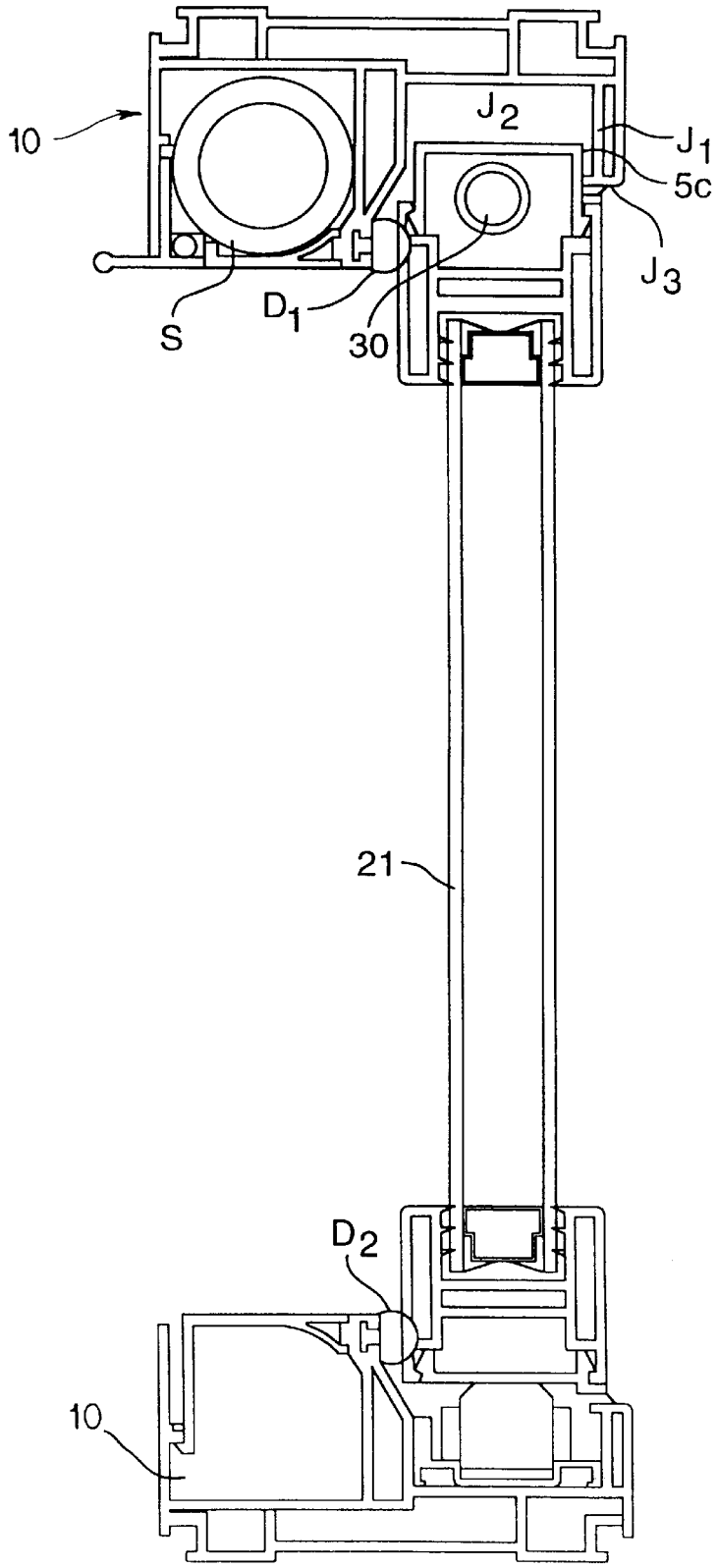
FIGS. 1D is a partial cutaway view of the casement style windows of FIG. 1A depicting a rollaway screen thereof and illustrated in a preferred embodiment of the invention.

Referring to FIG. 1C there is illustrated a tilt and slide type window similar to FIG. 1 with the exception that when closed the window sashes will be oriented in a straight parallel line with one another. In order for this to happen the rack provided 18 includes a portion 18*a* made from fiber filled plastic or the like and joined at seam 18*c* to an aluminum track 18*b*. The sash 21 is therefore moveable as previously described on carrier 39 and rollers 39*a* as urged by pinion 35 until the pinion reaches the curved portion of the track 18 a wherein the assembly 30 will move along the curve to the terminus of the track 18*t*. The sash portion 21*a* will then lock in behind the edge of the sash contained in track 18' and be lockable at that position. The sash 21' (not shown) resides on assembly 30' in track 18'. As pinion 35' moves within the limits of rack 18' the sash 21 cannot adopt a parallel position unless sash 21' is in its fully closed position. Only then can the end 21*a* adopt its fully closed position butting up against the sash 21' at the end opposite the carrier assembly 30 and 39.

Figure 3:
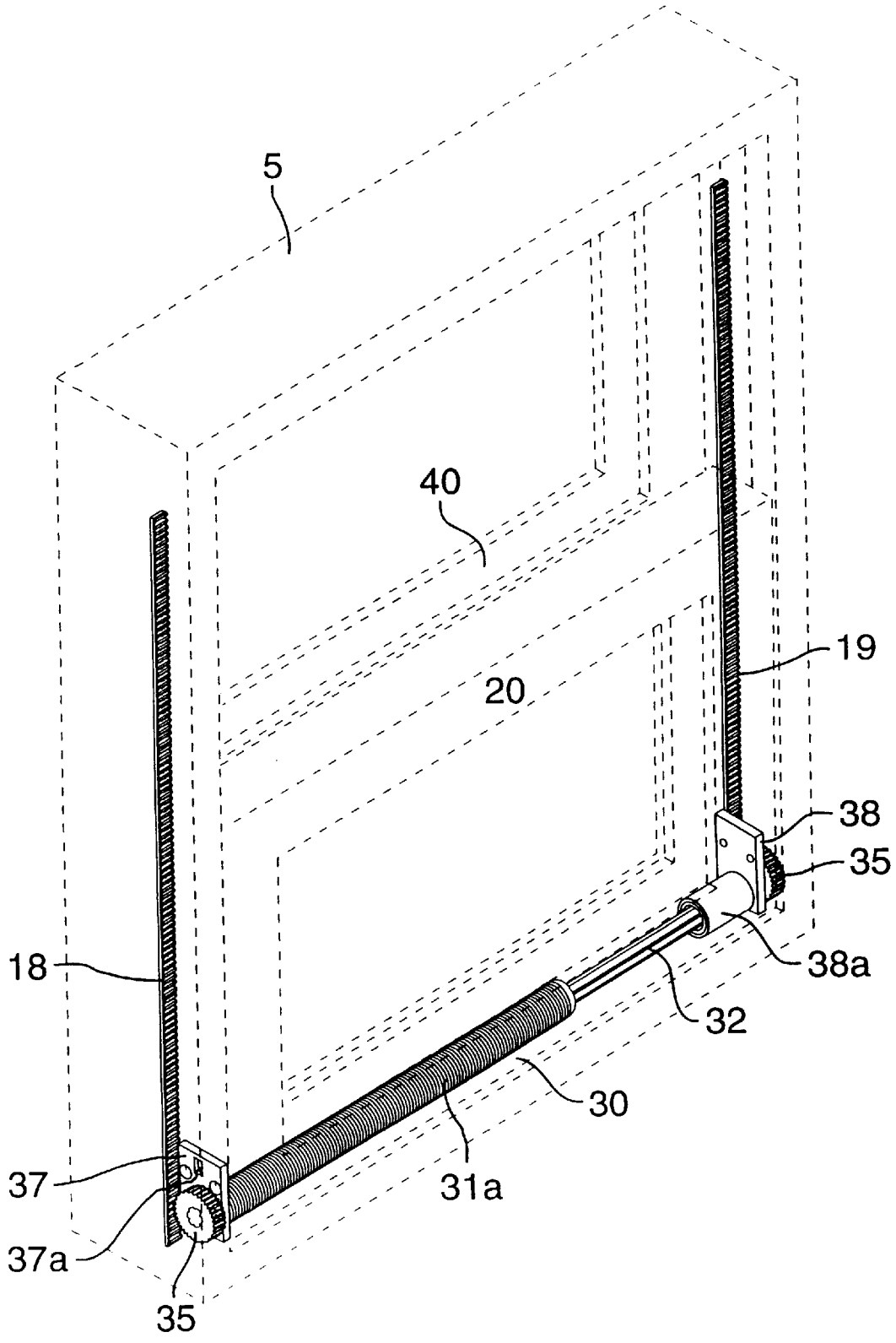
FIG. 3 is a double hung window assembly utilizing hardware similar to that of FIG. 1 and illustrated in a preferred embodiment of the invention.

Referring to FIG. 3 there is illustrated a double hung window assembly embodying the preferred embodiment of the hardware making up the invention substantially equal to that which is disclosed in FIG. 1, with the exception that a coil spring 31*a* is provided around the connector portion 31 of the interconnecting portion 30. By providing the interconnecting portion 31 with a spring 31*a* it will no longer be necessary in a double hung window assembly to provide a sash balance, as the spring 31*a* is pre-loaded to provide the necessary tension, much the same as a spring which is used in a garage door. In this example as a garage door goes up and down the spring is compressed and tensioned depending on the motion of the door and therefore provides for the return motion of the window assembly. Within the window assembly sashes 20 and 40 shown in ghost line are moveable with hardware substantially made up of a pivot or pinion 35 moving on a rack 18 and 19 respectively and being interconnected by the interconnecting portion 30.

Figure 4:
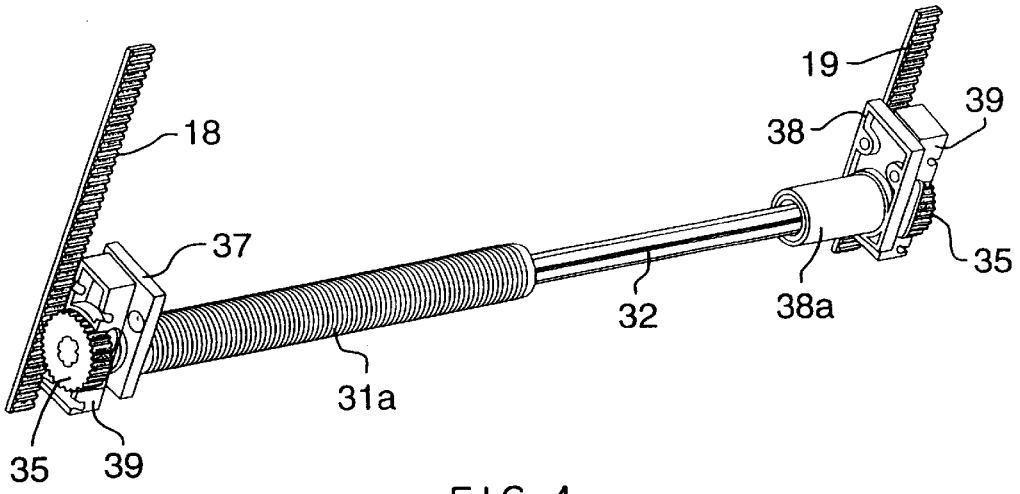
FIG. 4 is a perspective illustration of the hardware only for a double hung window of FIG. 3.
Figure 5:
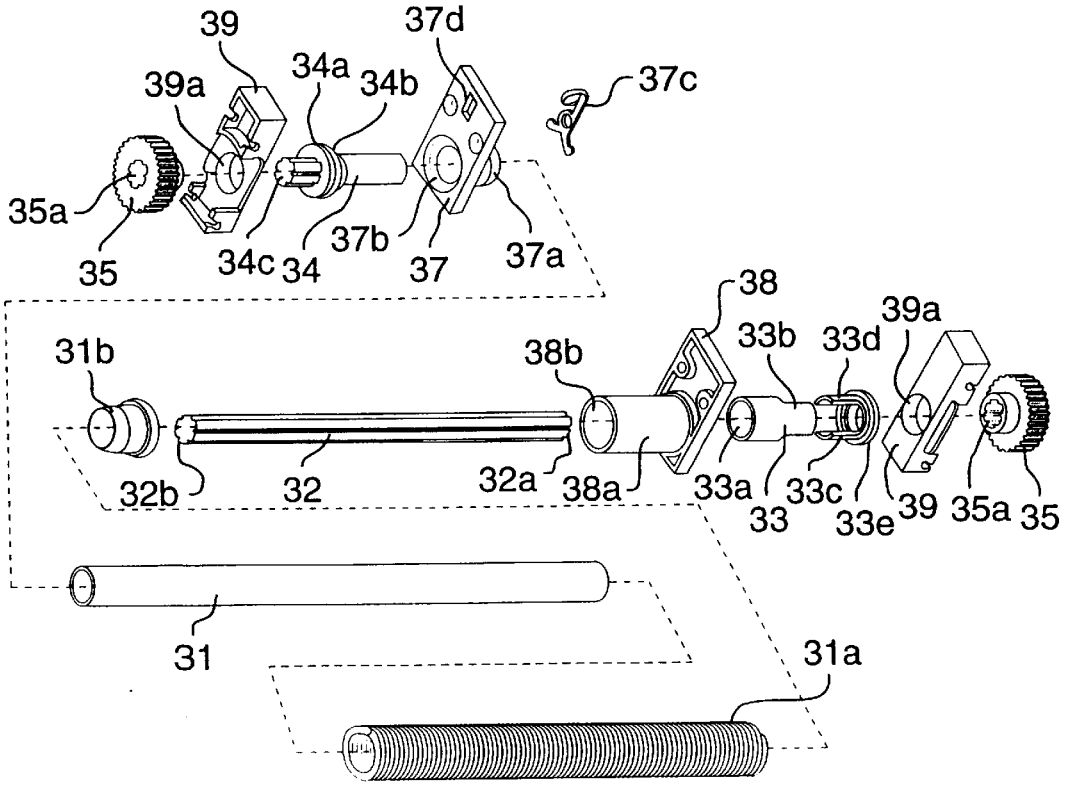
FIG. 5 is an exploded perspective view of the components of the hardware of FIG. 4 to be installed in a double hung window assembly.

Referring to FIGS. 4 and 5 there is illustrated the hardware which is installed within the double hung window assembly of FIG. 3. Pinions 35 therefore are provided, which seat within the carriers or shoes 39. The pinion includes a shaped opening 35*a* which is compatible with the bar stock 34*c* and 32*a* proximate the ends thereof. The pinion therefore will ride on the rack 18 and 19 within shoe 39. Opposed supplementary portion 37 is provided to oppose the shoe 39 as it rides in the track. Therefore, referring to FIG. 2*b* the portion 37 and 38 may be readily seen. A combined ratchet and pawl assembly is provided with portion 37 or at least connected therewith. The pawl assembly 37*c* is resilient biased through the opening 37*d* of member 37 so as to release the ratchet 34*b* of shaft 34 when the window is to be removed from the assembly. Proximate the other end of the hardware there is provided a backing member 38 in a unique shaft extension 33 which includes portions 33*b*, 33*d*, 33*c* and 33*a* wherein the shaft end 32*a* extends through. A locking nut 33*e* is provided to lock the entire hardware together and to allow for ease of separation thereof. An adjustable connector 31*b* is provided proximate the other end which allows for adjustment with regard to the length of section 32 of the shaft so as to allow variation in the sizes of the assembly supported. Portions 31, 31*b*, 32, and 33 makeup the shaft assembly which allows for ease of installation, adjustment, alignment and removal of the sash assembly. Also the hardware therefore described provides for the interconnection of the pivot shoes proximate their sides and provides for parallel motion of the pivot shoes at all times thereby illuminating the need to lock the pivot shoes in the track assembly.

Figure 6:
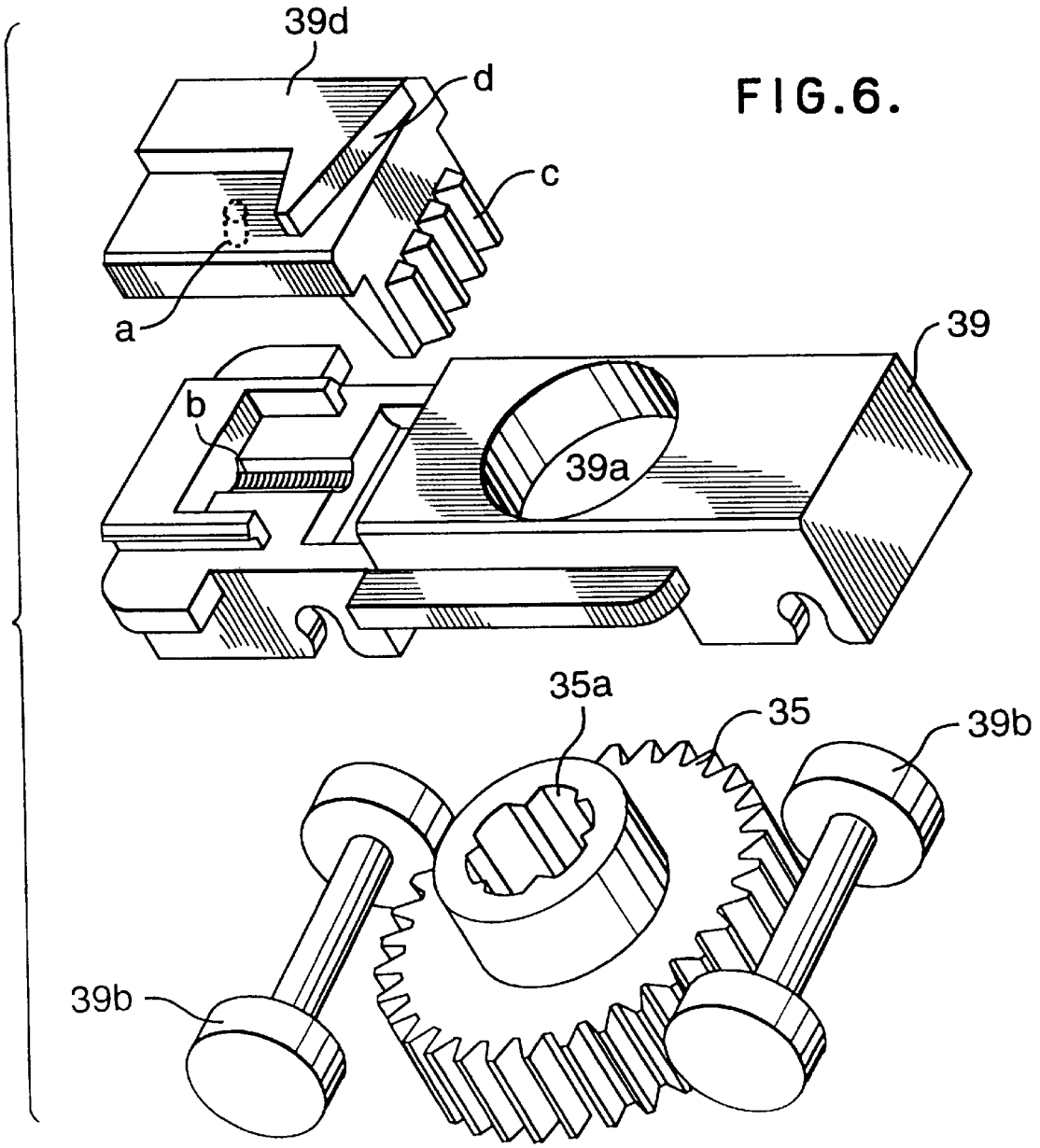
FIG. 6 is a carrier design illustrated in a preferred embodiment of the invention which allows for ease of removal of a window from a window assembly and illustrated in an exploded perspective view.
Figure 7:
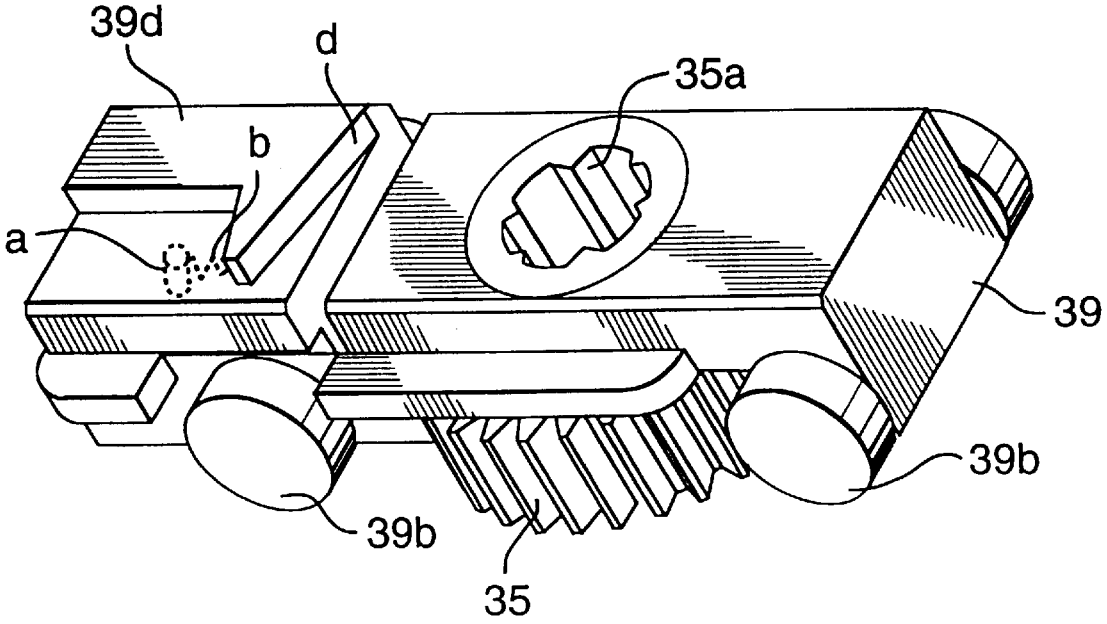
FIG. 7 is an assembled view of the components of FIG. 6.

Referring to FIG. 6 there is a description of a different shoe construction which is useful when a window is removed, since the carrier will be locked in position when the window is removed for maintenance or for cleaning. Therefore the shoe 39 includes a spring b and a recess therefor and a supplementary portion 39*d* and a finger a therefore wherein teeth c are provided on supplementary portion 39*d* which teeth are biased by spring b against the pinion 35 to thereby lock against pinion 35 and prevent the motion of the carrier when the window is removed. A sloped wall d is provided with the carrier supplementary portion 39*d* which is engaged by a separate simple latching and unlatching mechanism which thereby releases the supplementary portion away from the pinion or toward the pinion when the latch is opened. Therefore when the latch engages the supplementary portion d it will drive the supplementary portion 39*d* away from the pinion 35 thereby allowing free motion of the pinion in normal circumstances. However when the latch is disengaged the portion 39*d* will be free to move as biased by the spring b toward locking the pinion 35 via the teeth c of the supplementary portion 39*d*. The alternate shoe of FIGS. 6 and 7 has an opening 39*a* within which the extension 35*a* passes to engage the connecting member 30 as previously described. The rollers 39*b* engage with the notches as shown to improve the motion of the carrier in the track.

Figure 8B:
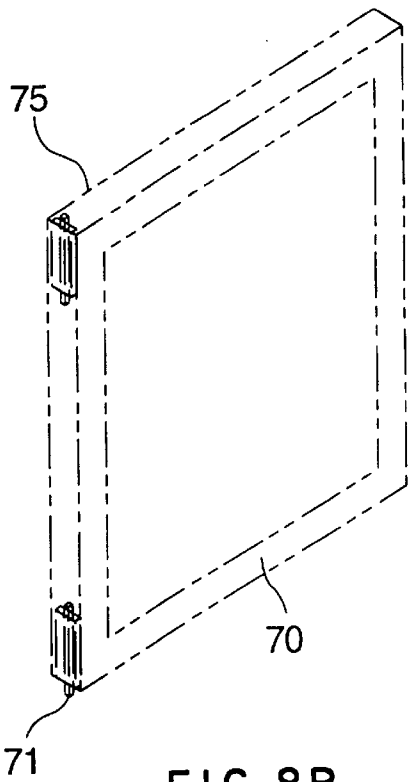
FIG. 8B is a window sash for use with the frame assembly in FIG. 8A.
Figure 8A:
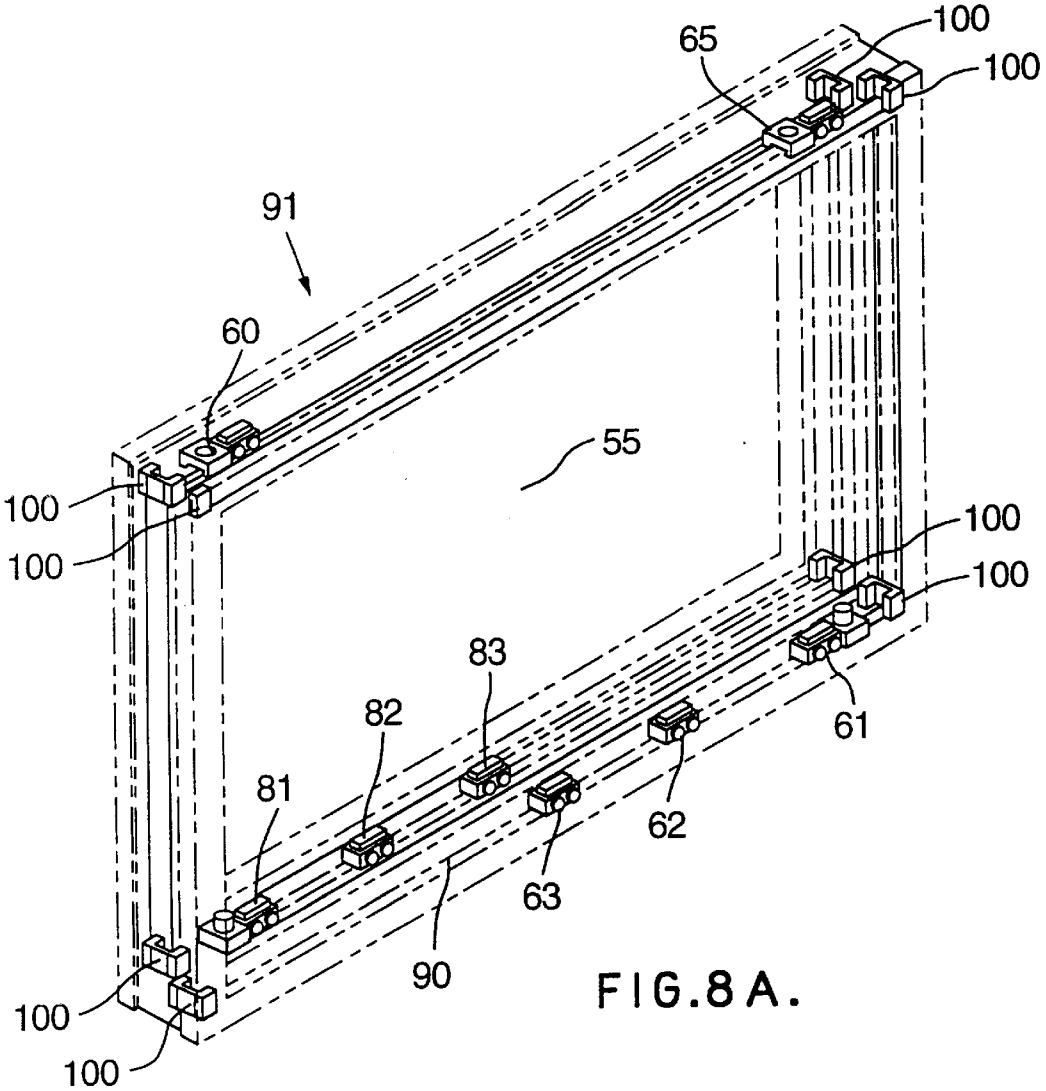
FIG. 8A is a frame assembly primarily for the hardware therefore and illustrated in an alternative embodiment of the invention.
Figure 9:
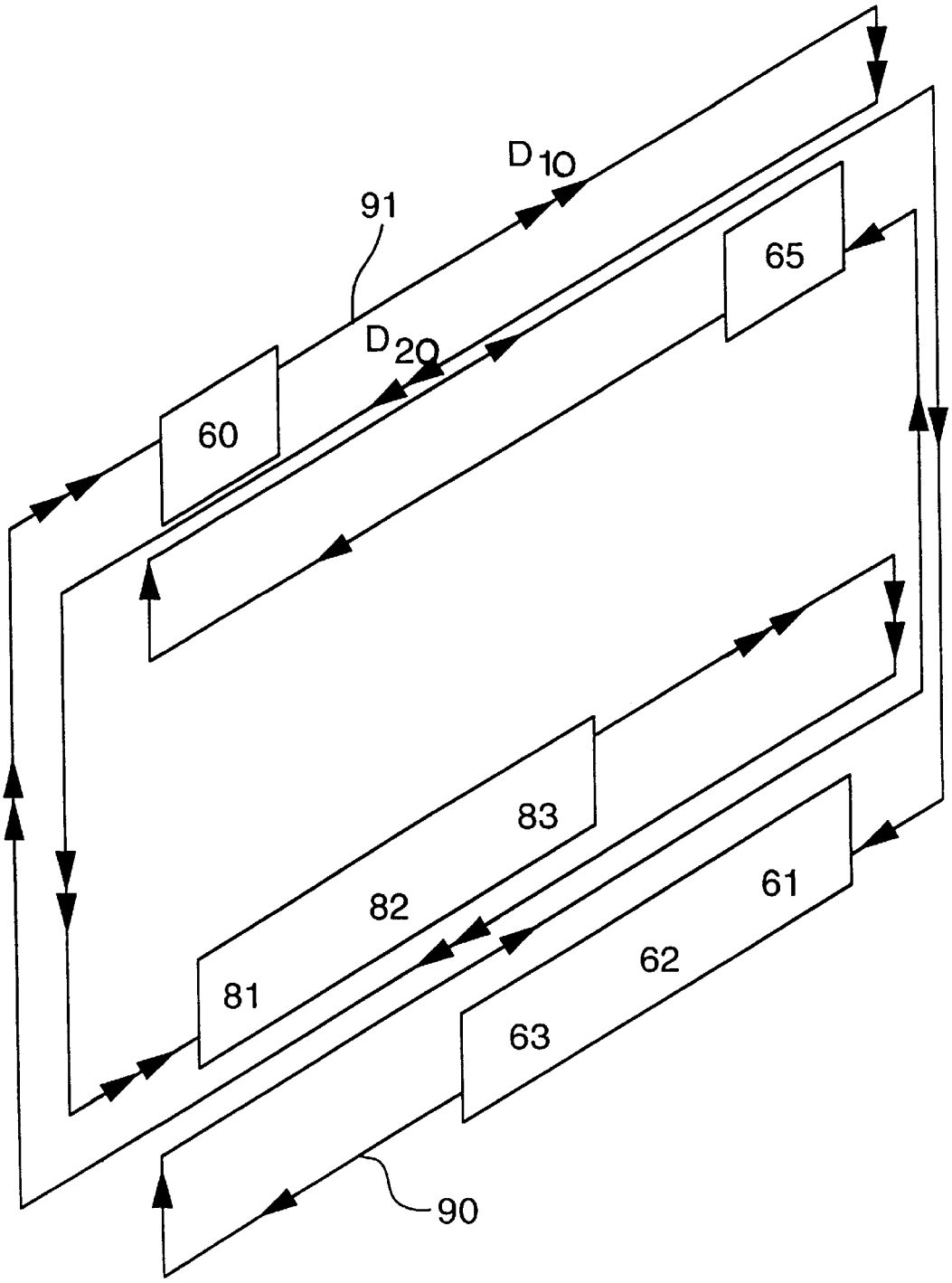
FIG. 9 is a schematic view of the movement of the shoes of FIG. 8 illustrated in alternative of the invention.

Referring now to FIGS. 8A, 8B, 9 and 10 there is illustrated an alternative embodiment of the invention to maintain the carrier pivots 61, 65, 60 and 81 in substantially parallel alignment and thereby eliminate the need for braking mechanisms. FIGS. 8A and 8B are illustrated as a tilt and slide frame in ghost line with the window 70 also shown in ghost line having pivot 75 and 71. The pivots 75 and 71 engage with openings within the shoe 61 and 65 in the manner which is known. These pivot pins 75 and 71 may be removed from these shoes merely by retracting them from their locked positions. The sash 70 therefore is moved on the carrier 81, 82 and 83 proximate the bottom thereof in the track portions as shown and within carrier 60 on the top thereof. A similar sash arrangement would be arranged for the other shoes as well but for simplicity sake this is not illustrated. The important aspect is that a cable 91 is connected to the carrier 60 and the carrier assembly 81, 82 and 83 substantially as shown in FIG. 9, so that when the window moves toward the right hand side of the drawing that both carriers will move an equal amount by the movement of the cable maintaining the pivots 75 and 71 within the shoes 60 and 81 substantially parallel at all times. Similarly, a cable 90 is provided which moves in conjunction with the carrier 63, 62 and 61 and the shoe 65, as best seen in FIG. 9, so that as the shoe 65 is moved in a direction D2 that the carrier 61, 62 and 63 will also be moved in the direction D2. FIG. 9 therefore shows the path of the cable connecting the carrier described above.

Figure 10:
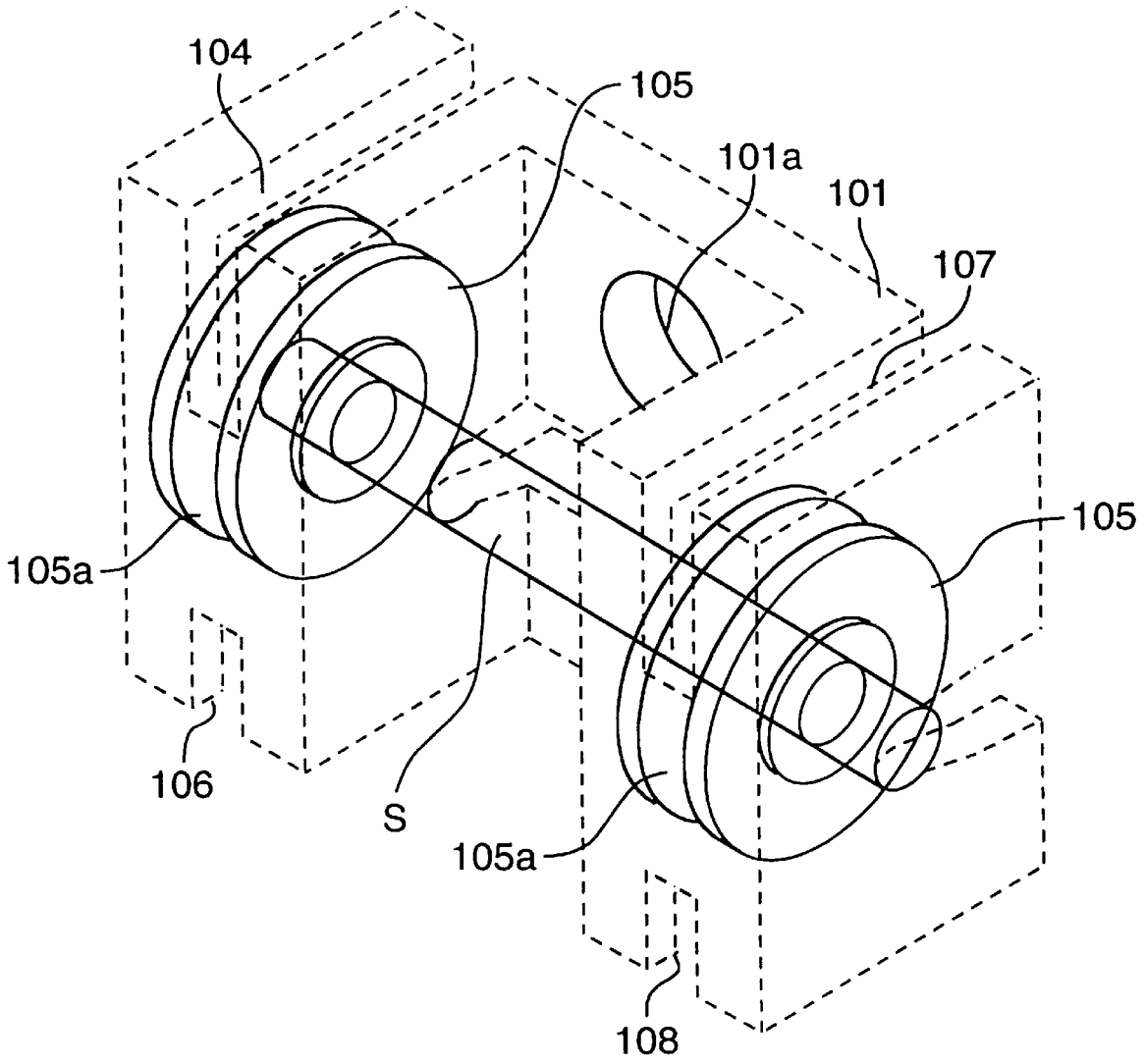
FIG. 10 is a perspective illustration of a pulley arrangement installed at the corners of the window assembly of FIG. 8A and illustrated in alternative embodiment of the invention.

In order to allow for the movement of the cable the unique pulley arrangement is illustrated in FIG. 10 wherein the cable will travel through the respective channels 107, 108 and 105*a* within the wheel 105, or through 106, 104, 105*a* within the opposite wheel or pulley 105. Assembly 101 is therefore provided which is affixed within the window frame via opening 101*a* and a fastener, not shown, which assembly allows for the movement of the cable and hence the carriers in a manner as best seen in FIG. 9.

Figure 11:
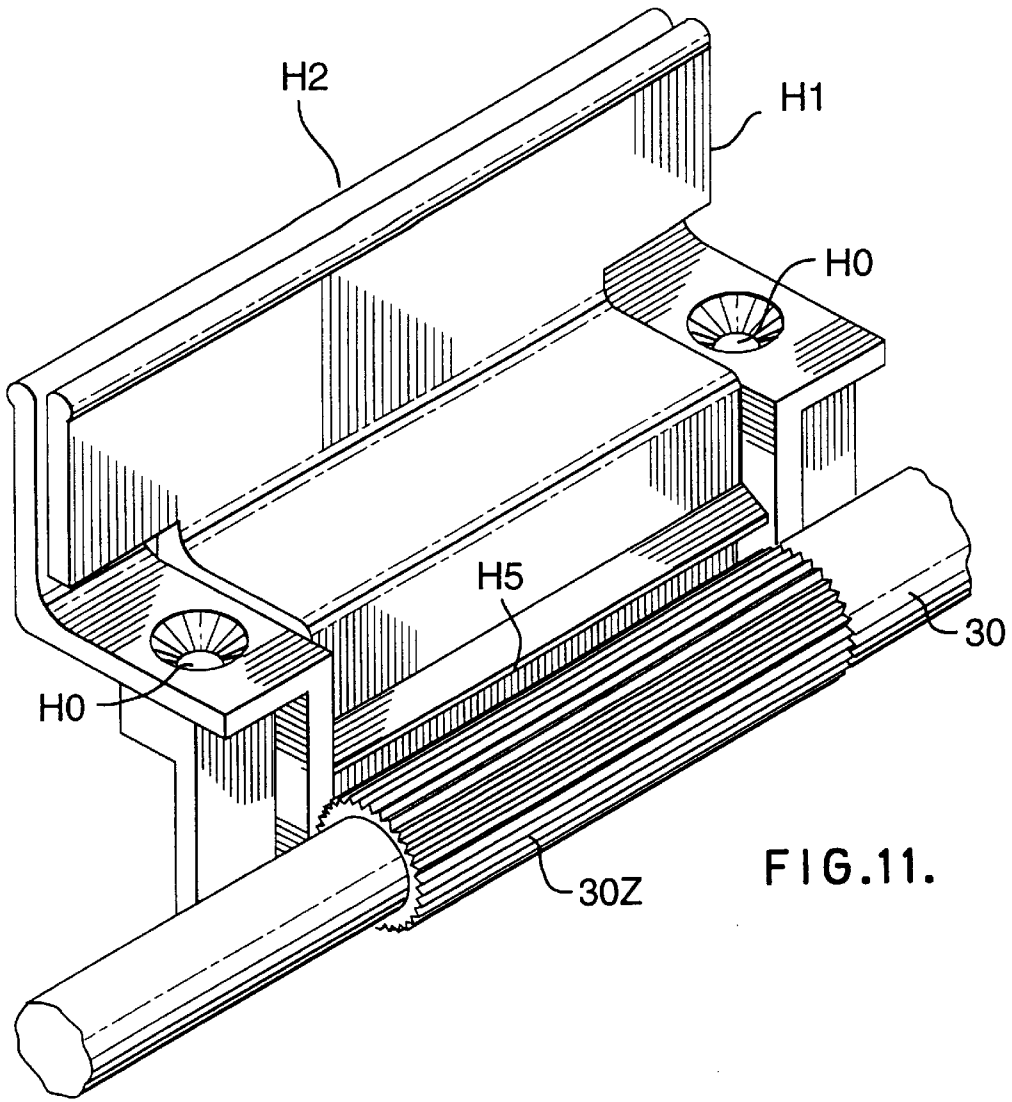
FIG. 11 is a close-up perspective view of a locking mechanism for the shaft assembly 30 illustrated in a preferred embodiment of the invention.
Figure 12:
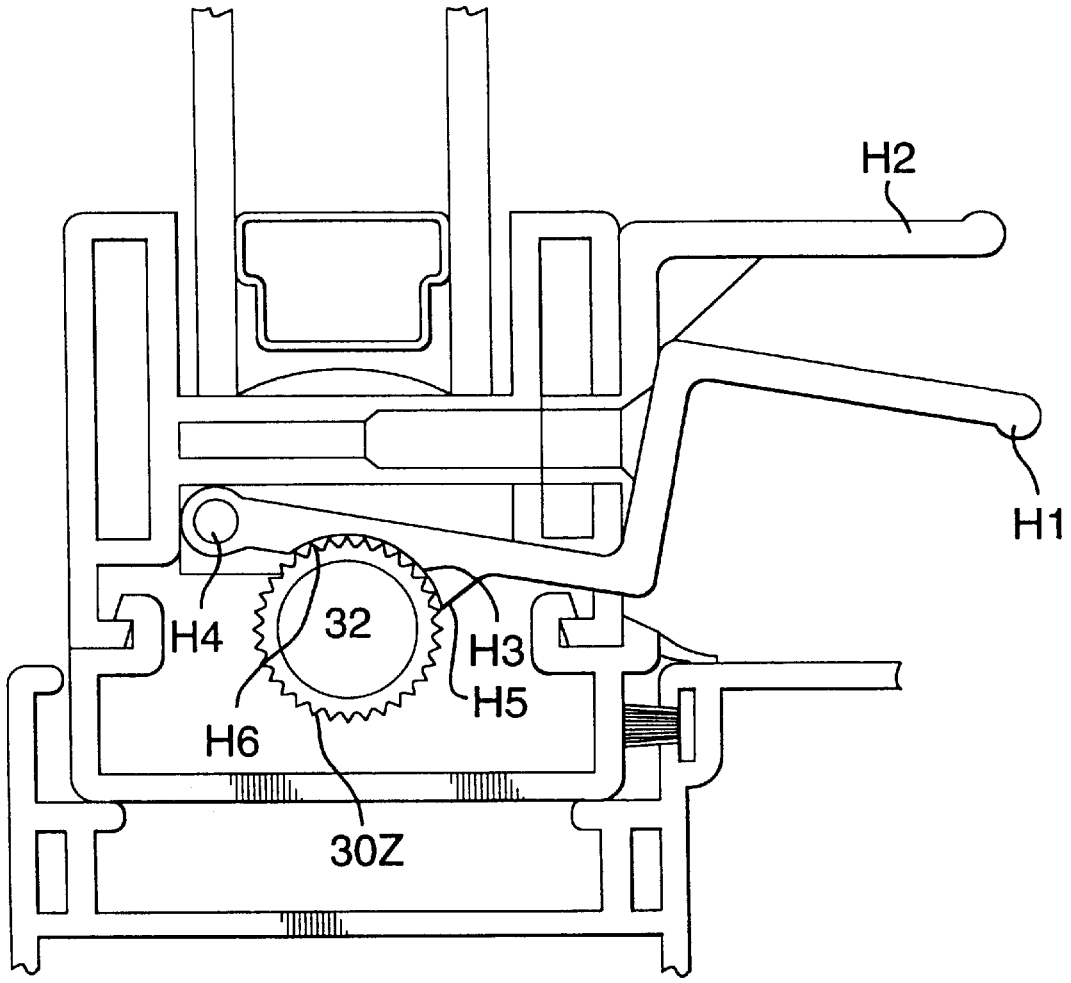
FIG. 12 is an end view of the locking mechanism of FIG. 11 illustrated in a preferred embodiment of the invention.

Referring now to FIGS. 11 and 12 there is provided a locking mechanism for the shaft 30 which may be used with any lousier assembly. A handle assembly H is provided including a stationary portion H2 fixed to the sash 21 and a moveable spring biased portion H1 biased to a continual locked position via spring leaf S2. The handle portion H1 includes a pivot H4 and detent portions H5 and H6. Normally the spring S2 will cause the handle portion H1 to remain in engagement at detents H5 and H6 with gear portion or serrations 30Z of the shaft 30. Therefore the window or door is locked in that position and cannot be pivoted or slid. When a user engages the handle H1 and presses it towards H2 the detents H5 and H6 release from the gears 30Z and hence the window or door may be repositioned as desired. At that repositioned location when the user releases the handles the window or door will again become locked.

Figure 13A:
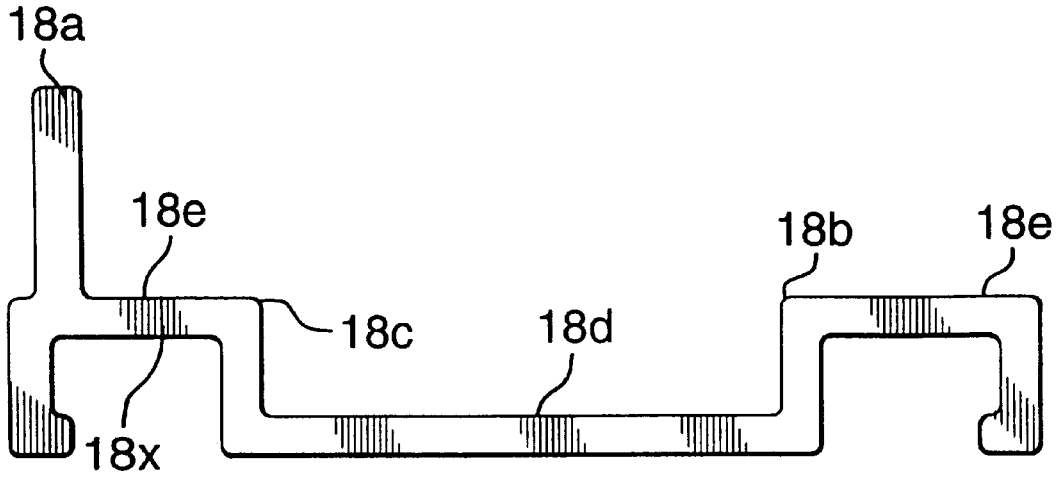
FIG. 13A is an end view of the track profile used in conjunction with the lock block assembly of FIG. 13 and illustrated in a preferred embodiment of the invention.
Figure 13B:
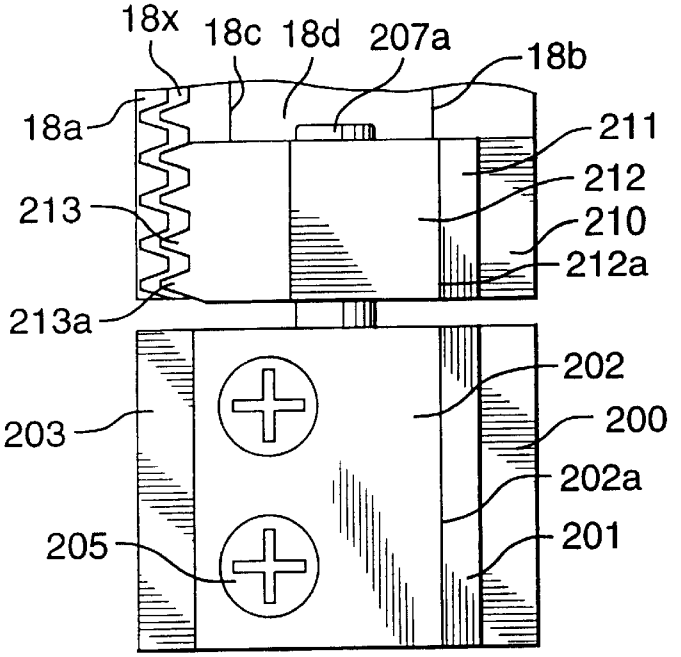
FIG. 13B is a top schematic view of the lock block assembly of FIG. 13 shown engaging the rack portion of the track and illustrated in a preferred embodiment of the invention.
Figure 13C:
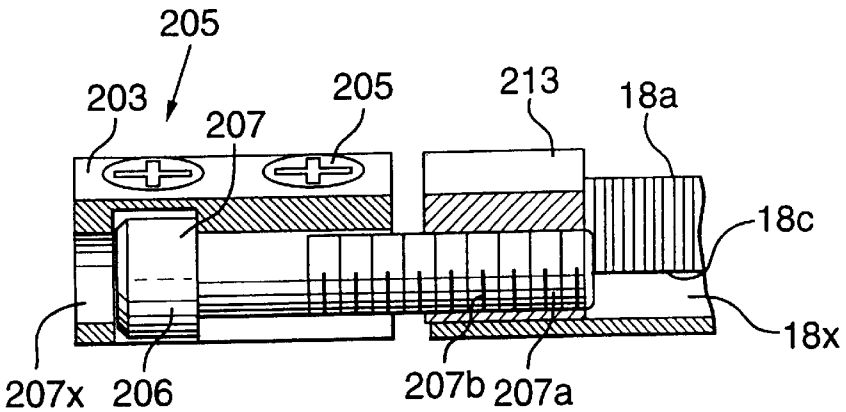
FIG. 13C is a side cross-sectional view of the adjusting cap screw used to adjust the track within the sill or header or jamb portions and illustrated in a preferred embodiment of the invention.
Figure 13:
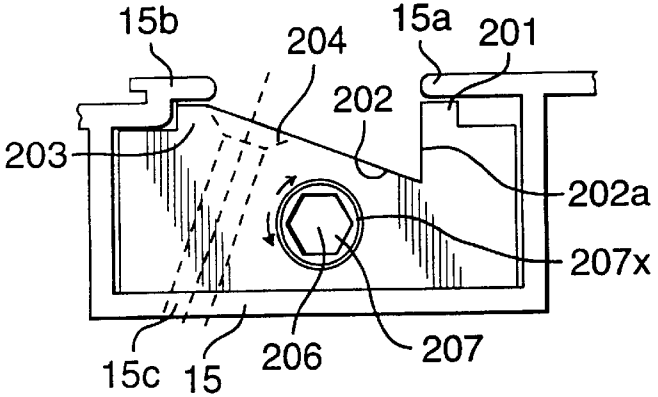
FIG. 13 is an end view of a locking block assembly illustrated in a preferred embodiment of the invention.
Figure 17:
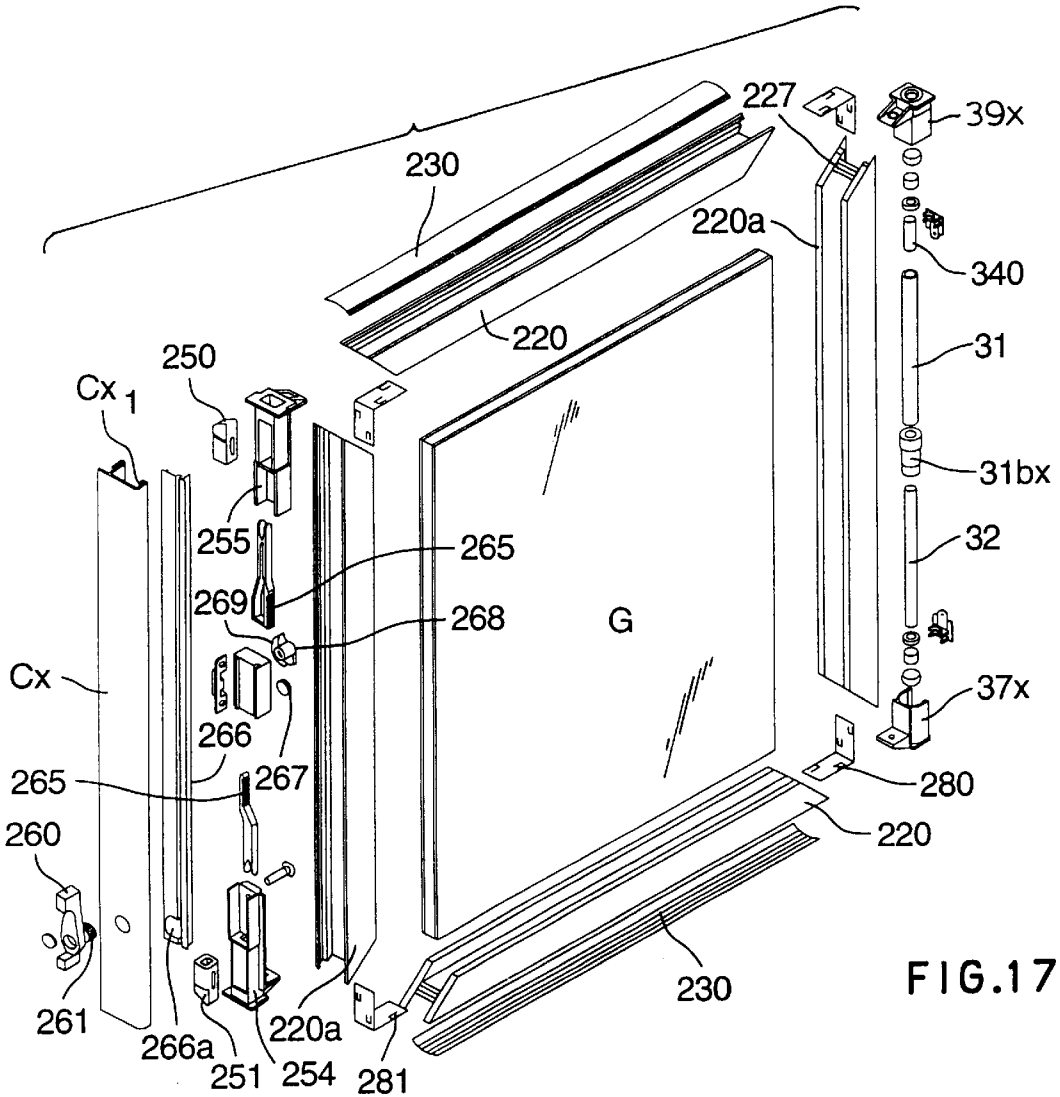
FIG. 17 is an exploded perspective view of a window sash for a tilt and slide or casement window illustrated in a preferred embodiment of the invention.
Figure 18:
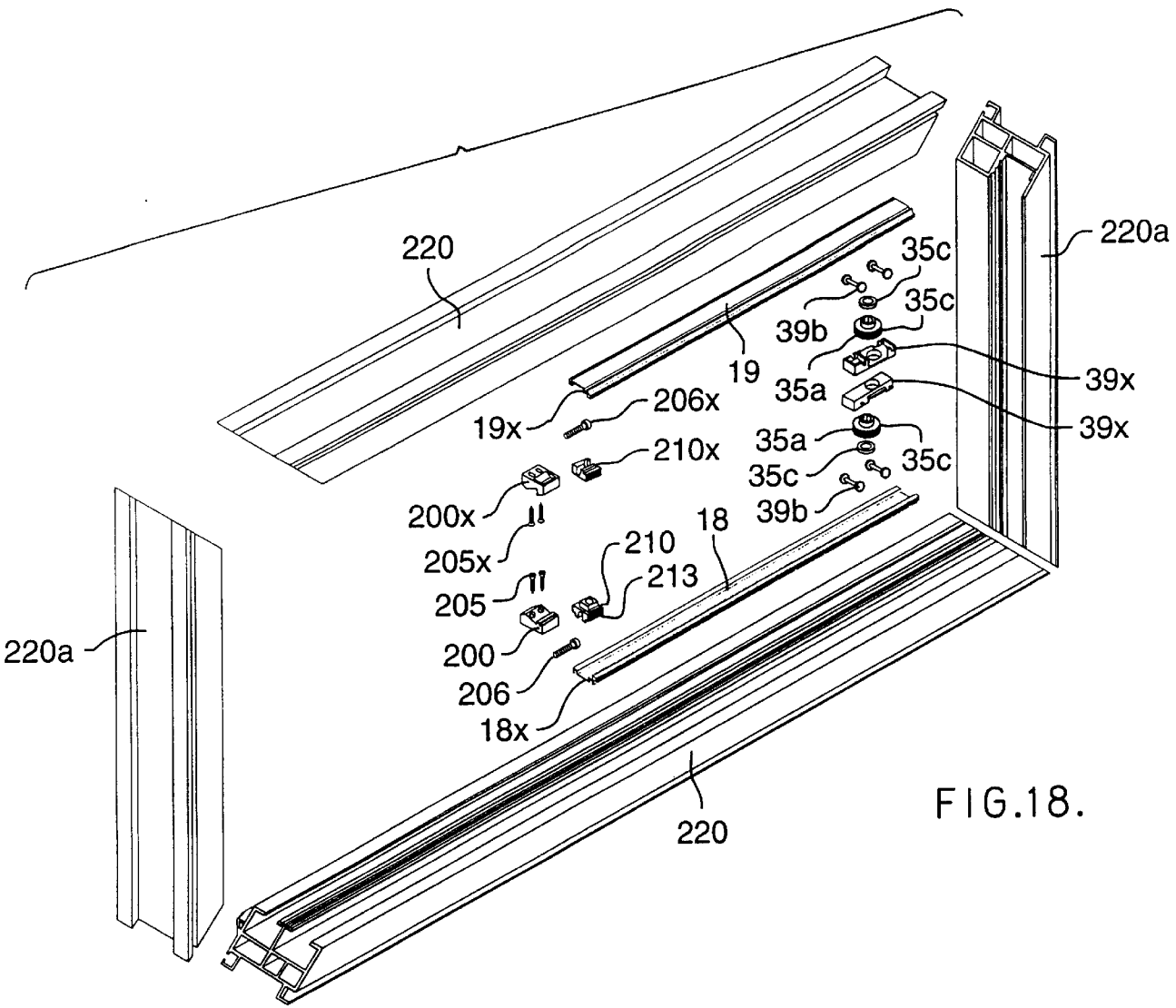
FIG. 18 is an exploded perspective view of the header, sill and jamb portions of the window assembly illustrating the track and its positioning in relation to the sill and header and illustrated in a preferred embodiment of the invention.

Referring now to FIGS. 13, 13*a*, 13*b*, 13*c* and FIG. 18, there is illustrated a track portion 18 and 19 which is to be installed within, as shown in FIG. 18, the sill and header 220 of a frame assembly also including upwardly extending jamb portions 220*a*. The track portions 18 and 19 therefore are installed within the profiles as seen in FIGS. 2*b* and 18 by the provision of a locking block assembly 200 which includes an adjuster nut 210 which engages the rack portion 18*x* of the rack 18*a* of the track profile 18 as best seen in FIG. 13*a*. The profile therefore includes the rack 18*a*, a riding portion for the rollers 18*e* which will be explained hereinafter, and a recess 18*d* wherein a carrier as best seen in relation to FIG. 14 rides with the exception of the rollers. The track 18 therefore must be locked in position in the sash 220, and this is affected by the locking block 200 and the moveable nut 210. As best seen in FIG. 13*c*, the track is inserted into the sill profile as shown so that the carrier may ride on the track. The assembly of FIG. 17 for the sash is therefore engaged with the carrier. The block 200 therefore is screwed down through the profile 15 into the wooden frame member not shown via opening 15*c* in the profile and 204 in the block 200. Two fasteners 205 therefore are provided, and as shown in FIG. 13, they are inclined at an angle to the vertical in order to allow for the provision of an adjuster 206 which is accessible through the opening 207 in the block 200 wherein a cap screw having a head 206*a* having an allen key type access slot is provided. The threading 207*b* extends down to the end 207*a* proximate the nut 210.

As best seen in FIG. 13, the lock block 200 and the locking nut 210 have a profile substantially as shown with a triangular shaped cut out provided adjacent the top thereof and wherein abutting portions 201 and 203 are provided to engage with the flanges 15*b* and 15*a* of the profile 15 of the sill portion 220. The triangular cutout portion includes an upwardly vertical face 202*a*, and bottom 202. Similarly the nut has a shoulder 211 provided and a substantially triangular shaped cut out 212 and an upwardly extending face 212*a* for engaging with the sill profile 15 similar to that which is illustrated and described in relation to FIG. 13. The rotation therefore of the cap screw 206 results in the movement of the nut 210 in relation to the block 200 which is fastened in position. The adjustment therefore of the screw allows for the thread to engage a threaded opening not shown in the nut 210 so that the rack portions 213*a* provide engagement with the rack 18*a* of the track portion 18 and will allow for fine adjustment in the positioning of the track 18 and the locking in position of the track. It has been found sufficient that by providing the block and the adjustment of the nut, it will sufficiently position and lock the track in position and allow for the adjustment of the track which will then further allow for the adjustment of the pivots as best seen in FIGS. 1, 1*a*, 1*b*, 1*c*, FIG. 2, FIG. 3 and FIG. 17 so that the parallelism is not lost, and if fine adjustments once installed are required to the window sash to maintain the parallelism of the system, this is very easy to do. Should the system go out of parallel and require fine adjustment to restore the parallelism, a mere rotation of the head 207 is required for both the sill and headers 220 so that the system is squared.

The notch portion defined by the faces 202*a* and 202 have a unique purpose in that the latch portion 251 as well as 250, as best seen in FIG. 17, will engage with the face 202*a* and provide a lock detent for the lock 251. This adds reinforcement to the lock provided in that should the triangular shaped detent of the block not be provided, then the lock 251 would engage flange 15*a* and in time would wear out that flange in that particular locking position. The nut 210 has a similar function so that either the nut or the block can function as the detent for the latch. Specifically in FIG. 18, the screw 206 is shown being engageable from the nut toward the block, and in fact it is accessible in either direction as shown in FIG. 13 and FIG. 18 without changing the advantages of the system. For access purposes, depending on the installation and the type of window, it may be easier to adjust as shown in FIG. 18 as opposed to FIG. 13. Preferably the block is made from fiber-filled nylon. Alternatively, the block may be made from aluminum. The nut may be made from fiber-filled nylon as well.

Figure 14:
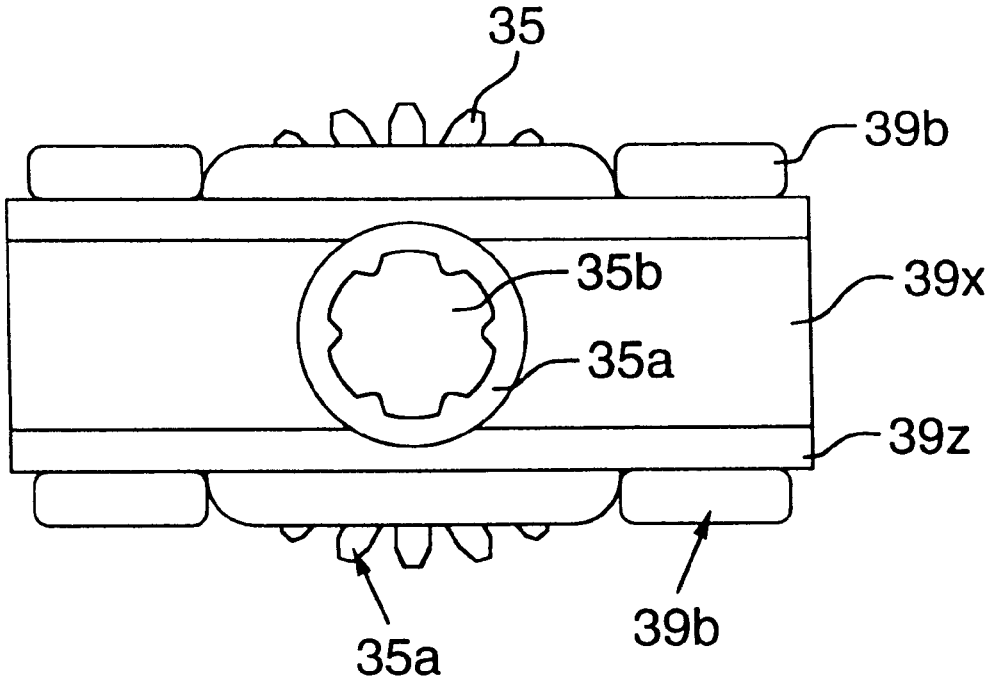
FIG. 14 is a top view of the carrier for the shaft assembly of FIG. 17 and illustrated in a preferred embodiment of the invention.
Figure 14A:
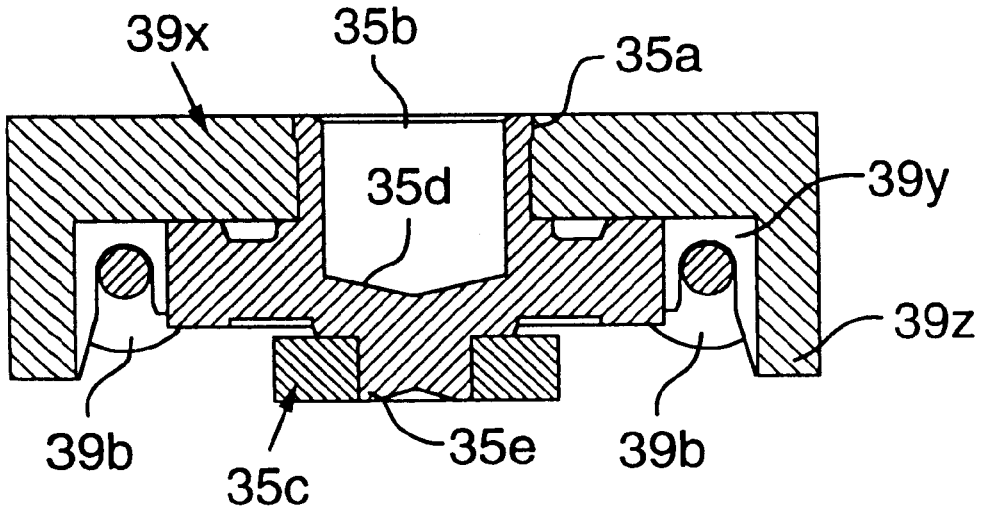
FIG. 14A is a cross-sectional view through the diameter of the opening 35*b* of FIG. 14 illustrated in a preferred embodiment of the invention.

Referring to FIGS. 14, 14*a* and 18, there is illustrated a carrier 39*x* which includes a pivot portion 35 for engaging with the shaft portion 32 and 34*c* of the pivot assembly and for carrying that shaft assembly and the pivoting end of the sash in the track 18 and 19 respectively of FIG. 18. The carrier includes a portion 39*y* provided therewith to carry the rollers 39*b* therein. This is very similar to the carrier illustrated and described in the previous descriptions and more specifically in relation to FIGS. 1*a* and 1*b*, with the exception that the details of the carrier were not shown at that time in relation to the thrust wheel 35*c* provided on the bottom.

The carrier, as best seen in FIG. 1*a* therefore rides on the rollers on the track profile seen in FIG. 13A on the surfaces 18*e* for the roller wheels 39*b* and in the notch or cut-out recess 18*d* for the side portions adjacent the roller 39*b* at 39*z*. The pinion portion 35 therefore has an opening 35*b* for receiving the shaft 32 which extends toward the bottom of the opening 35*d* and which opening 35*b* as best seen in FIG. 14 is compatible with the shape of the shaft 32. The outer surface 35*a* of the opening 35*b* is compatibly shaped with the opening in the carrier so that the opening 35*b* may be accessible to the shaft 32. At the bottom of the pinion portion 35 is a thrust wheel carrying portion 35*e* which carries the thrust wheel 35*c*. The thrust wheel 35*c* therefore rides in between the shoulders 18*c* and 18*b* on the surface 18*d* of the track profile 18. The thrust wheel is provided to accommodate any wind load which may be placed on the system when the window is opened. Further, in the normal meshing of gears with a rack, there is a thrusting force created as the pinion 35 moves on the rack 18*x*. Therefore, the thrusting wheel will engage from time to time the shoulders or the surfaces defined by the shoulders 18*c* and 18*b* so as to maintain the parallelism and the accuracy of the installation of the window system. A pinion gear 35*a* is therefore provided between the thrust wheel 35*c* and the pivot receiving opening 35*b* which operates substantially as described in relation to FIG. 1A and FIG. 1 in that as the window rotates the pivot rotates causing the gear 35*a* to rotate and move on the track. This is particularly advantageous when the pivot assembly is provided on a casement window as best seen in relation to FIG. 1A in that it is desirable to have the window move away from a pocket provided in the window jamb as best seen in relation to FIG. 1D so that the sash profile will not engage the jamb profile but will readily clear the jamb profile as the window is opened. For example, as best seen in FIG. 1D, proximate the top thereof, it may be readily seen that a pocket is provided in the jamb profile so that the pivot assembly 30 is accommodated at that end of the window. However, a flange portion unlabelled engages the sash cover portion so that within the jamb J1 there is a pocket J2 provided which improves the seal of the window in that the cover portion SC extends into the pocket J2 when the sash is closed. However, when the sash is pivoted as in the case with the casement window of FIG. 1C, the pinion gear when pivoted will move the sash and the sash cover SC out of the pocket J2 away from the jamb J1 and provide suitable clearance so that the sash cover SC will not engage with the jamb portion J3 which is a flange and therefore will clear easily the pocket and all its enabling portions. When the casement window is closed, the opposite happens and the sash cover SC will engage the pocket J2 and be moved in position with the pivoting of the window to the closed position.

The rollers 39*b* therefore provide a smooth motion of the closure system in relation to the track which would not be present if the rollers were not provided since the track is made from aluminum. The rollers are not absolutely essential in every embodiment, however, it is preferred.

Figure 15:
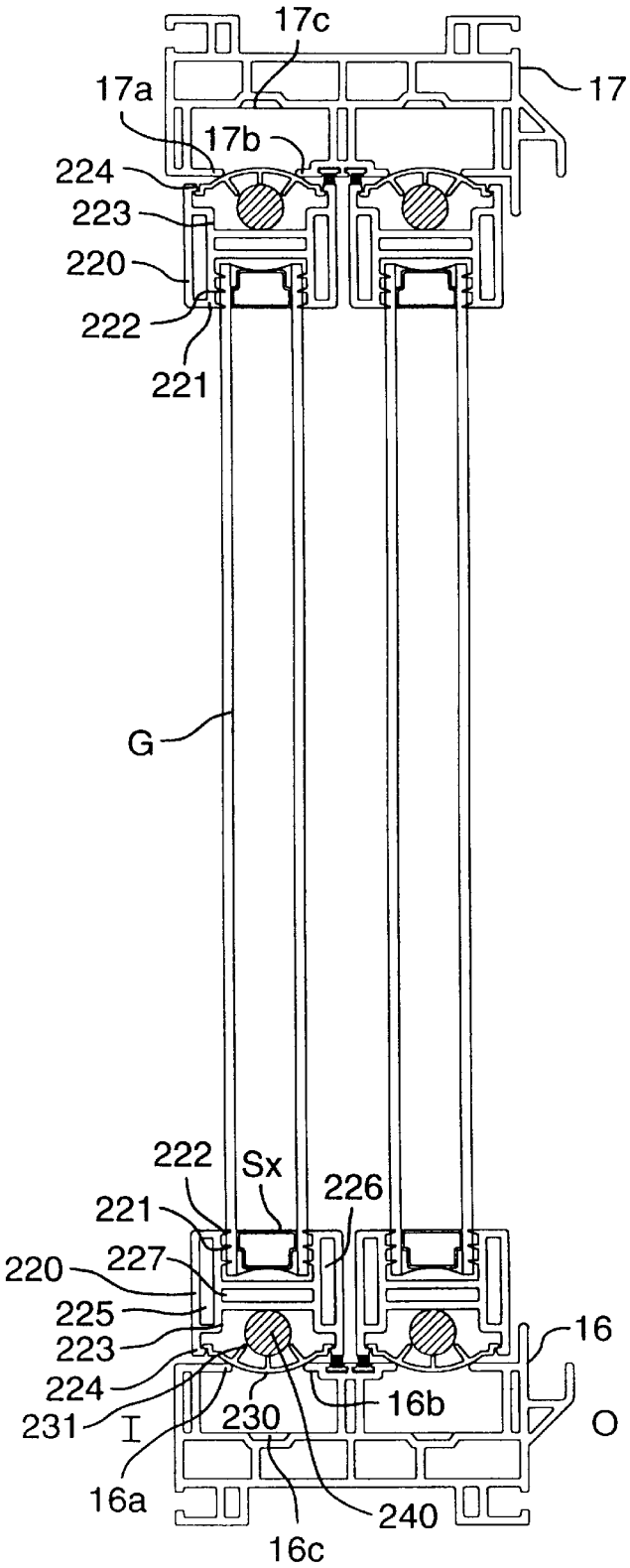
FIG. 15 is an top end view of the sash portions for a tilt and slide window assembly from the opening end of the window and illustrated in a preferred embodiment of the invention.
Figure 15A:
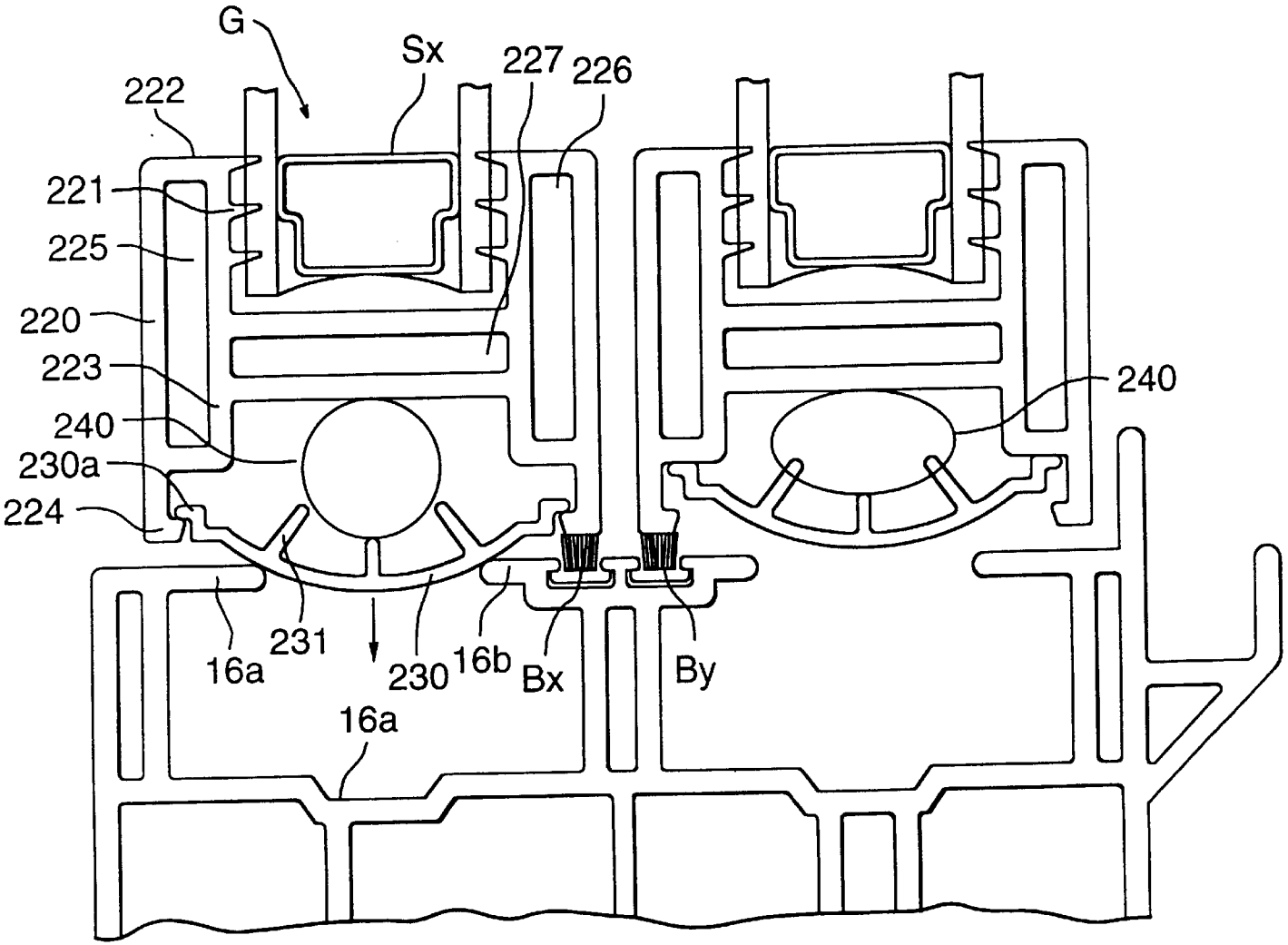
FIG. 15A is a close up view of the section of the assembly of FIG. 15 where the sash abuts with the sill and illustrated in a preferred embodiment of the invention.

Referring now to FIG. 15, there is illustrated two sashes side by side shown in end view. The sashes are made substantially as constructed in relation to FIG. 17 wherein the sash 220 is defined by a central I-shaped portion 227 having an opening therein and two side abutting portions 225 and 226. A pocket therefore for receiving the glass G is defined at 222. Fin seal portions 221 are therefore provided for abutting the glass G which contains the normal known seal portion SX. The window sash profiles also include flange portions 224 proximate the opening opposite the glass G. Within that opening there is provided in use a closed cell caulking foam which is compressible at portion 240. This portion extends totally along the sash profile within the opening as shown with the exception of the portion adjacent the pivoting assembly. A cover portion therefore is provided at 230 which engages the tab portions 224 proximate each side of the sash profile. This cover portion when inserted is flexed downwardly as the closed cell foam 240 is compressed as best seen in FIG. 15*a* so that the flange portions of the cover at 230*a* engage with the flange portion of the sash at 224 to provide a compressed seal for the track cover 230. The track cover is defined as a track cover although it does occupy the sash as a component thereof in that as the sash is closed over the opening defined between the flange portion 16*a* and 16*b* as best seen in FIG. 15*a*, the snap cover portion will extend down into and engage with the flanges 16*a* and 16*b*, thus covering the track and snapping into position each time the sash is opened and closed. The typical seals BX and BY are provided as is known in the art.

Alternatively, as best seen in FIG. 1D, the sash covers may include alternative embodiments shown proximate the jamb portions 16*a* and 17*a* of the window assembly. Alternatively, a cover portion may be provided over the track portion 15 of sill portion 220 and header portion 220 of FIG. 18 that engages with the sash profile in a similar way to that of the track cover of FIG. 15*a* with the exception that the track cover only extends over the second half of the track, that is to say the second half not carrying the window. For example as shown in FIG. 2, the wheel portion 39*a* may be eliminated and the track cover may extend along the track portion opposite the pivot assembly so that the sash may slide on the track cover and be assisted to be supported by that track cover only in the second half of the track profile thereby eliminating the second carrier of FIG. 2. The track cover therefore in FIG. 2 as an example would extend from the carrier 39*a* toward the left side of the page to allow the pivot assembly 35 to move to approximately the position of the present carrier 39*a* wherein it would engage the track cover. In the movement of the carrier 35 to that position, the other end of the window would already be supported by the track cover. This installation therefore would eliminate the carrier 39*a*.

Figure 16B:
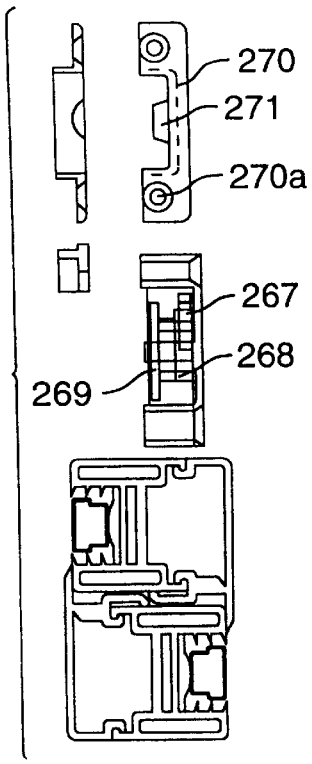
FIG. 16B specifically illustrates the latching plate and latch of the central locking system and illustrated in a preferred embodiment of the invention.
Figure 16A:
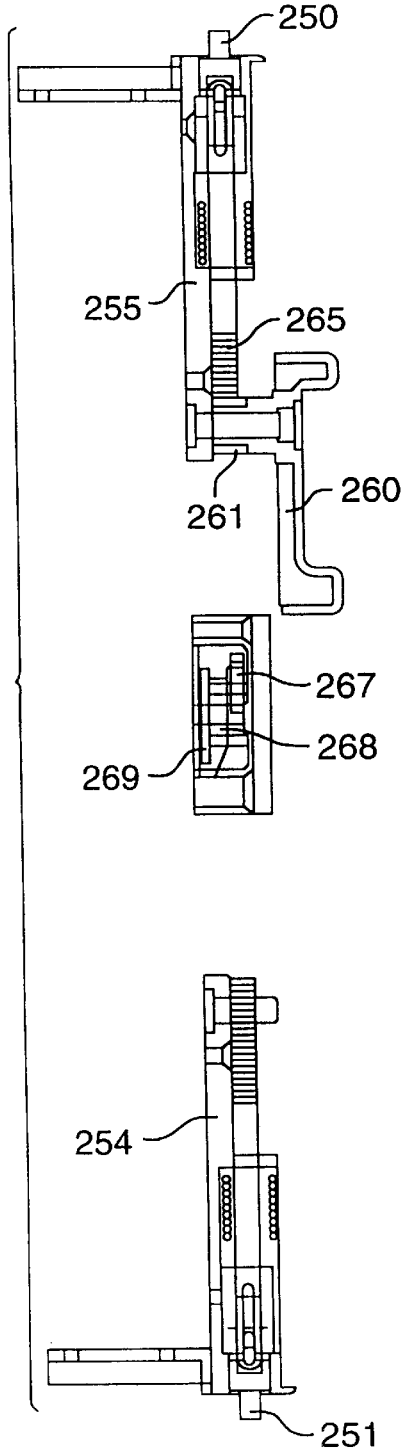
FIG. 16A is an end view of the central locking system of FIG. 16.
Figure 16:
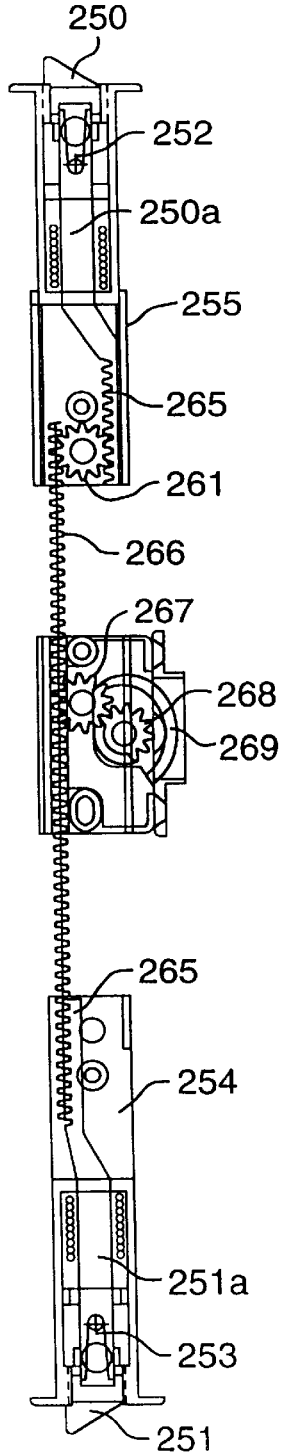
FIG. 16 is a schematic end view of a central locking system best seen in FIG. 17 and illustrated in a preferred embodiment of the invention.

Referring now to FIG. 16B, there is provided locking detents 250 and 251 which engage with the locking detent portions 202 and 212 of the lock and nut portions 200 and 210. These locking portions 250 therefore and 251 are operated by a handle 260 as best seen in FIG. 16A which is rotatable to cause the motion of the rack portion 265 and the detent 250 into and out of the locking abutment provided with the lock block and the lock nut 200 and 210 respectively. In FIGS. 16, 16A and 16B, the installation is provided for a casement window assembly. In the U.S. patent application described in the Summary of the Invention which was incorporated by reference, there is no provision of a casement-style window lock. Nor was there the provision of a lock block or nut detents 210 and 200 respectively. The handle therefore 260 is rotated by the user which causes the movement of the corresponding pinion gear 261, the rotation of the pinion gear 261 affects the movement of the rack 265, and the latch engaging portion 250*a* and 251*a* carried within the housings 255 and 254 respectively as best seen in relation to FIG. 17. The rotation of the pinion will therefore also cause the motion of the rack portion 266 sufficiently as provided by the opening 266*a* of said rack portion to allow for engagement of said rack portion with said rack portion 265 with the bottom portion affecting the latching and unlatching of detent 251. Intermediate the two latching portions for the casement window is provided a second pinion 267 which is rotated effectively by the movement of the rack portion 266. Rotation of the pinion 267 causes rotation of the pinion sector 268 which is engaged with the locking detent 269 for the latch plate 270 and the detent 271 thereof. This latch plate is typical for casement windows as is the movement of the lock 269, i.e. the rotation thereof. However, with the central locking system provided with this invention, it is the one handle operation of both the detents 250 and 251 and the casement window lock 269 which is in combination the essence of the central locking system. Alternatively, the casement window portion may be left out and the essence of the locking system therefore includes the locking block in the track which provides a detent for the locks 250 and 251 respectively.

As best seen in relation to FIG. 17, there is provided a cover C(x) which hooks into the sash profile similarly to the cover 230 previously described in relation to FIGS. 15 and 15A through which the handle portion 260 extends. Therefore, the latch assembly is contained within the sash profile, and the only portion extending outside of the sash profile is the handle portion. This handle portion is considerably smaller than the normal handle portion provided with a casement window which is typically rotary, and there is a tremendous elimination of components for a casement-type window. In fact, this will be described hereinafter.

Referring to FIG. 17, there is shown an exploded perspective view of the window assembly which will fit into the track profile similar to FIG. 18, but more specifically which may be designed for a casement window. The sashes 220 are provided with an opening 227 wherein a corner connector 280 is provided which extends into the opening 227 proximate all four corners and eliminates the necessity for welding. Clip portions 281 bite into the vinyl and are tapered in a direction so as to prevent the removal of the corner connectors once inserted within opening 227. This snap lock feature therefore provides for the installation of the corner connectors and the quick fastening of the sash profile around the glass G. The track covers 230 are therefore provided and snapped into position once the closed cell foam, best seen in FIG. 15*a* at 240, is inserted within the opening of the sash profile. The hardware including the carriers, best seen in FIG. 18, which are then assembled within the opening opposite the glass of the sash proximate each jamb portion in use. The hardware therefore including the top and bottom track engaging portion 39*x* and 37*x*, the shaft 32, the connector 31*bx*, the other shaft 31, and the small shaft 34*c* are provided proximate the pivoting end of the window assembly within the sash profile enclosed by a cover similar to that of cover CX. The central lock as described in relation to FIGS. 16, 16A and 16B is therefore inserted within the other opening of the sash profile and assembled and covered by the cover CX. The window sash is now available for installation within the frame assembly of FIG. 18 once the carrier portions 39*x* are engaged with the respective shafts 32 and 34*c*. The block portions 200 are therefore locked in position once the track is installed in the frame, and the nut portions are adjusted to allow for the parallelism of the carriers 39*x* within the tracks to ensure the parallelism of the sash so that it rides well within the track portions. The window is therefore assembled.

For a casement window, all of the prior art levers and latch mechanisms are substantially eliminated. This means a great deal to window manufacture in that there are a considerable number of screws and fasteners to hold down the prior art lever linkages of the prior art systems. In the present invention, only the latch block fasteners are provided. The rest of the window assembly merely snaps together with a friction fit of the sash profiles, the sash profile covers and the frames. A minimum of assembly labour is therefore required with the installation of this window assembly. In one particular situation where an old style double-hung window is installed within an opening, it may be conveniently removed by an installer and the present invention may be installed in any of its embodiments including a casement window.

This is heretofore unknown in that a casement window occupies a certain standard space in the industry, and because of the linkage systems and the known systems, it is not possible to provide a larger window. With the present invention, a larger casement window may be provided which is easily installed with the minimum amount of labour and assembly time required. Should the window now be misalligned for any reason, it may be easily adjusted by the rotation of the screw 206 provided. A sophisticated user therefore could easily adjust this once instructed over the phone by an installer, or alternatively the installer may return for a quick adjustment at any time. Also, the window assembly is less likely to go out of adjustment because of the great care taken in the development of the precision of the assembly.

A method therefore of assembling the window may be considered as described in the above-mentioned description wherein, firstly the sash components are assembled by the quick fastening feature of the corner locking portions which are inserted within the opening of the sash profiles provided and provide one-way friction fit. The closed cell caulking is therefore inserted within the top and bottom of the sash assembled and these portions are covered by the track covers by the compression of the closed cell foam and the engagement of the tabs of the track cover with the tabs of the sash profile. The hardware is then installed along the vertical portions of the sash within the openings thereof opposite the glass which is then covered by a sash cover portion provided. The hardware located proximate the pivoting end is therefore installed on the carrier portions and inserted within the track portion within the sill and header, for example of a window assembly. The window is therefore closed in position with the sash covers or track covers located proximate the sill and header snapping into the frame and closing any path for air to enter the window and pass the primary seals provided as best seen in relation to the FIG. 15A. The track covers also provide blockage of light, air and the friction fit of the sash into the track portions. By providing a track cover along the track remote the pivoting end of the window, this track cover may be used as support as well for the window assembly.

In another embodiment not shown, a double casement window is provided which is provided in a straight-line window, that is to say a frame is provided wherein a central mullion is disposed. A central mullion separates two casement windows, one opening as a mirror image of the other and containing all of the elements described above in relation to the pivot assembly and the central locking system and track system.

Figure 19:
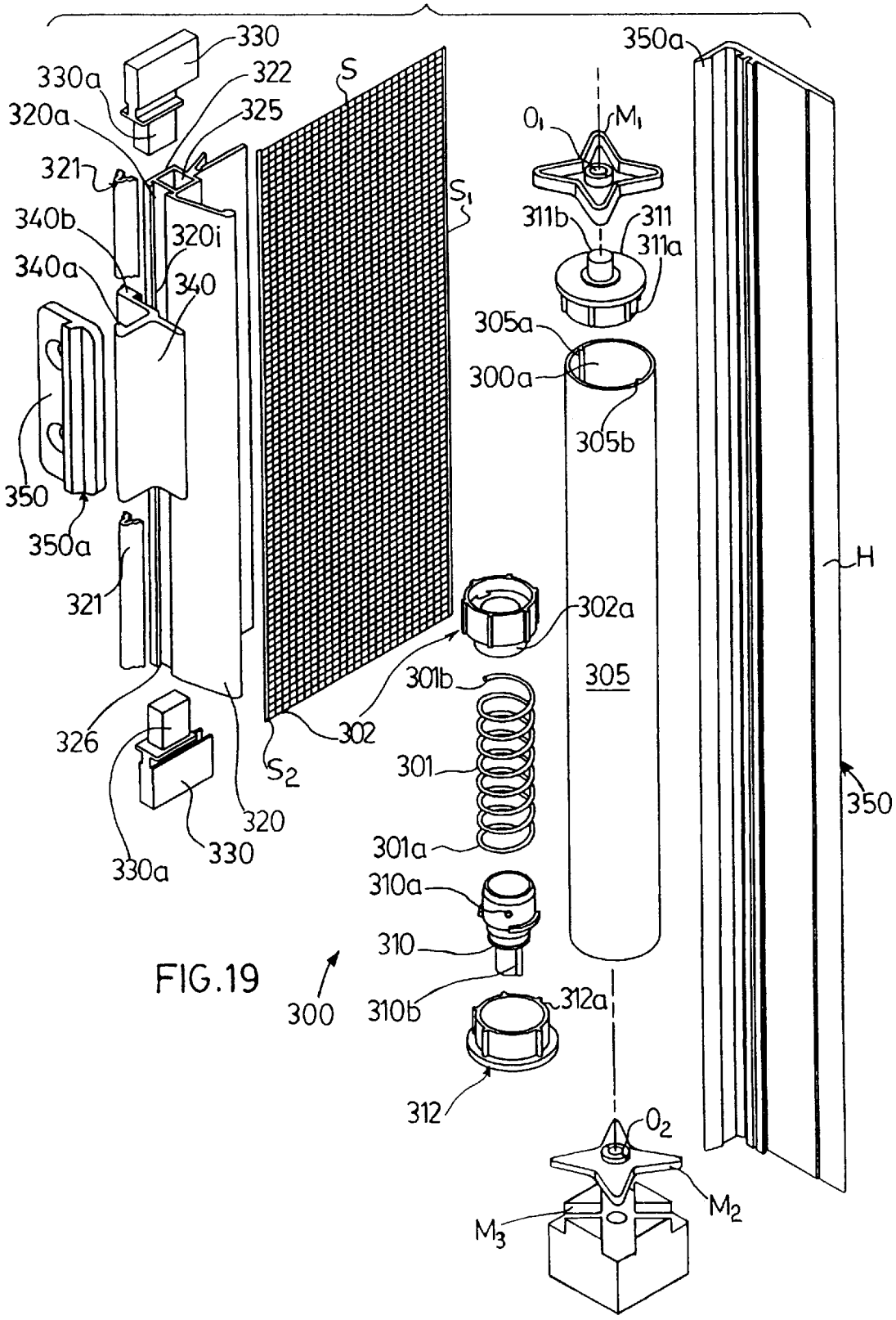
FIG. 19 is an exploded perspective view of a retractable screen assembly illustrated in one embodiment of the invention.

Referring now to FIGS. 1 and 1D, there is illustrated a retractable screen contained within the opening of the jamb within a framing section for a window assembly having a header 17, a sill 15, and two side jambs 5 and 10. The side jambs 5 and 10 are somewhat identical with the exception of the details herein provided. One of said jambs 5 or 10, or for that matter in alternative embodiments sill 15 and or header 17 may contain a retractable screen stored on a tube. This may be seen in relation to FIG. 21 which is comparable to FIG. 1D. The screen assembly 300 includes a tube 305 having a pair of ridges 305*a* contained within the hollow 300*a* thereof, said hollow 300*a* for receiving a spring 301 being a torsion spring having two ends 301*a* and 301*b*. Said ends 301*b* and 301*a* for anchoring into the assembly and for ensuring that the spring stays in constant torsion loading. A pin assembly 310 and 311 are disposed proximate each end of said tube 305. The pin 310 includes an opening 310*a* for receiving the end 301*a* of said torsion spring 301. Likewise, the insert 302 includes an opening 302*a* for receipt of the end 301*b* of the torsion spring 301. The insert 302 engages the pin portion 311. The pin portion 310 engages the bushing portion 312. The pin portions 310*b* and 311*b* are inserted within mounting brackets M1 and M2 for mounting in the hollow of the jamb section. The rib portions 305*a* and 305*b* engage with corresponding rib portions provided with the pin section 311 and the bushing 312 to prevent rotation of the pins with respect to the tube unless the tube itself is rotated. With respect to the brackets M1 and M2, spacers S1 may be provided to orient and correctly space the screen assembly in the jamb portion or pocket within which the spring assembly retracts. The screen S is manufactured from a flexible material and has disposed proximate the ends thereof screen welding material or adhesive to adhere to the roller 305 and to the joint provided with respect to the handle portion 320 illustrated best in relation to FIG. 30. The other end of the screen is inserted within the alligator-type locking jaw of FIG. 30 between elements 320*a* and 320*b* to capture the screen portion S2 therein. The screen portion 320 also includes a seal portion 321 which will be described hereinafter which locks and is retained within a channel 322 provided on one edge of the aluminum handle portion. Openings 325 and 326 are provided with the handle assembly 320 so as to retain the guide portions 330 therein. The guide portions 330 are contained within the openings 325 and 326 of the handle portion 320 so as to guide the screen assembly as it pays out from the jamb in a track portion provided with the header and sill portion of the framing sections. A latch portion and a latching plate 350 are shown with the assembly. The latching plate 350 is affixed to the opposite jamb for engaging with the latching member 340 wherein the detents mate and cooperate to retain the screen in its closed position. A seal 321 is contained within a seal receiving channel 320*a* to seal against the opposite jamb and prevent bugs from entering the living space. The guide members 330 include a leg 330*a* which are compatibly shaped with the opening 325 within the handle portion 320. The handle portion 320 is extruded from aluminum to form all of the details thereof. The bracket portions M1 and M2 are mounted within a pocket P as seen in FIG. 1 containing the roll 305. A cover plate 350 therefore is provided which snaps into place via the leg portion 350*a* being inserted within an opening provided adjacent the jamb pocket. The jamb pocket therefore is defined by three sides 10*a*, 10*b* and 10*c* against which the closure member buts up against and seals. This will be described hereinafter in relation to FIG. 21. The screen assembly, and particularly the brackets of FIG. 19 are therefore installed within the frame pocket P of FIG. 21 as being keyed into said frame pocket and engaged with the rear wall 10*c* of the jamb 10. The roller cassette 300 is then installed within the pocket P being pre-tensioned and wherein the pin portions 311*b* and 310*b* are inserted within openings O1 and O2 within said brackets, and the adjustment is provided via the bottom bracket M2 including the spacer S1 with the supplemental adjustment M3 to ensure that the roller is properly placed in the system. The tension may be adjusted if required by removing the snap-on cover portion 350 at any time. The handle portion 320 is specifically sized to be received within the opening defined between the cover 350 and the adjacent jamb portion 10*b*.

Figure 20:
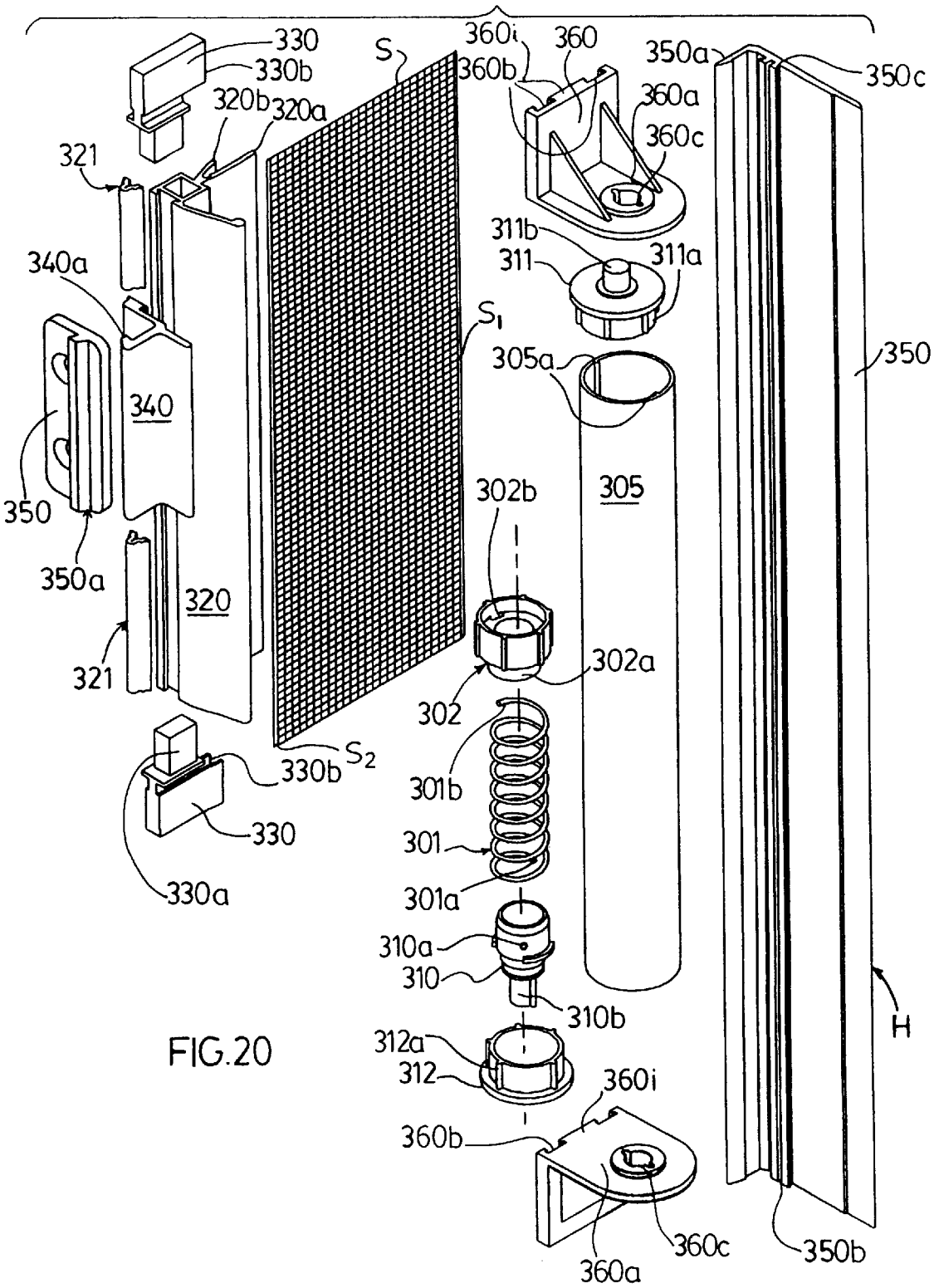
FIG. 20 is a similar view to that of FIG. 19 illustrating another embodiment of the invention.

Referring now to FIG. 20, there is illustrated a similar cassette assembly for a retractable screen to that of FIG. 19 with the exception of the mounting brackets and the particulars of the screen. All other elements are identical or substantially identical. The brackets 360 therefore engage the generally T-shaped guide 350*b* of the snap-on cover 350 proximate the generally T-shaped channels 360*b* disposed therewith as best seen in relation to FIG. 28*b*. Only one of the T-shaped channels or pockets 360*b* therefore engage the T-shaped guide 350*b* which allows for a certain amount of adjustability in relation to the positioning and pre-tensioning of the screen assembly 300. The cover is therefore utilized as a chassis to hold the screen brackets and hence the screen cassette. The edges of the screen S1 and S2 are therefore provided with adhesive in the form of a tape system to mount the edge S1 onto the hollow tube 305 and to mount the edge S2 into the screen-receiving pocket of the handle portion 320 at 320*a*. The glides 330 at the end of the handle portion 320 telescope to accept manufacturing installation variations prior to snapping them into the flexible frame track provided thereby providing a seal for the screen pocket and guide rails.

Figures 21, 22:
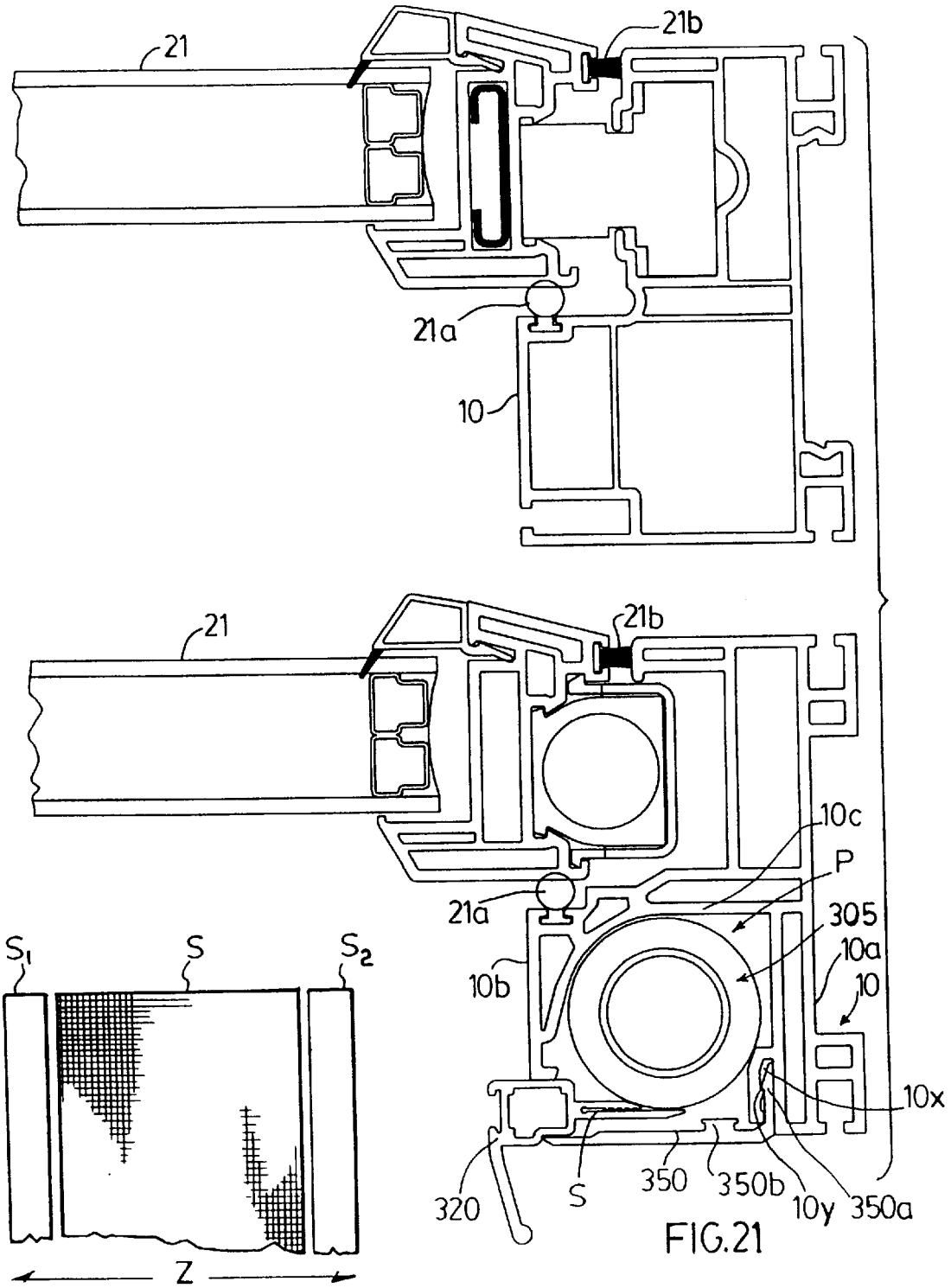
FIG. 21 is a cross-sectional view of a frame portion containing the retractable screen illustrated in a preferred embodiment of the invention.
FIG. 22 is a schematic view of a screen manufactured in another embodiment of the invention illustrated in a preferred embodiment of the invention.
Figure 23:
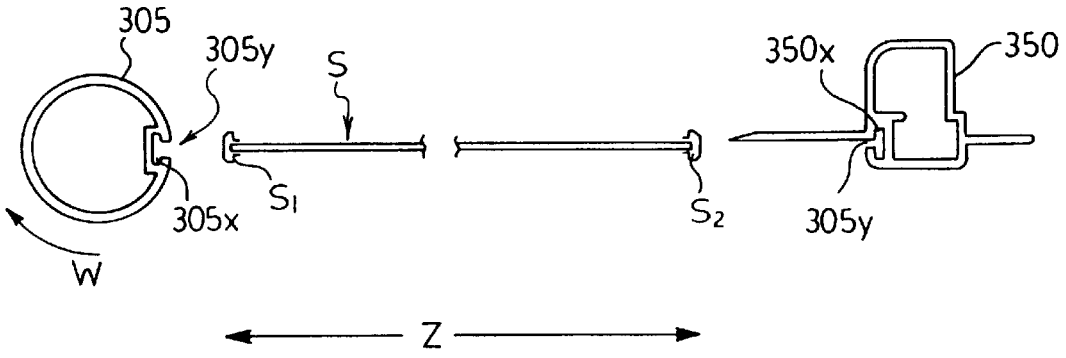
FIG. 23 is a schematic view of the installation of the screen of FIG. 22 in a retractable screen assembly and illustrated in a preferred embodiment of the invention.

Referring now to FIGS. 21, 22 and 23, the screen embodiments shown in FIGS. 19 and 20 may be utilized with a screen assembly as best seen in relation to FIGS. 22 and 23 which include generally T-shaped key portions S1 and S2 which are generally T-shaped and which engage with generally T-shaped openings 305*x* and 350*x* within the tube 305 and within the handle 350 in one embodiment of the invention thereof. By providing such a keyed relationship between the handle and the screen, screen replacement becomes very easy eliminating the need for adhesives and the general cutting of screen sections. The screen width indicated as Z therefore is a constant for all screens. Therefore, one continuous screen may be manufactured having the keyed portions located and anchored to the ends thereof as one continuous roll of screen having a predetermined size or width Z which may be cut to the desired length as the only variable dimension when making the screen assemblies of FIGS. 19 and 20 and/or replacing the broken screen which might result under normal wear of FIGS. 19 and 20.

Referring now to FIGS. 1D and 21, the screen assembly 310 included in the jamb does not compromise the typical framing size and standards nor interfere with the window function. Clearly the closure member or window 21 may be swung outwardly away from the jamb and be sealed against the seal 21*a* in a closed position. Alternatively, when the window is a tilt and slide, the window 21 may be slid away from the jamb 10. When the window is in the closed position, there is no need for the screen to be utilized. Therefore, the screen assembly 300 remains hidden within the jamb portion 10 of the window assembly. An aesthetically pleasing result therefore is pleasant without the unsightly screen being present and without the unsightly lines of an additional housing added onto the jamb section 10. The cover portion 350 including the guide 350*b* may equally be utilized on the side 10*b* of the jamb 10. That is to say it is not necessary to have the cover 350 close the three-sided jamb sections 10*a*, 10*b* and 10*c* from the front face thereof as shown in FIG. 21. Equally, the side face 10*b* and in one embodiment a preferred approach will be utilized for the cover facing 350 wherein the cover therefore is not observable at the front of the jamb 10 but only at the side making a much more esthetically pleasing installation.

Figure 24:
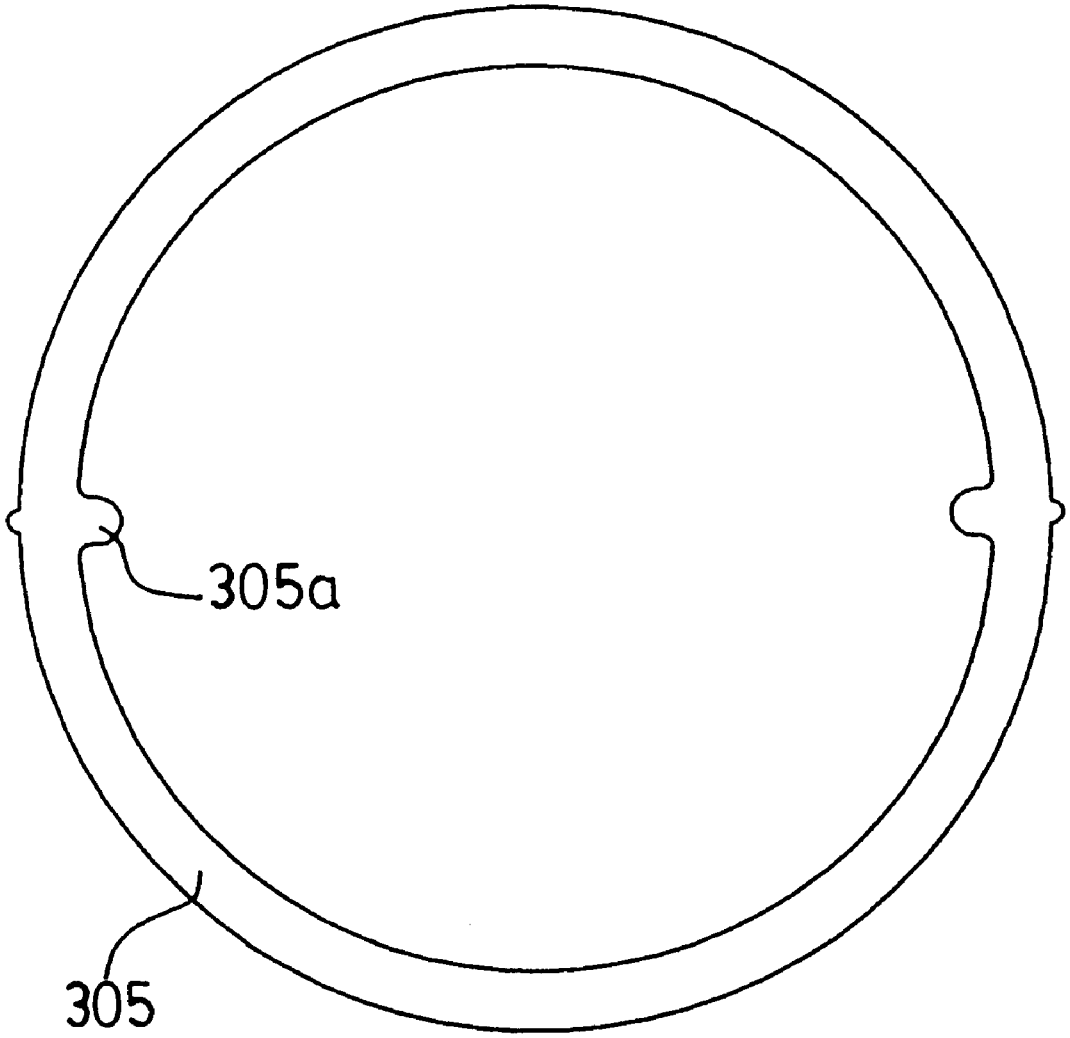
FIG. 24 is a cross-sectional view of the hollow tube upon which the screen is rolled up and illustrated in one embodiment of the invention.
Figure 25A:
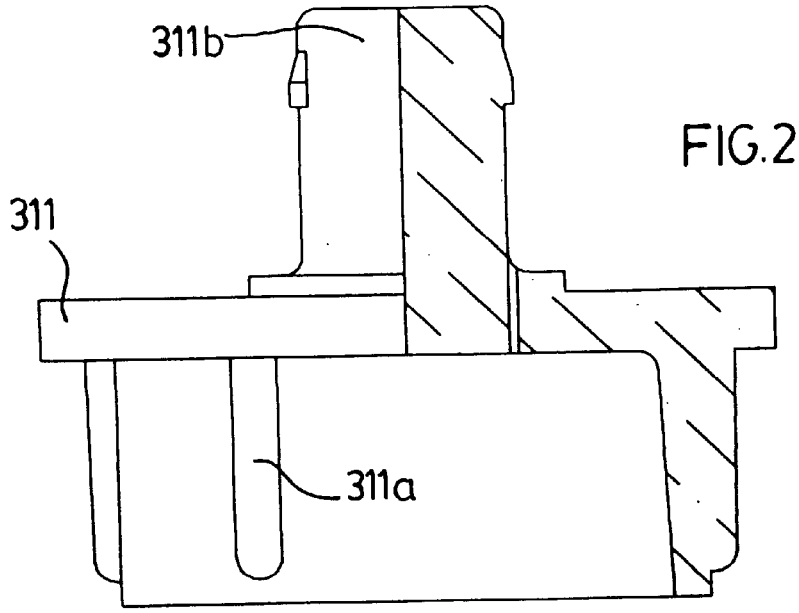
FIGS. 25A and 25B are side and end views of the pin assembly shown in FIG. 19 and illustrated in a preferred embodiment of the invention.
Figure 25B:
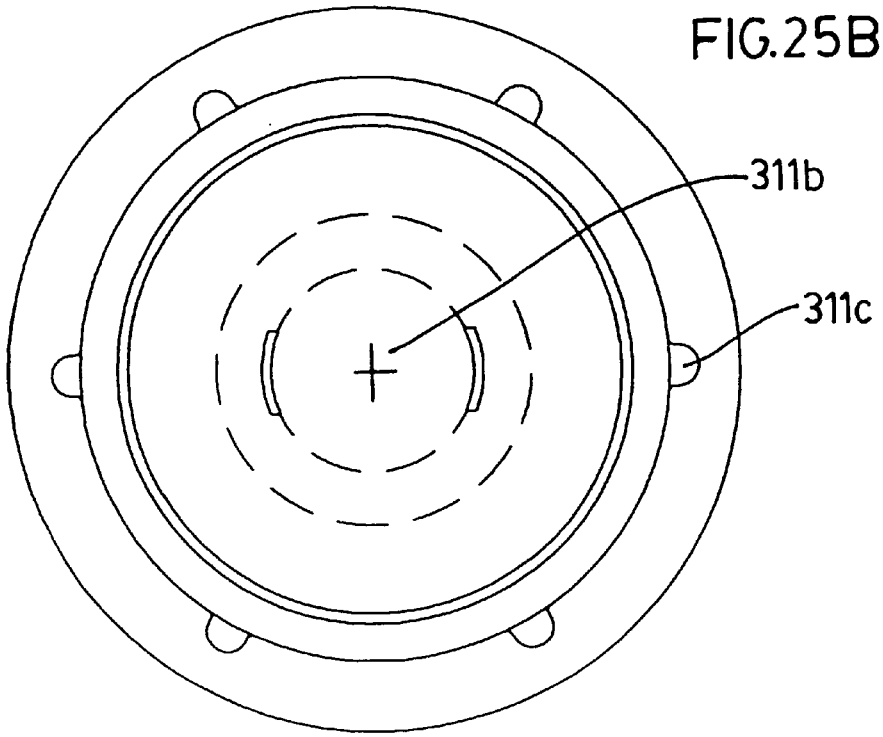
Figure 26A:
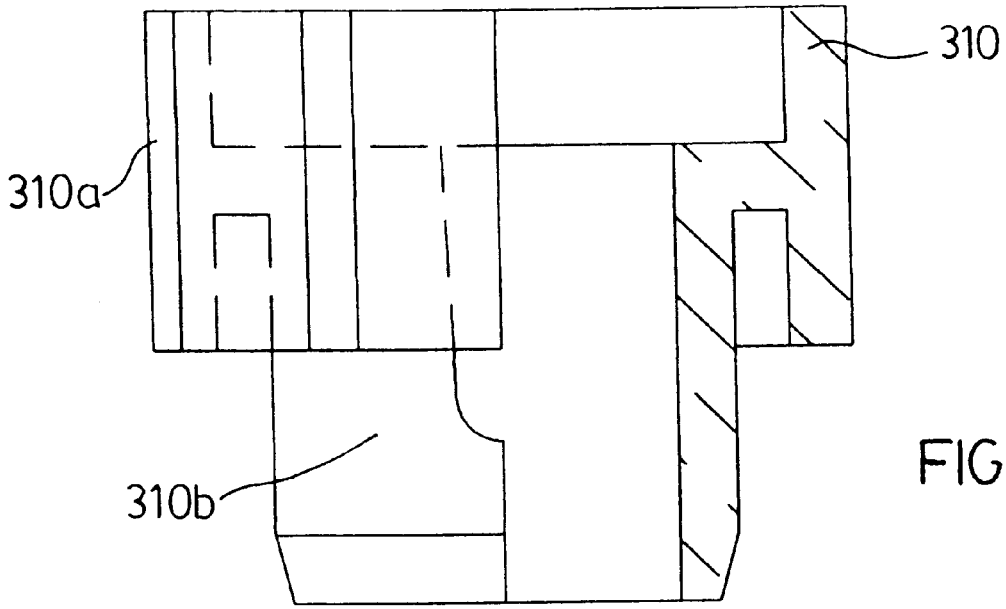
FIGS. 26A and 26B are side and end views of the slide illustrated in FIG. 19 and shown here in a preferred embodiment of the invention.
Figure 26B:
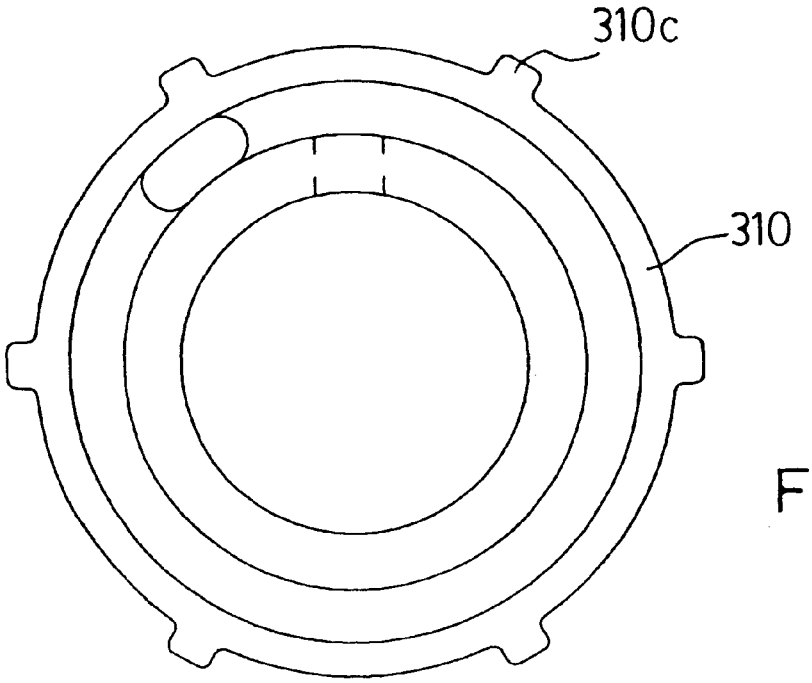
Figure 27A:
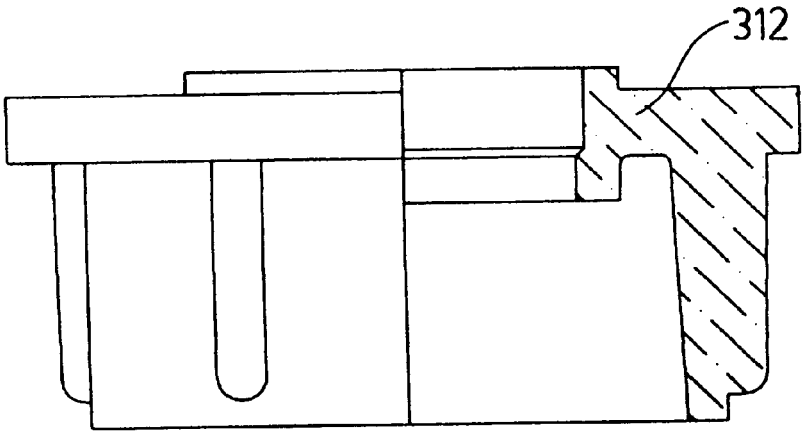
FIGS. 27A and 27B are side and end views of the bushing of FIG. 19 illustrated herein in a preferred embodiment of the invention.
Figure 27B:
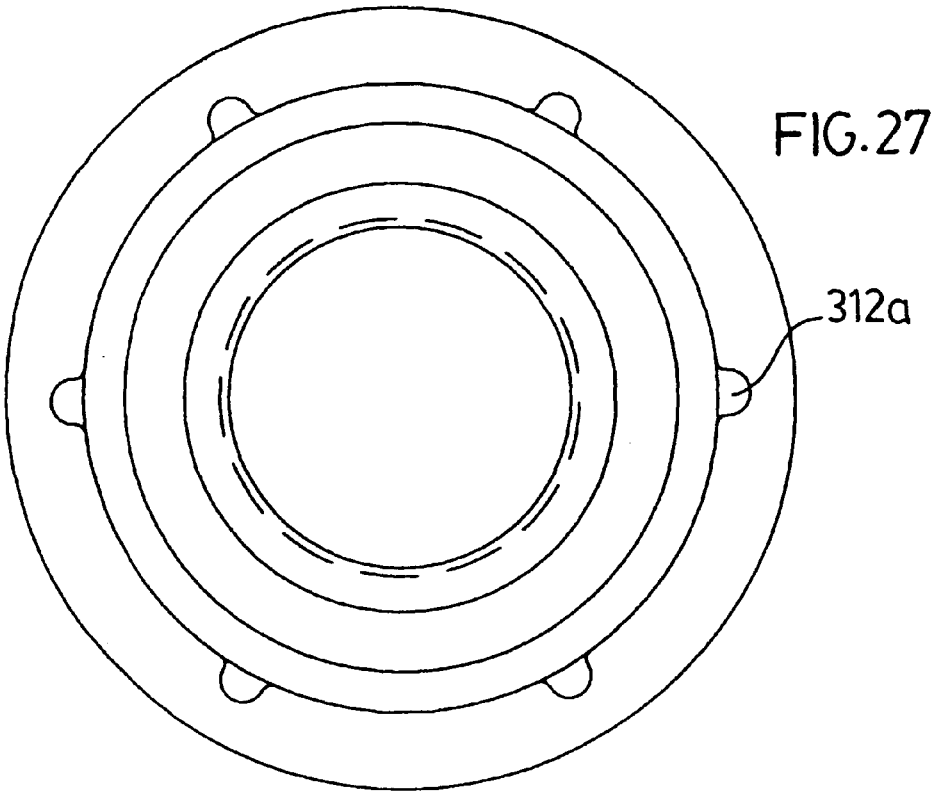

Referring to FIGS. 24, 25A, 25B, 26A, 26B, 27A and 27B, there is illustrated the tube of FIG. 24 having a predetermined diameter and having rib portions 305*a* provided therewith which engage with the compatible detents provided with the pin assembly at 311*a* which prevents the rotation of the pins with respect to the hollow tube 305. In this way, the torsion spring 301 and its effort can not slip in relation to the pins 311*b* and 310*b*. Similarly, the pin assembly embodying 302 as rib portions 302*b* to prevent rotation thereof with respect to the tube portion 305 when engaged with the pin assembly portion 311. An opening 302*a* is provided to engage the spring end 301*b* and help in establishing the loading and the constant torsion of the assembly. Similarly, the pin portion 310 has an opening 310*a* for engagement with the end of the spring 301*a* prior to insertion within the bushing 312 which also includes rib portions 312*a*.

Figure 28A:
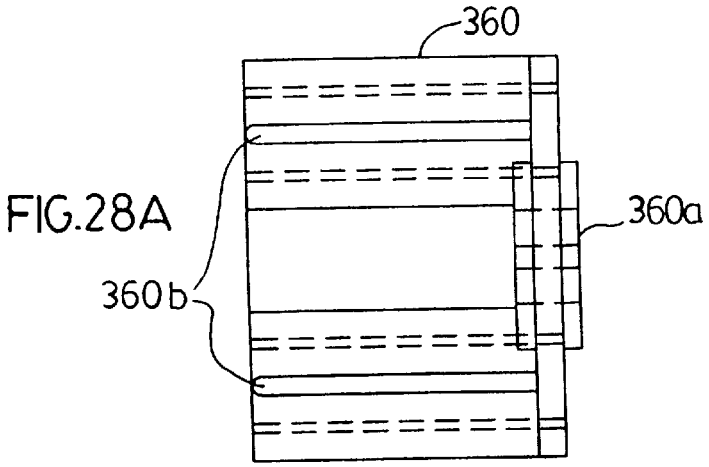
FIGS. 28A through 28C are top end and side views of the mounting bracket of FIG. 19 illustrated in a preferred embodiment of the invention.
Figure 28B:
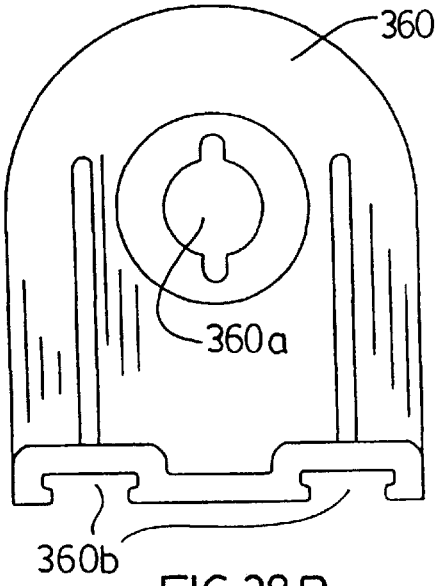

Referring now to FIG. 28A, there is illustrated the bracket of FIG. 20 which bracket 360 includes a pin-receiving opening and a pair of generally T-shaped openings 360*b* for receiving the guide portion 350*b* of the flexible cover 350. Only one of the openings 360*b* is utilized depending on whether the bracket is being utilized as a top or as a bottom bracket. Clearly, the bracket has adjustability in that it may slide along the guide 350*b* in the flexible cover to the predetermined position to turn by the distance separating the pins 311*b* and 310*b* in the screen assembly. The brackets then may be fixed in position utilizing glue or the like and may be fastened to the opposite wall 10*c* of the jamb 10 of FIG. 21 using conventional methods. It is recommended that the fastening be a removable fastener type allowing for repair of the screen assembly.

Referring now to FIGS. 29A and 29C, there is illustrated the glide portion 330 shown in FIGS. 19 and 20 which glide portion has a generally T-shaped guide-receiving portion 330*b* to retain the channel. The member 330*a* therefore is provided to be inserted within the opening 325 of the handle portion 320 to seal the entire assembly. Said foot 330*a* can be moved in and out of the opening 325 to allow for adjustment as is required.

Figure 30:
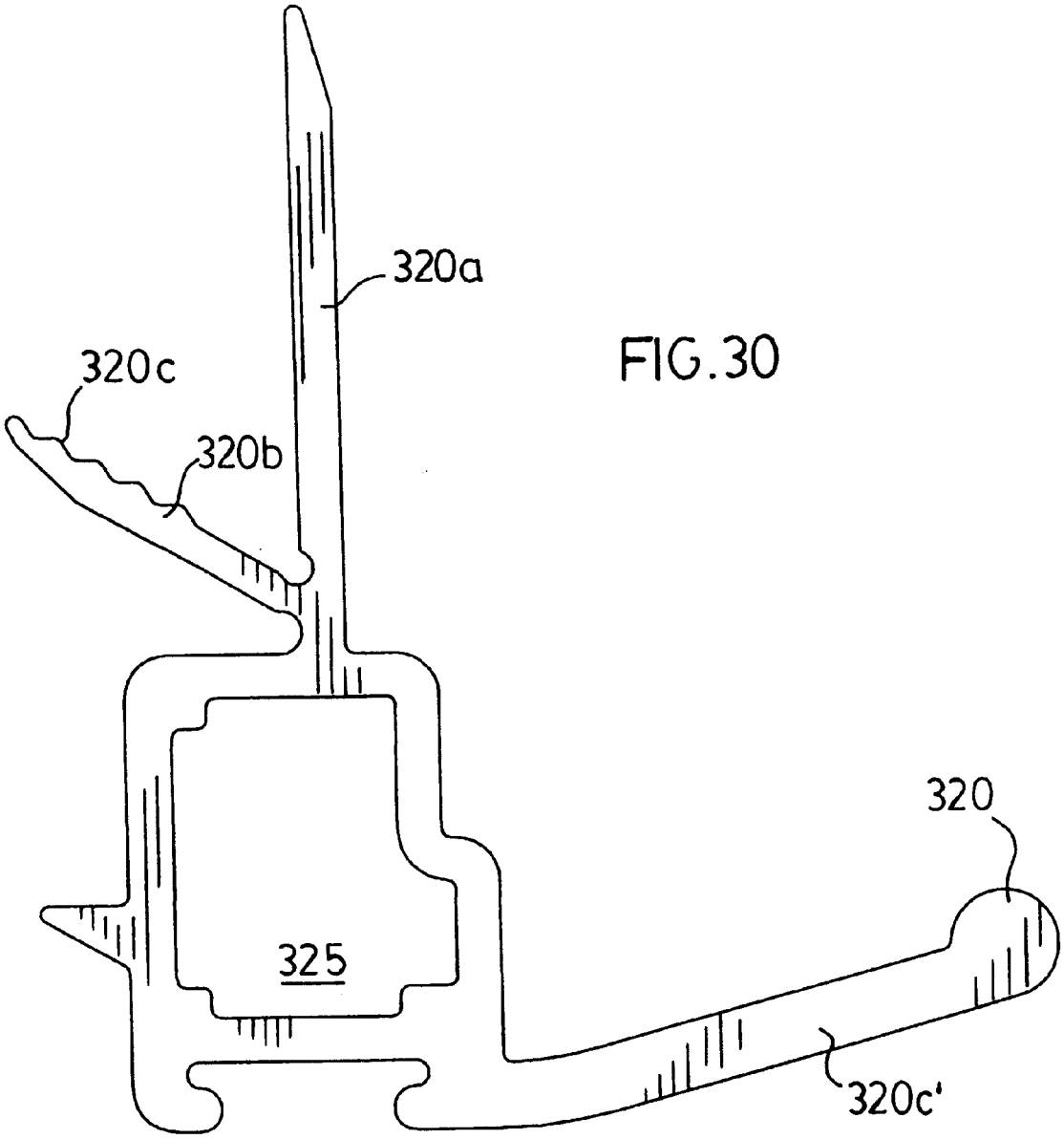
FIG. 30 is an end view of the screen handle illustrated in FIG. 19 and shown here in a preferred embodiment of the invention.
Figure 31A:
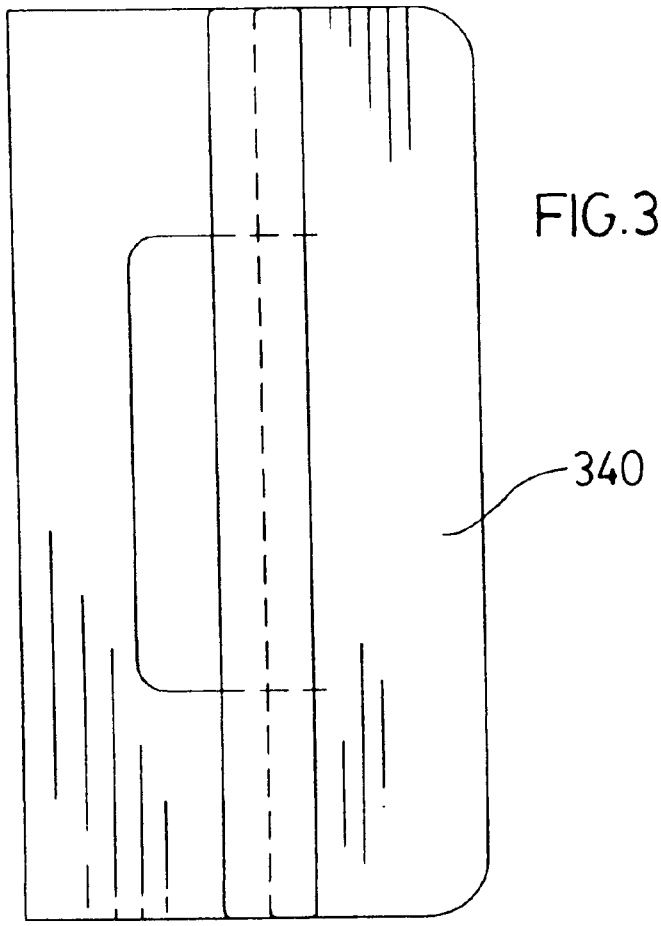
FIGS. 31A and 31B are top and side views of the screen lock illustrated in FIG. 19 and shown here in a preferred embodiment of the invention.
Figure 31B:
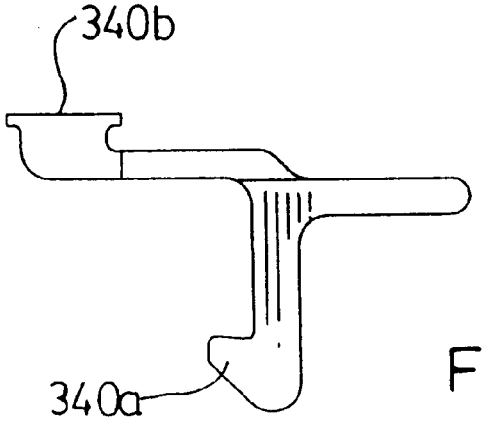

Referring now to FIG. 30 in relation to FIGS. 19 and 20, the handle portion 320 is therefore shown including alligator jaw-like portions 320*a* and 320*b* as seen in FIG. 20 for capturing the edge S2 of the screen S when the portion 320*b* is crimped and moved toward the edge of portion 320*a* capturing the screen therebetween via serrated edges 320*i* of the side 320*b* of the joint. An opening 325 is provided for receipt of the guide portion 330. The handle portion 320*i* allows a user to remove the screen as required.

Referring now to FIGS. 31*a*, 31*b*, 32*a* and 32*b*, there is illustrating the latching portions of the screen assembly comprising items 340 and 350. The portion 340 is mounted on the handle portion 320 and is clipped in position via a hook portion 340*b* to be retained within a slot 320*i* and 340 as best seen in FIG. 19. This latching portion engages the latching plate of FIGS. 32A and 32B which is mounted via mounting openings 350*b* of the latching plate 350. The opposite jamb is utilized to mount the latching plate 350 so that as the screen moves across the opening framed by the frame assembly, the detent or latch portion 340*a* engages the latch portion 350*a* of the latching plate to retain the screen in its operative position. This can be released of course by disengaging the latching portions 340*a* and 350*a* respectively wherein the screen may be retracted within the opening in the jamb 10 of the framing section.

Figure 32A:
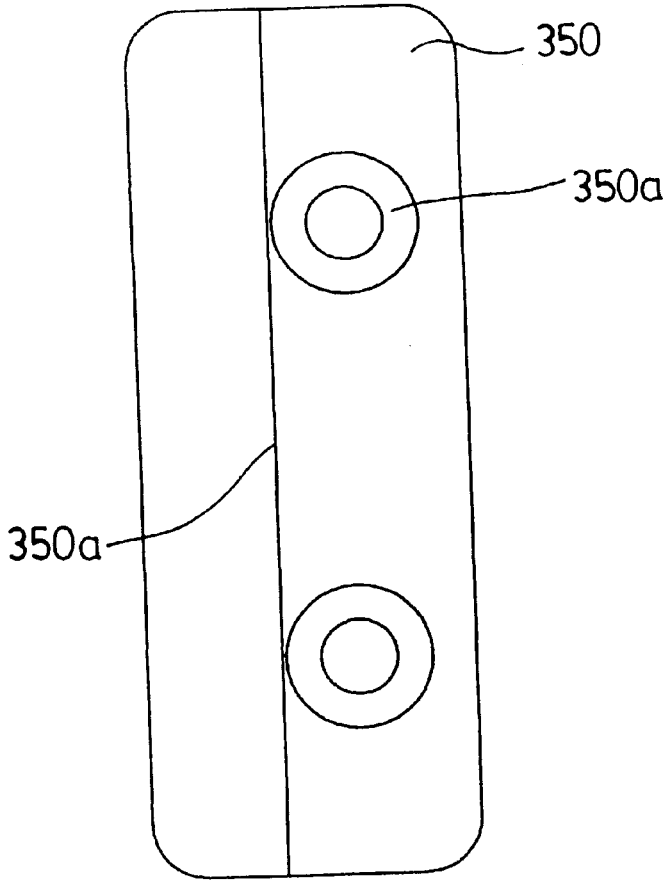
FIGS. 32A and 32B are top and side views of the latching plate of FIG. 19 and shown here in a preferred embodiment of the invention.
Figure 32B:
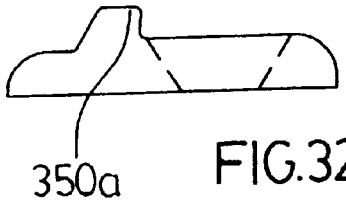
Figure 33:
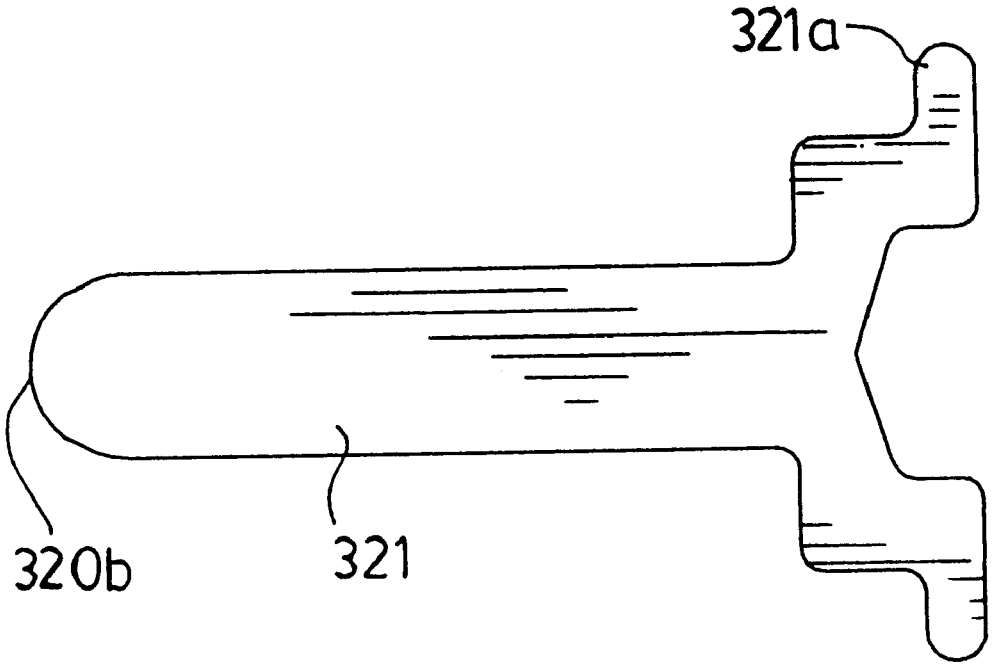
FIG. 33 is an end view of the sealing block shown in FIG. 19 and illustrated here in a preferred embodiment of the invention.

Referring now to FIG. 33, there is illustrated the but seal 321 which is anchored in position within the groove 320*a* of the handle portion 320 via legs 321*a*. The bug seal 321 therefore buts up against the opposite jamb portion not shown via edge 320*b*, that is the same jamb portion to which the latching plate of FIGS. 32A and 32B is mounted.

Figure 28C:
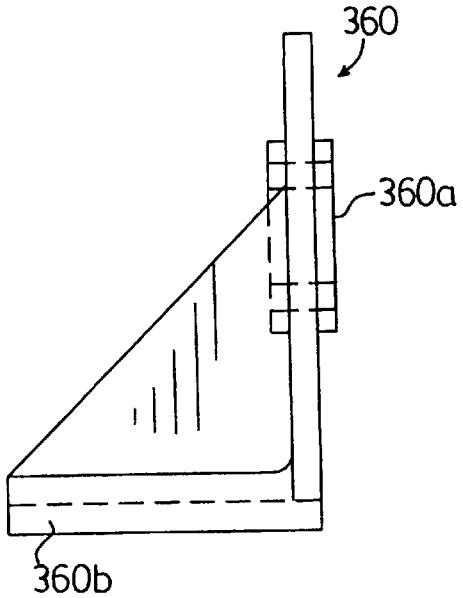
Figure 34:
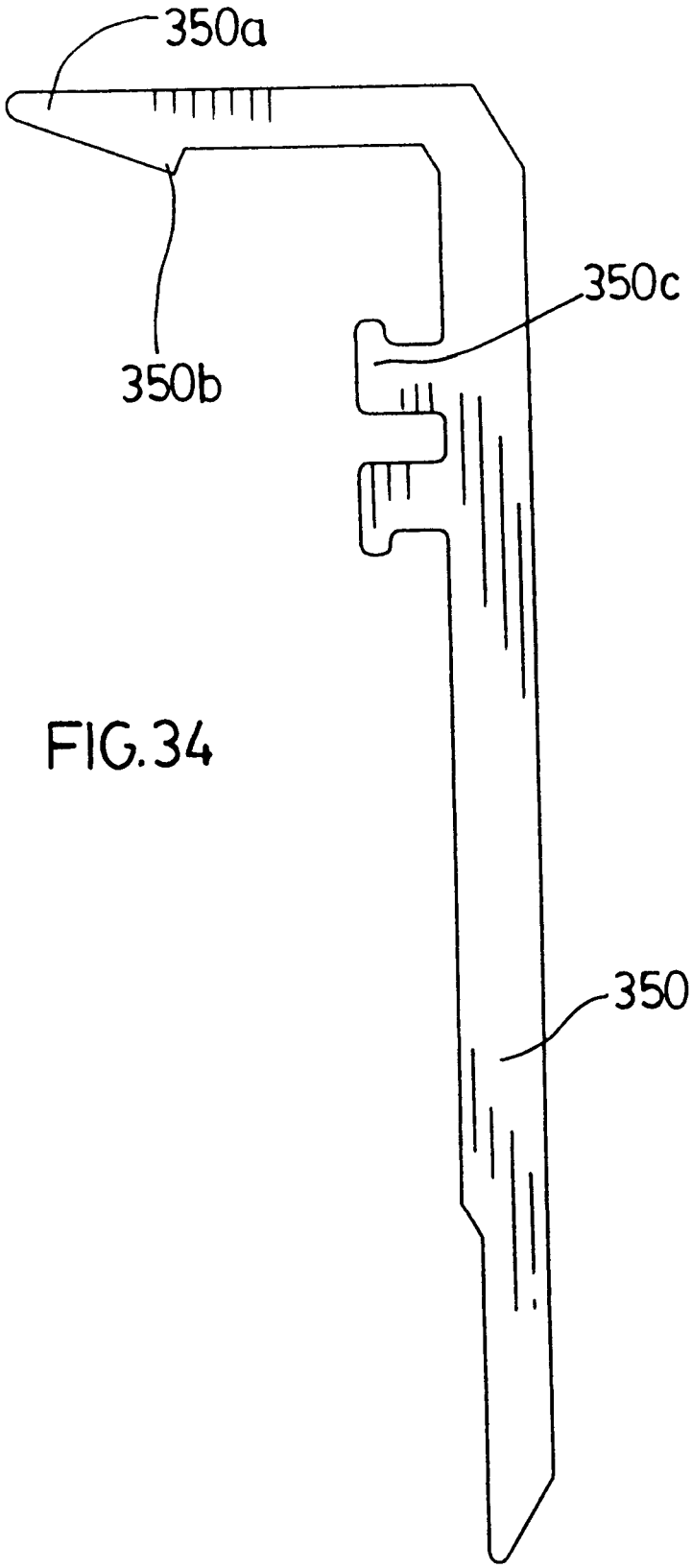
FIG. 34 is a side view of the cover portion for the jamb section of FIG. 21 and illustrated in a preferred embodiment of the invention.

Referring now to FIG. 34, there is illustrated the cover portion 350 for the assembly of FIG. 20 which includes an arm or leg portion 350*a* which is received within the channel 10*x* of FIG. 21 which includes a locking edge at 350*b* to retain said arm 350*a* within the compatible groove 10*x* which also includes a detent at 10*y* to correspondingly lock the flange in position. The element 350*c* therefore is disposed within the interior side of the cover 350 to be received within the channels or guides shown in FIGS. 28A through 28C at 360*b* and thereby retain the mounting brackets for the screen assembly in the position required allowing the adjustment thereof and final fixing in relation thereto.

Those skilled in the art will also appreciate the fact that a screen assembly having two ends separated by a predetermined distance and being formed as a continuous screen which may be cut as required at a predetermined distance as set out by the length of the tube 305. The anchor portions S1 and S2 are a fixed distance and are manufactured with the screen on a continuous length of screening which may be cut as required including cutting these anchor portions as best seen in relation to FIG. 23. This makes screen replacement very easy.

The entire assembly therefore 300 is provided as a cassette totally assembled and insertable into the jamb opening defined by the three sides of the jamb 10 at 10*a*, 10*b* and 10*c*. It is only necessary to provide the cassette integral with the cover portion 350 which may be either the front cover which clips in position as shown in FIG. 21 or a side cover, not shown, but easily determined by those skilled in the art from the teachings herein.

Figure 35A:
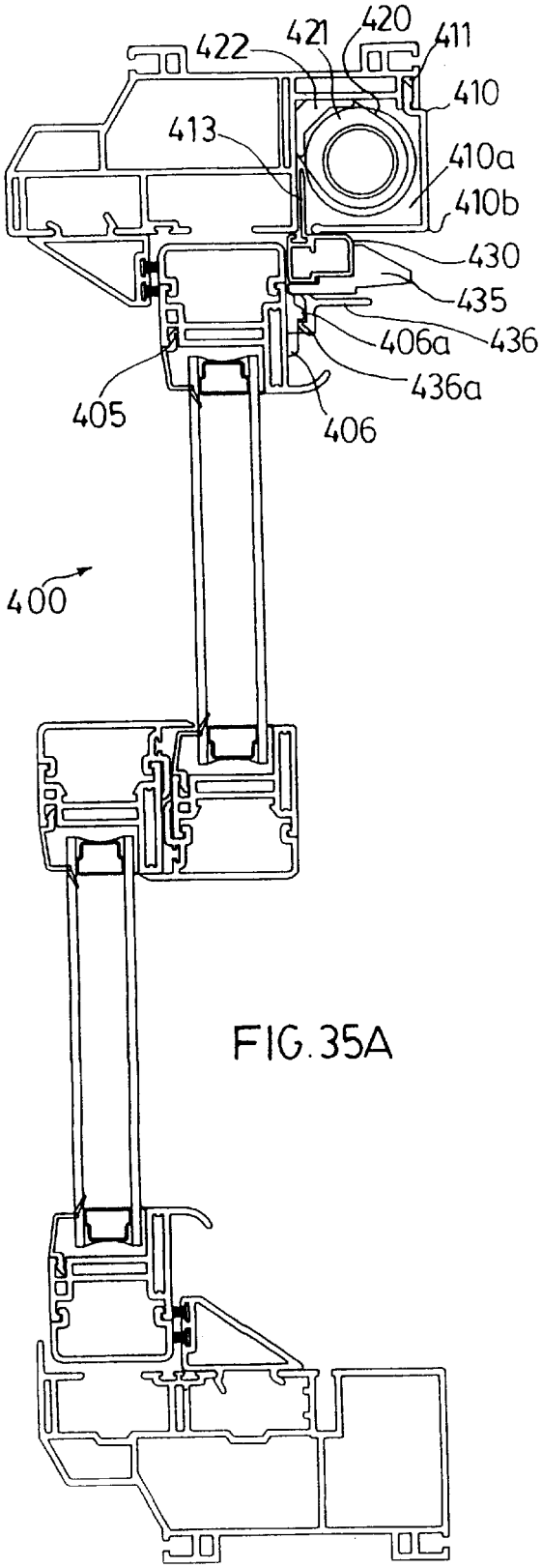
FIG. 35A is a top view for a tilt and slide window assembly containing the roller screen mechanism illustrated in a preferred embodiment of the invention.
Figure 35B:
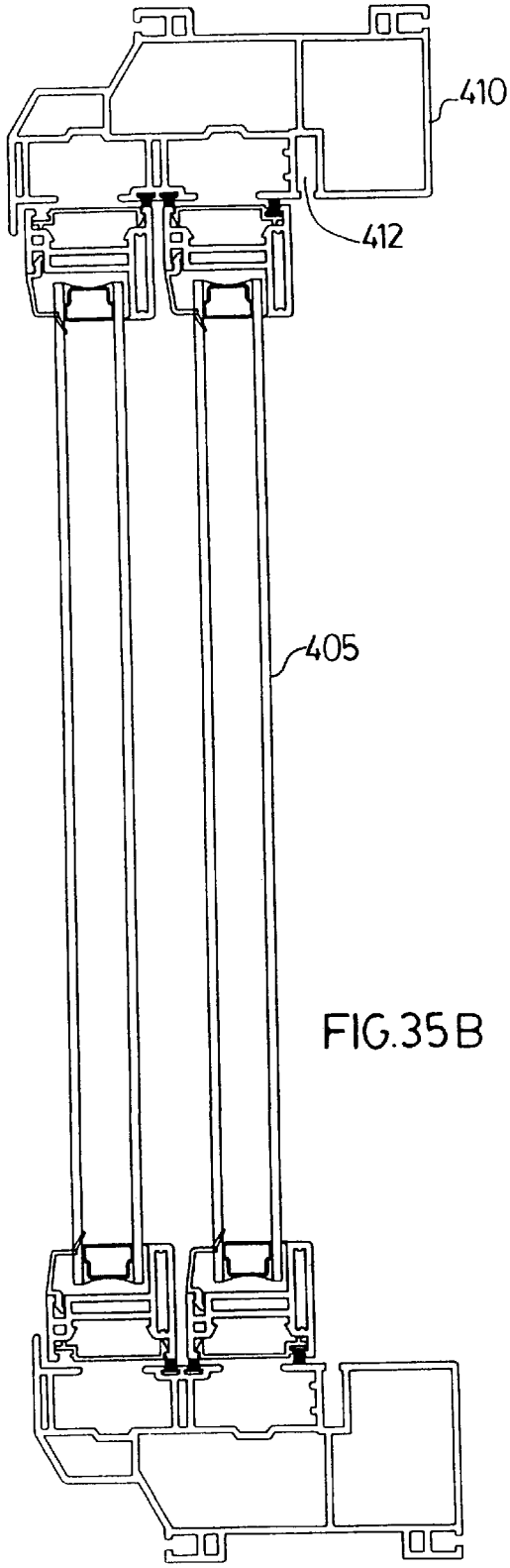
FIG. 35B is an end view of the window assembly of FIG. 35A illustrated in a preferred embodiment of the invention.
Figure 36:
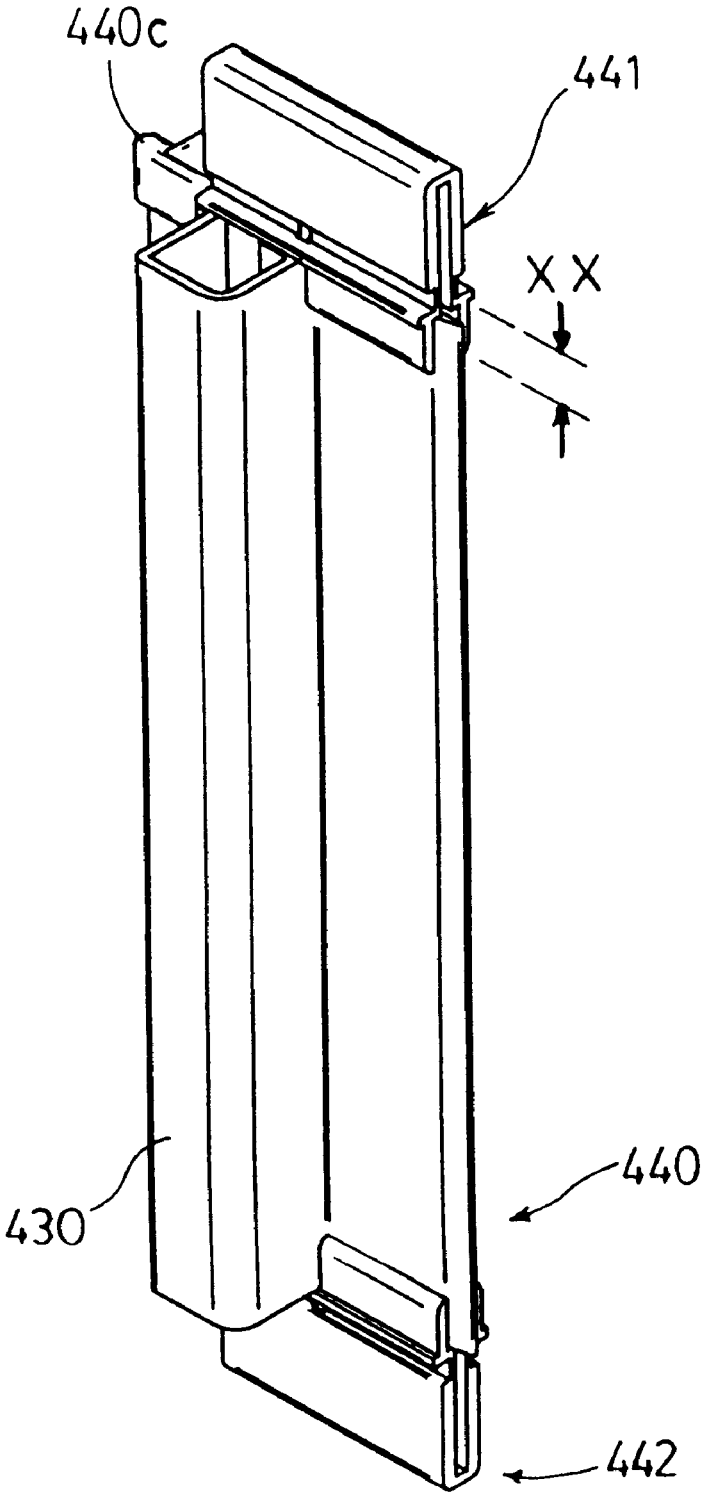
FIG. 36 is a schematic perspective view of the glide portions of the screen assembly illustrated in a preferred embodiment of the invention.
Figure 37:
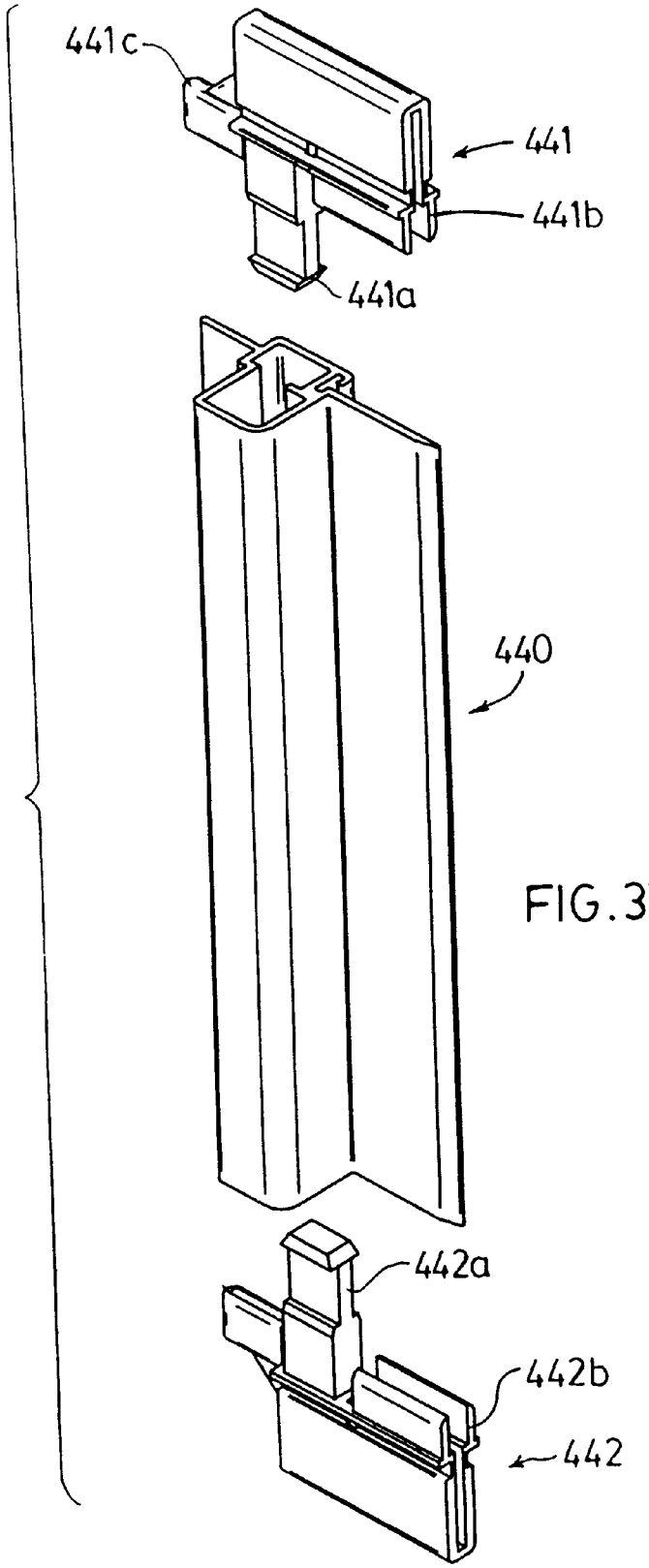
FIG. 37 is an exploded perspective view of the glide assembly of FIG. 36 illustrated in a preferred embodiment of the invention.
Figure 38:
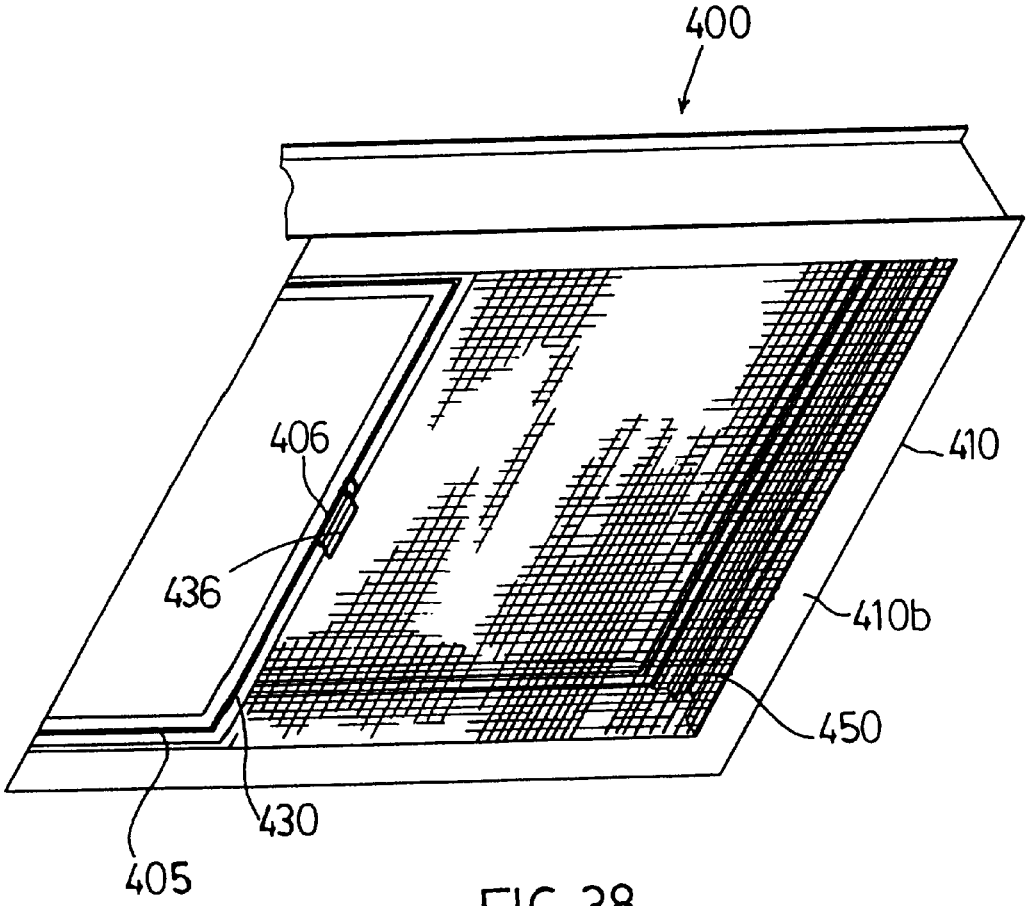
FIG. 38 is a schematic perspective view of a tilt and slide window assembly as shown in FIGS. 35A and 35B and illustrated in perspective in a preferred embodiment of the invention.
Figure 39:
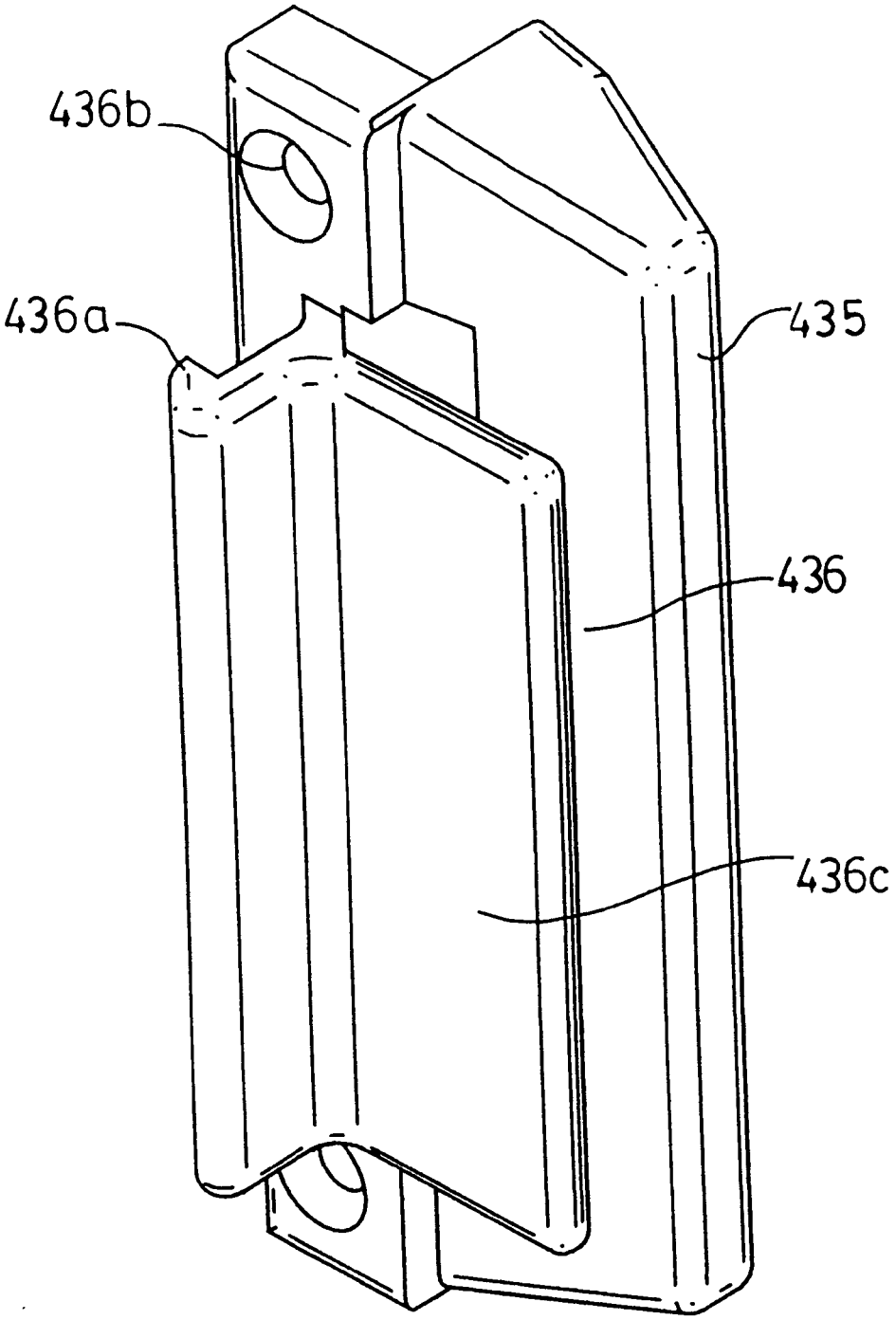
FIG. 39 is a perspective view of the handle portion 435 and the latch portion 436 illustrated in perspective in the preferred embodiment of the invention.
Figure 40:
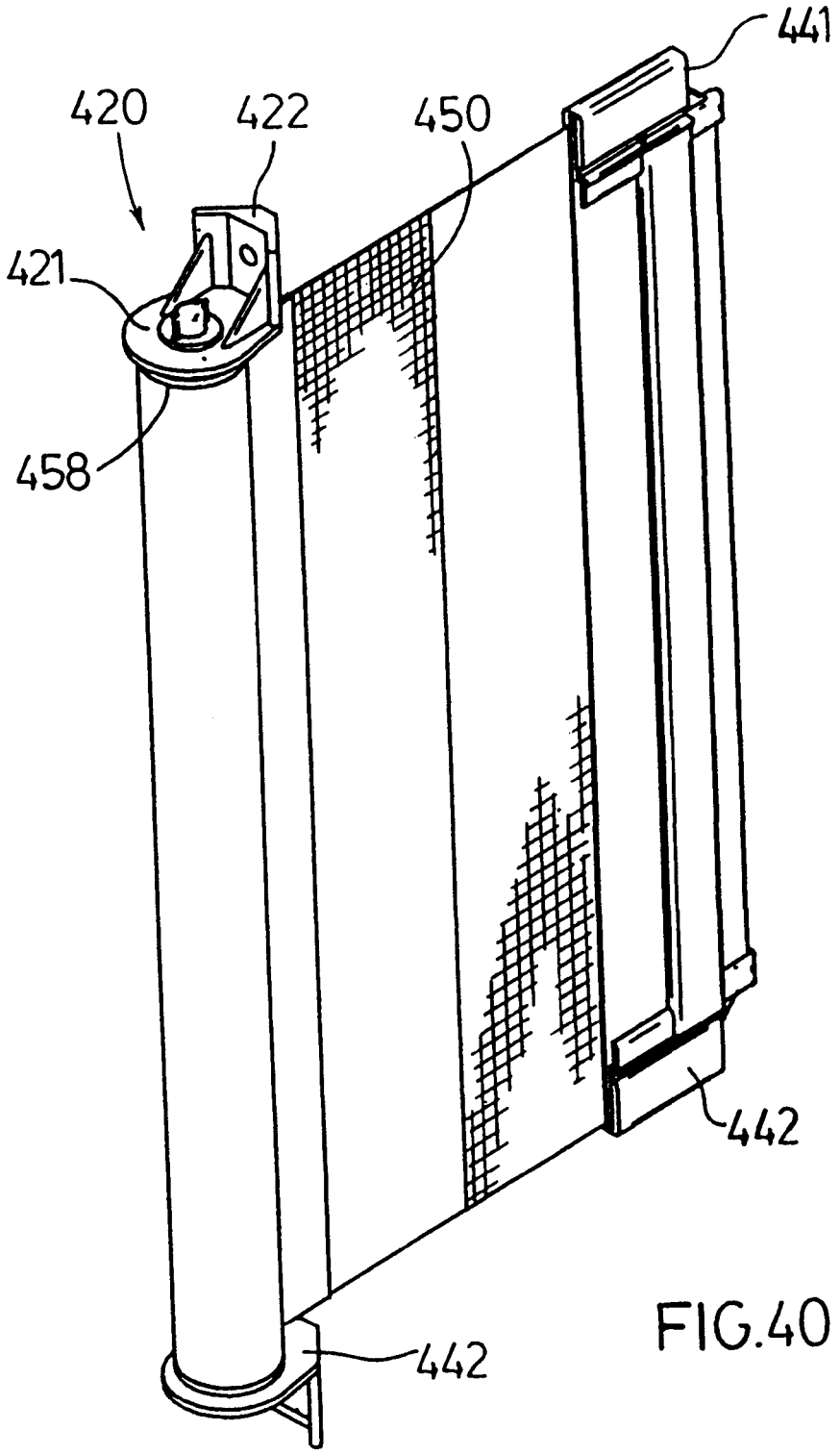
FIG. 40 is a perspective view of the screen assembly incorporated in the tilt and slide window assembly of FIG. 38 and illustrated in a perspective view in a preferred embodiment of the invention.
Figure 45:
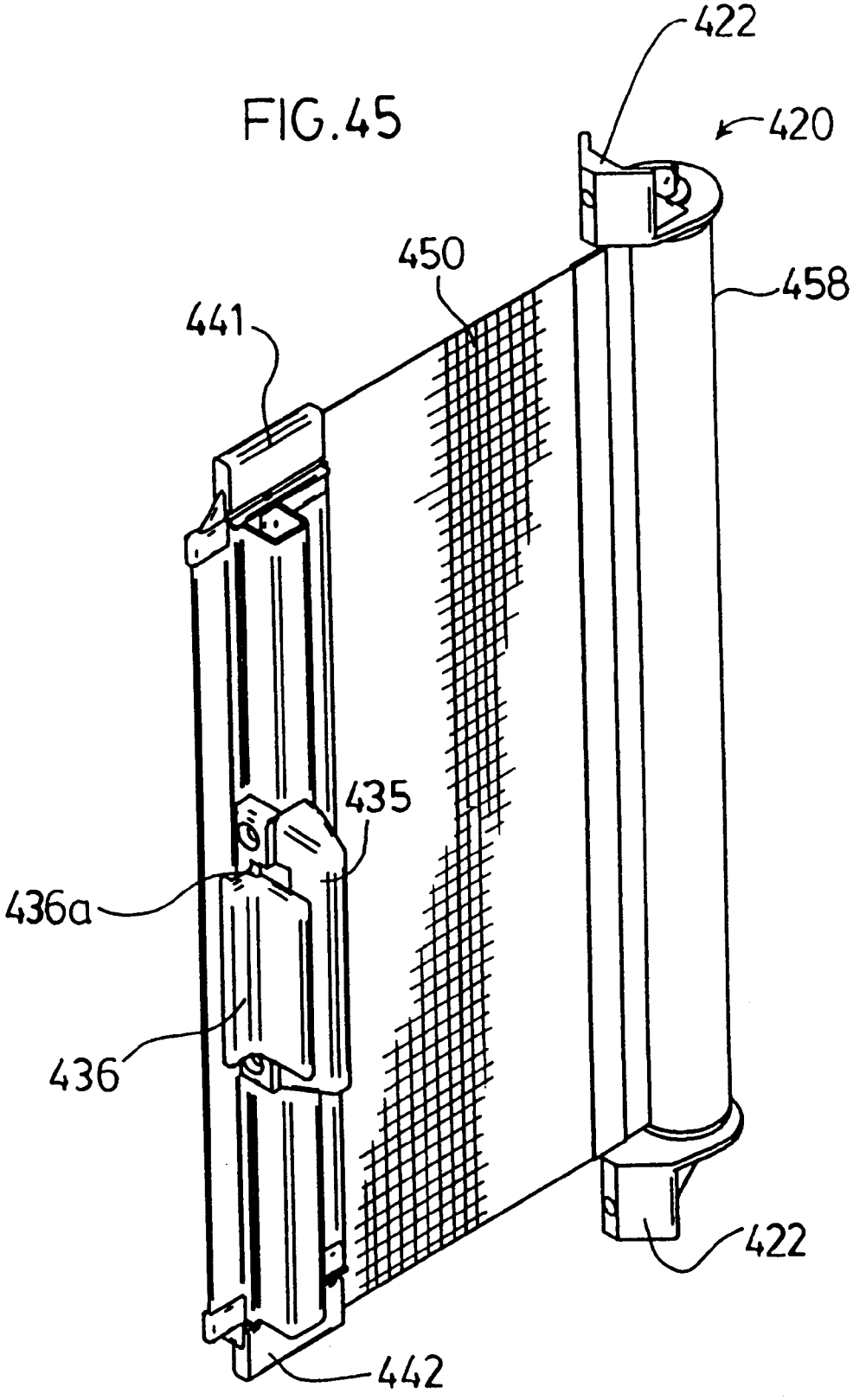
FIG. 45 is a schematic perspective view of the screen cassette assembly illustrated in a preferred embodiment of the invention.

Referring now to FIGS. 35A, 35B, 38, 44 and 40, there is provided a tilt and slide window assembly 400 wherein a sash 405 including a window light may slide in the track or pivot from the pivotable end thereof as is described previously. The sash is pivotally mounted within a frame section including jamb portions 410 wherein the screen assembly 420 is contained within the opening or pocket 410*a* provided in the framing jamb portion 410. As is best seen in FIGS. 21 and 35A, the roller assembly best seen in FIGS. 40 and 45 is contained within the opening 410*a* as fastened in position by a corner bracket 422, as best seen in FIG. 40. The jamb portion 410 is closed by a cover portion 410*b* after the screen assembly 420 is located in its position by the corner bracket 422. The screen will therefore pay out along the pathway 413 when the handle portion 430 is moved along with the sash 405 when desired. A latch portion and handle portion 435 and 436 respectively including a hook portion 436*a* engages with a detent portion 406 at the hook portion 406*a*. The movement therefore of the sash 405 will result in the movement of the screen 420 automatically and pay it out through the guide recess to cover as much of the opening as is desired. That is to say that one may pay out the screen 10% or 100% to cover the appropriate opening. Because of the design of the screen including the telescoping guides as best seen in FIG. 36, the screen is guided through channel 412 as best seen in FIG. 35B between fully closed and fully opened positions. The glide assembly therefore will accommodate and receive the upper edges and the bottom edges of the generally T-shaped screen portion as best seen and described in relation to FIG. 20. An upper glide 441 therefore and a lower glide 442 is provided to ride within the respective channel portions 412 of the jamb framing sections. The handle portion 430 therefore is adapted to receive the leg portions 441*a* and 442*a* of the glide portions respectively as best seen in relation to FIG. 37. A bug block 440*c* is provided as is previously described. The screen therefore will pay out from its roller as best seen in FIG. 40 and 45 including the glides capturing the edge of the screen including the generally T-shaped portion and riding within the guides 412 of the tilt and slide window assembly. When it is desired not to operate the screen, the latch 436 is operated to separate the detents 436*a* and 406*a*. The window will then operate on its own without the screen. Should it be desired to recapture the screen, one merely closes the window and snap locks the two detents together again to re-engage the screen assembly. This is best seen in relation to FIG. 38 and 44 wherein the screen is fully payed out and the latch 436 is engaged with the detent 406.

Figure 41:
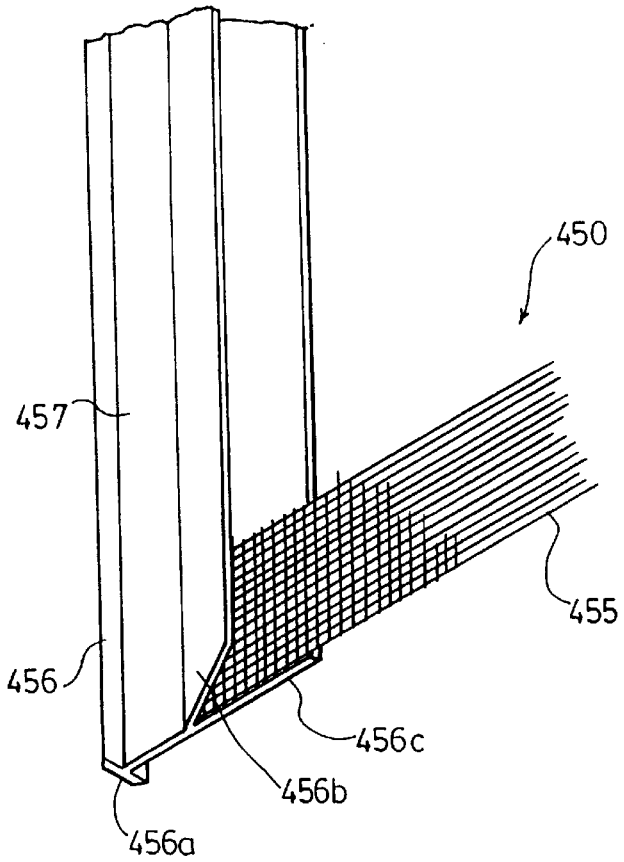
FIGS. 41 through 43 are partial perspective cut-away views of the screen assembly including the T-shaped portion and the method of assembling it with the screen and illustrated in preferred embodiments of the invention.
Figure 42:
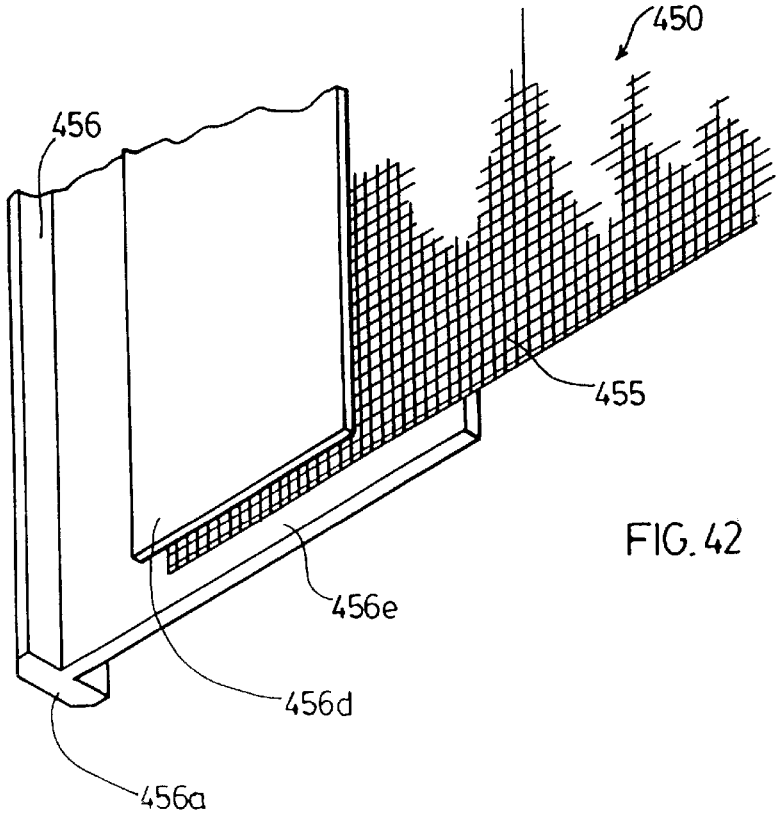
Figure 43:
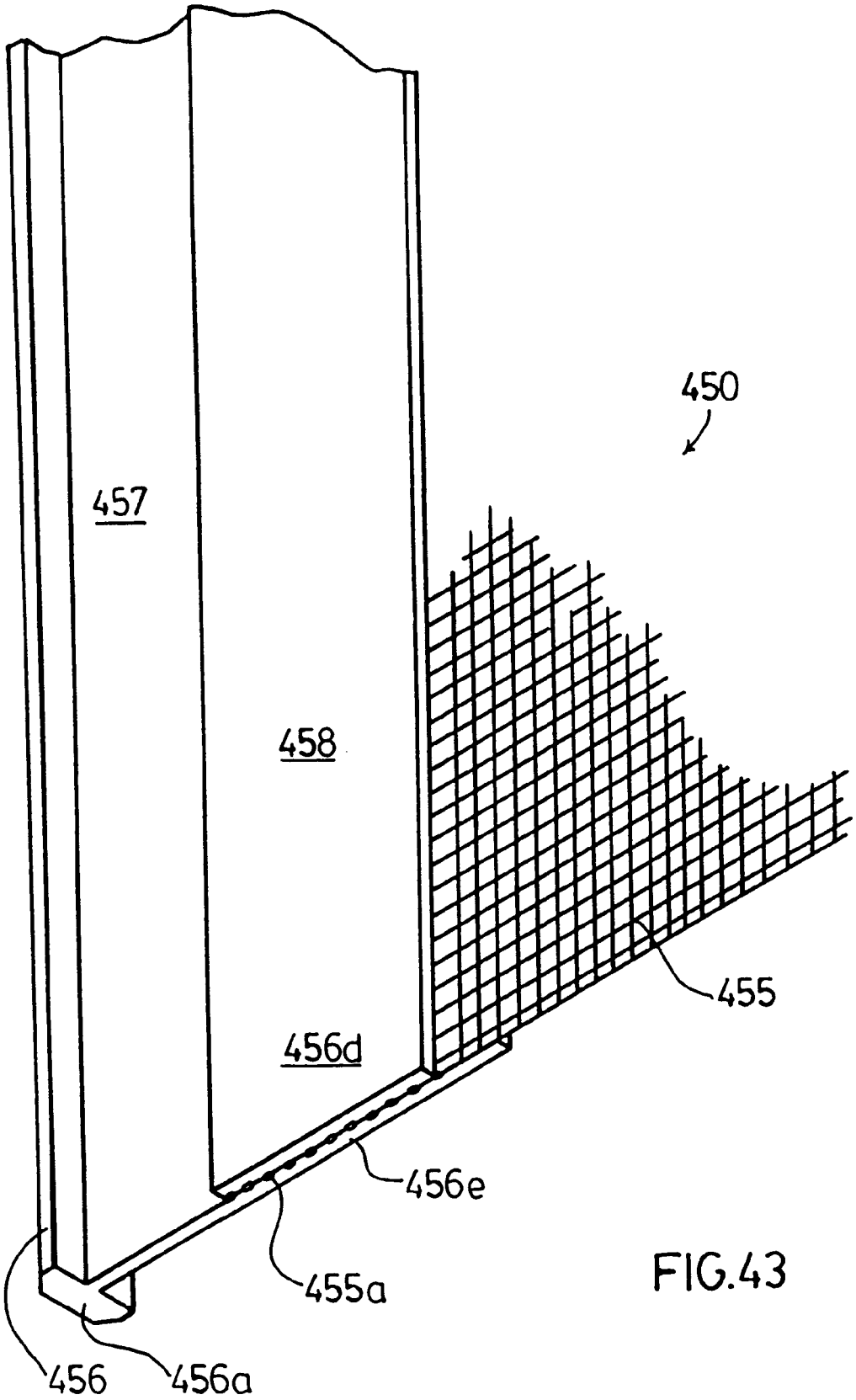
Figure 44:
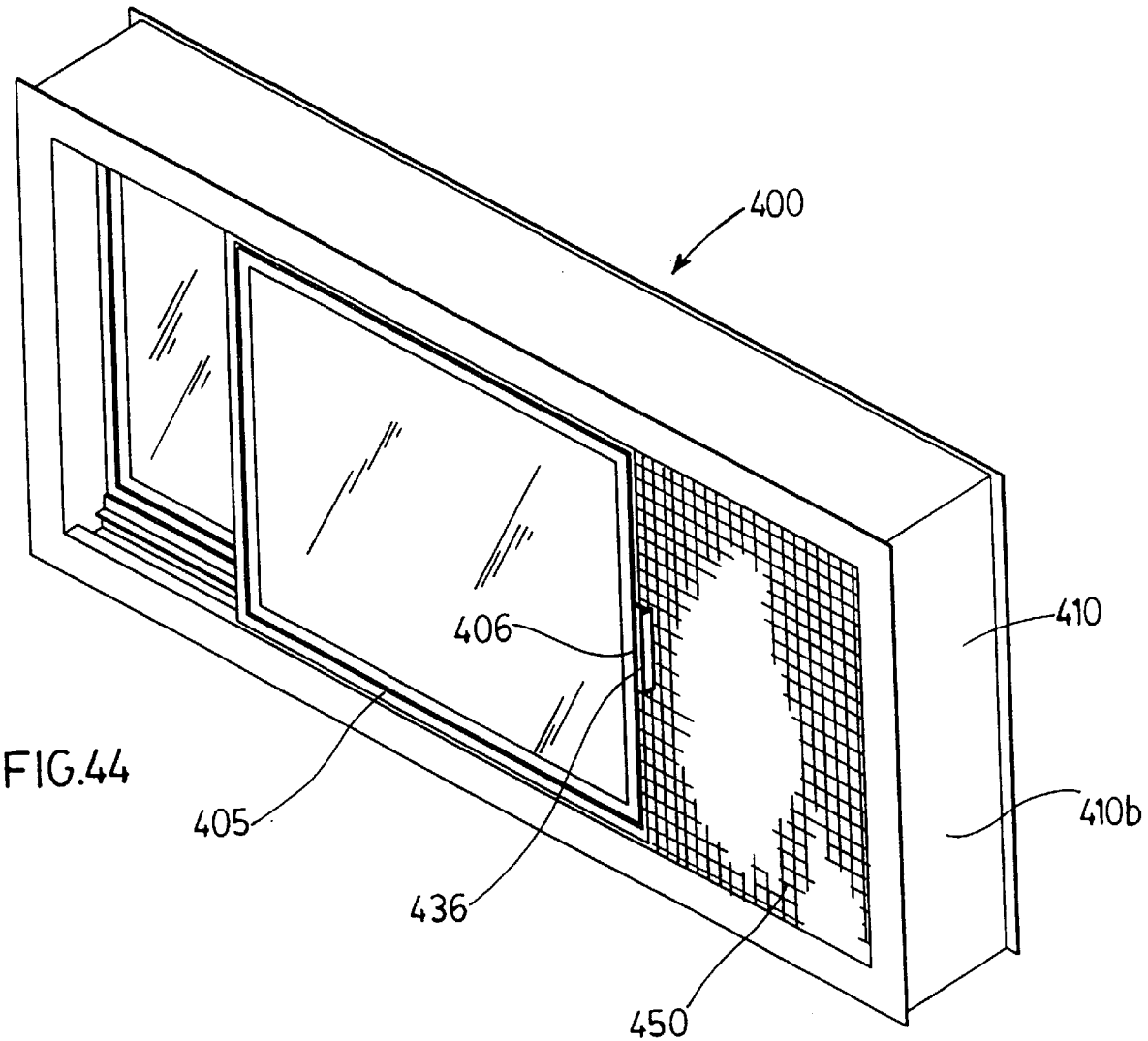
FIG. 44 is a schematic perspective view of a tilt and slide window assembly illustrated in a preferred embodiment of the invention.

Referring now to FIGS. 41 through 43, there is illustrated the method of assembling the screen with the generally T-shaped key portions. The key portions 456 therefore are manufactured from polyvinyl chloride or the like which is a material that may be radio frequency welded. The key portions therefore 446 include the head portion 456*a* for capturing within the appropriate groove of the handle and roller portion as best seen in relation to FIGS. 19, 21 and 22. The head portion therefore is separated from the two portions 456*b* and 456*c*, or alternatively 456*d* and 456*e* making up the leg to capture the screen 455 or sandwich it therebetween. In FIG. 41, the two legs 456*b* and 456*c* are generally connected to one another and separated from the head portion 456*a* by a flexible extension 457 which is not radio-frequency welded to the screen 455. This section 457 provides a considerable amount of flexing for the screen assembly and reduction in damage to the screen 455 as a result of any tensioning load on said screen 455. Once the two screen-capturing portions 456*b*, 456*c*, or alternatively 456*d* and 456*e*, as seen in FIGS. 41 and 42 respectively, capture the screen 455, the screen is passed through a radio-frequency welding machine continuously preferably so as to form a continuous roll of screen accumulated on a roll for future use. As best seen in FIG. 43, elements 450*a* of this screen which is manufactured from vinyl-coated fiberglass are melded into the polyvinyl chloride of the leg extensions 456*d* and 456*e* of the key element. In this manner, a tough and viable screen assembly is provided.

Referring generally to the figures a method of manufacturing a screen roller assembly comprises the following steps:

1) forming a screen from suitable screen material such as fiberglass and preferably coating said screen with vinyl,
2) forming a generally key-shaped anchor for said screen preferably from polyvinyl chloride, preferably said key having a head and a leg comprising two portions and a connector connecting said leg to said head, preferably said head being generally T-shaped,
3) separating the two leg portions for receiving the edges of said screen,
4) radio frequency welding said leg portions capturing said edges of said screen and preferably melding said vinyl of said screen with the PVC of said key,
5) forming a continuous screen to be accumulated on a roll as roll stock to be supplied to the window manufacturer or repair organization, A predetermined amount of screen may be payed of the roll stock roll sized to a predetermined window opening size which may be easily assembled with the spring-biased roller upon which the screen will accumulate by a manufacturer or by a repair person and which also may be engaged with the handle portion proximate the other edge of said screen, both said roller and said screen handle including a compatibly shaped generally key-shaped receiving portion to receive the head of said key for easy installation or replacement thereof.

It is important that the legs of the key portion be separated from the head portion by a flexible extension to allow for the accommodation of stretching in the screen assembly at that particular location when assembled without destroying the screen. It has been found that the screen when melded together with the PVC key has considerably more strength than the known methods of taping and gluing screen edges to rollers and handle portions. The flexibility is provided by the flexible key shape and material. Any suitable material can be utilized including those materials which readily accept hot welding. However, radio frequency welding is preferred because one does not have to allow for creeping of the material and the allowances of temperature differentials. Cold dies may be provided which come together to provide a reliable joint which may be accurately controlled.

The present invention advantageously fits into any existing frame design thereby reducing cost, easing assembly and improving appearance. It is only necessary to provide a pocket with the jamb, header or sill of any window design within which the screen roller assembly is placed preferably as a cassette.

Figure 46:
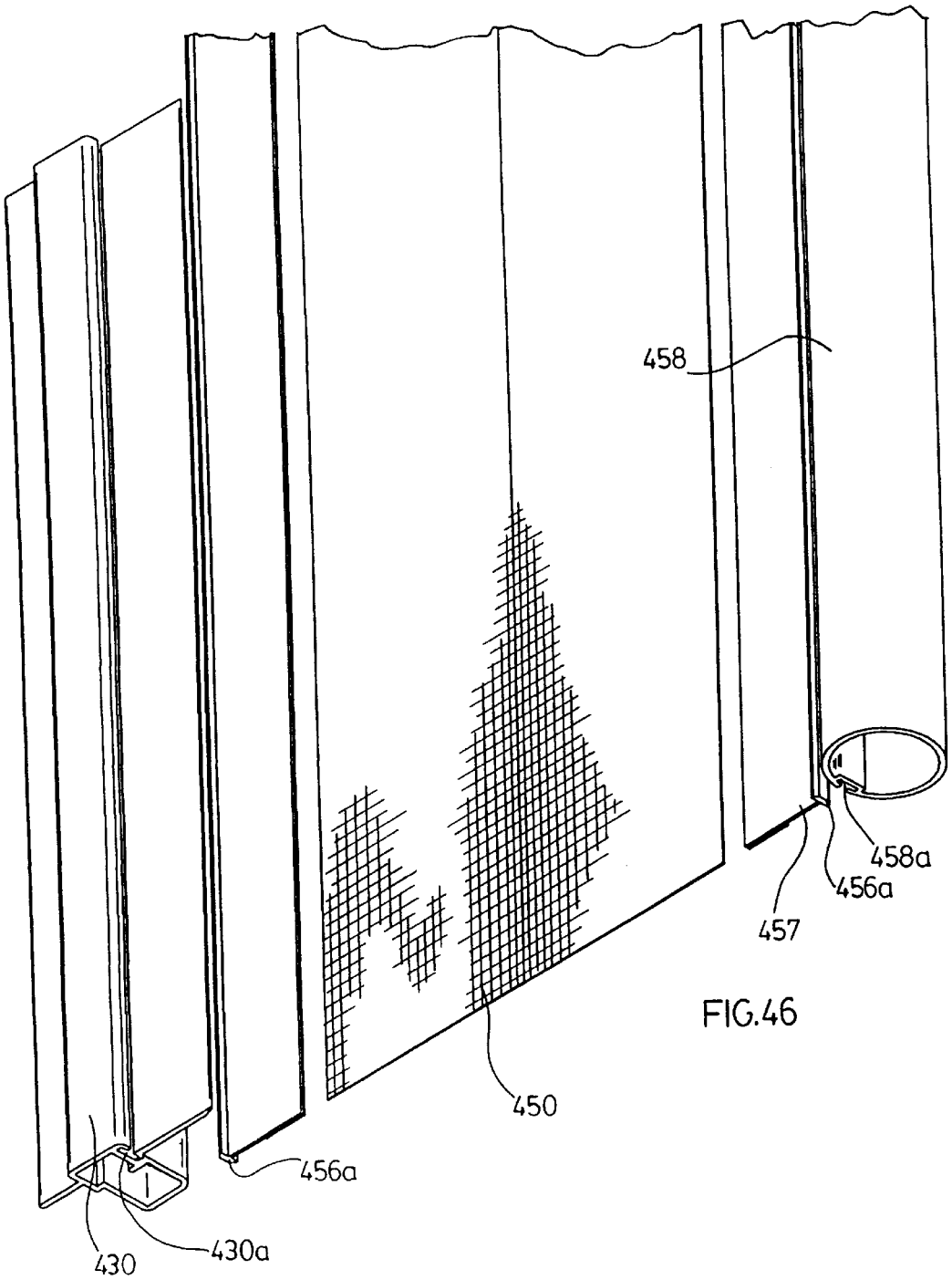
FIG. 46 is an exploded perspective view of the components of the screen assembly illustrated in a preferred embodiment of the invention.

As best seen in FIG. 46 to produce a screen one cuts from roll stack the "T" edge screen 450 to fit inside the frame opening of the window allowing for the guiding track depth less any clearances required. The roller drum 458 and handle 430 are cut to screen length providing for clearance as required. The "T" edge of the cloth 456*a* is slid into the drum slot 458*a* and the other "T" end 456*a* being slid into the handle slot 430*a* thereby fixing the screen to the critical components. A telescoping glide with its own "T" slot groove as previously described supports the screen in the guide track at each end thereof and allows the glide the freedom to move back and forth on the "T" edge of the screen taking up the opening tolerance.

Because the "T" edge is flexible and able to stretch, any local load on the screen cloth will distribute itself over a wide range of fibers of the screen thus improving the impact and tear resistance of the system. In the event that screen was pushed it would pay out the stored material to the end limit reducing dramatically the stress forces on the system. With the high tensile capability of the "T" edge system, the risk of failure of the system is greatly reduced. In servicing a screen that is already installed on site, a bolt of screen cloth carried by the service person need only be cut to the right length, the cover removed from the system to give access, the old screen cloth slide out and the new screen cloth rethreaded. There is no need for any other component replacement if they are sound.

The screen is self storing within the frame of the window by virtue of accumulating on a roller similar to the operation of a roller blind. It is payed out by pulling on a full length handle which is guided by a rail at each end. The window frame includes a guide channel for the screen which tracks and covers the free edges of the screen. The handle provided with the screen engages the adjacent sash frame section with latch detents provided which will maintain the screen under tension from the dispensing drum and covers the opening created when the sash is opened by sliding in the track wrinkle free and bug tight.

Figure 47:
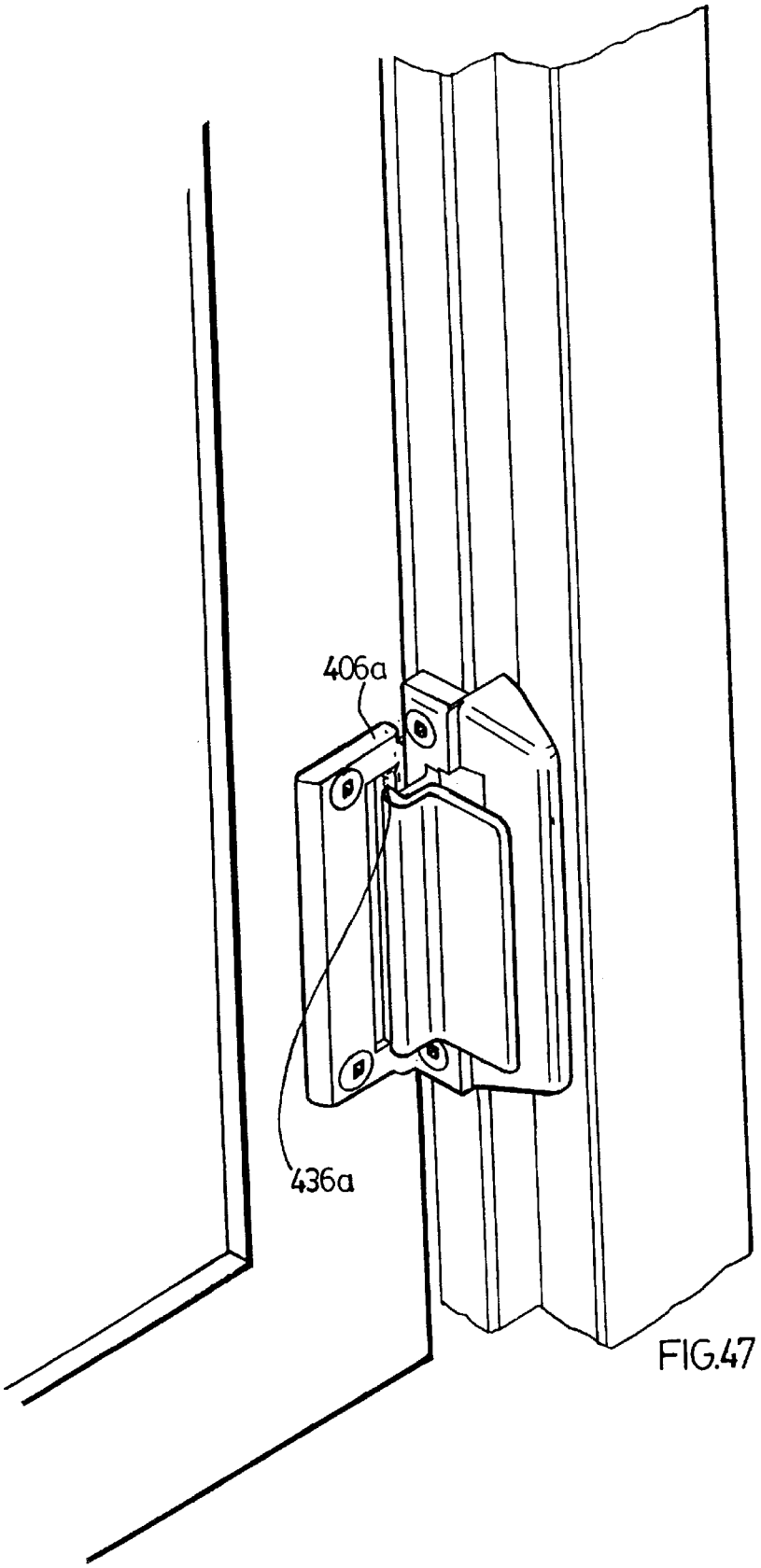
FIG. 47 is a close-up perspective view of the latch detents of FIG. 44.

Referring generally to FIG. 47 the leading edge of said detent provided with said window sash has a chamfered edge adjacent 406*a* to cause the latch including a hook portion 436*a* to ride up on said chamfered edge and engage with a compatible hook portion 406*a* disposed with said detent of said window sash.

Figure 48:
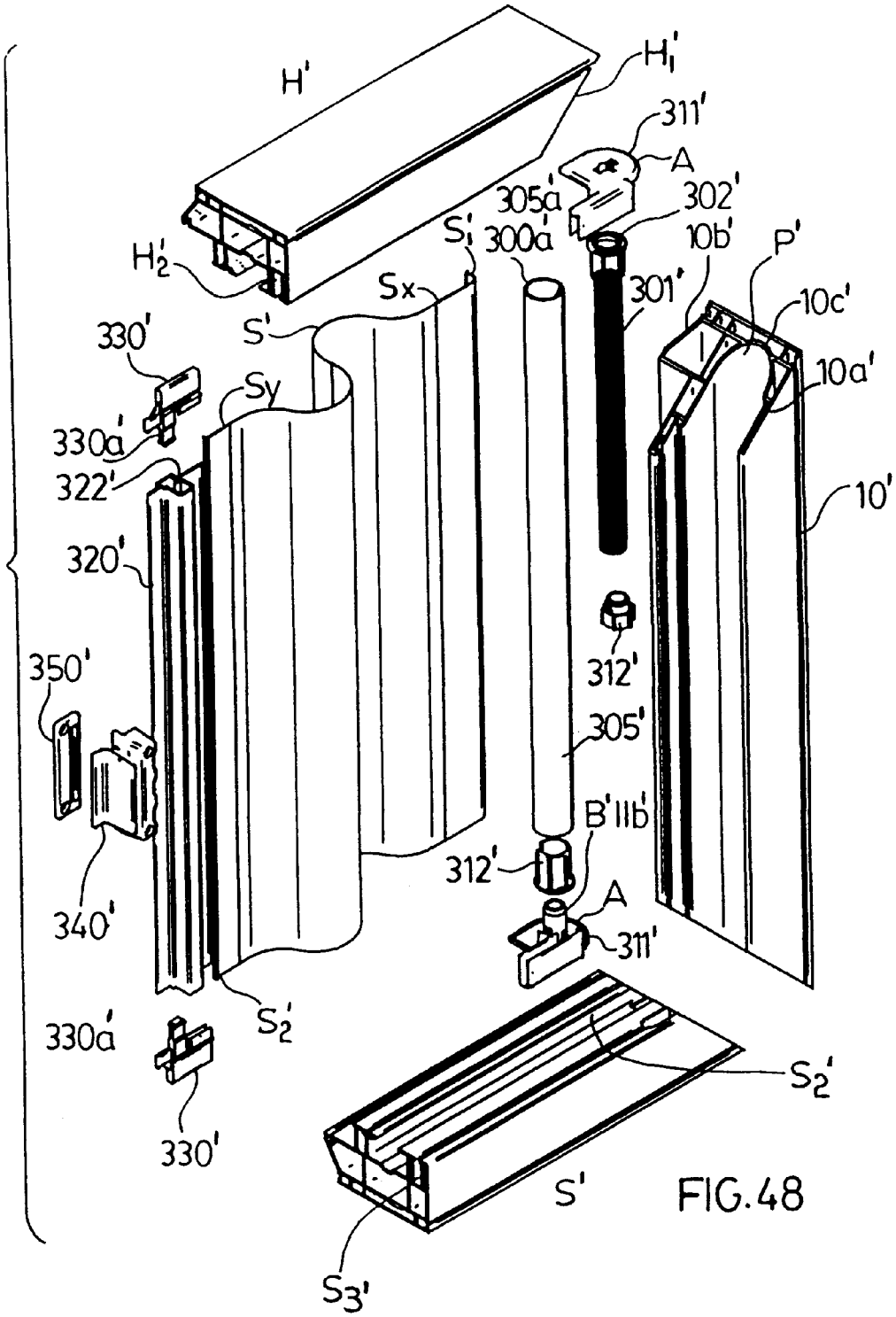
FIG. 48 is a similar view to that of FIG. 19, an exploded perspective view illustrating in a preferred embodiment of the improvements to the invention a roll screen cassette being installed in a vertical jamb.
Figure 49:
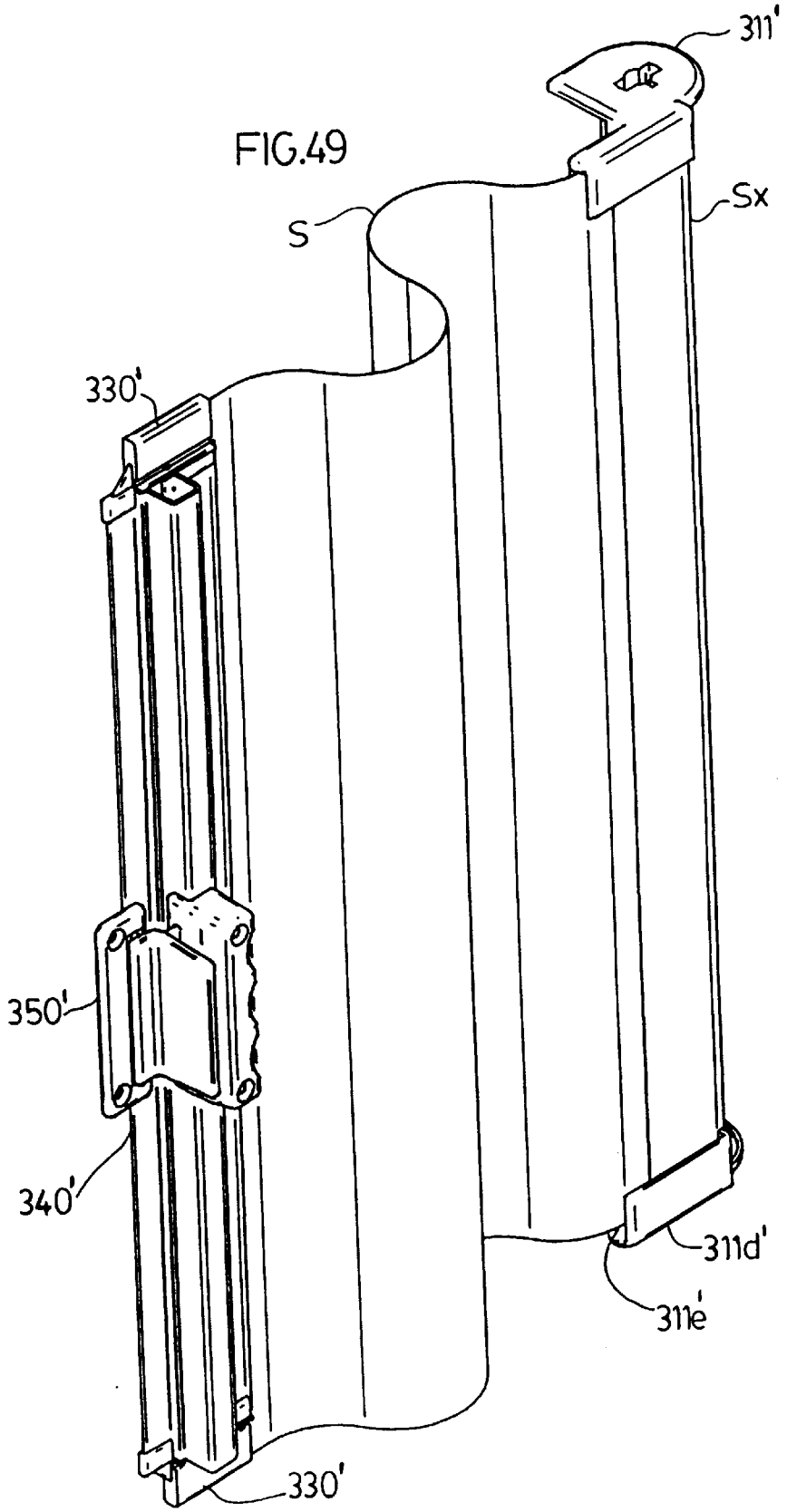
FIG. 49 is a perspective view of the roll screen cassette isolated from the frame section.

As can be seen with respect to FIG. 19, it had been contemplated to utilize a bottom bracket for the roll screen which would fit within a pocket within a jamb section and whose shape would be compatible with the shape of the pocket so as to prevent movement of the roll screen cassette without the provision of fasteners. At that time, other embodiments as seen in FIG. 20 and FIG. 45 in particular were being pursued. FIG. 45 included brackets 422 which included openings for receiving a fastener as the screen was locked within the compatible jamb section. It was also contemplated to have a cover 350 attached to the screen cassette 300. Applicant has in perfecting its invention created the embodiment of FIG. 48 which for all intents and purposes is very similar to the previous embodiment of FIG. 19 as described above. For example, all of the details with respect to the spring motor and the construction of the screen are substantially identical with the exception of the shape and function of the brackets 311', the details of which are best seen in relation to FIGS. 56 through 63. The bracket 311' includes a pivot 311*b*' extending upwardly from a plate A2 having one end being substantially arcuate in shape at A, and the other end being rectangular in shape at A1. Extending on one side of the bracket pivot 311*b*' is a screen-receiving opening 311*a*' bounded by appendages 311*d*' and 311*e*'. The screen-receiving opening commences at a mouth 311*a* extending to a mouth 311*c*'. The screen is accumulated on the roll 305' pivoted from the pivot 311*b*' via bushing member 312' and 302' having openings therein not shown (which pivot from the pivots 311*b*'). The screen S' includes two ends SX and SY which include portions S1' and S2' identically formed with the previous description in relation to FIG. 43 in a preferred embodiment. Alternative structures, of course, are possible. However, the T shape appendage S1' and S2' and the resilience of the section SY and SX provide for superior performance in a roll screen assembly. The screen ends S1' and S2' therefore are retained within the handle portion 322' and the roller portion 305' at 305*a*' which portions 305*a*' and 322' are compatibly shaped to receive the generally T-shaped appendages S1' and S2'. The spring 301' includes a generally rib-shaped portion 312' which engages the interior diameter 300*a*' intermediate the ends of the roller 305' wherein the rib portions provided with the portion 312' engage the portions 305*b*' contained within the interior of the roller as best seen in relation to FIG. 19 (and not shown in FIG. 48) so as to allow for the winding up of the spring as described in relation to FIG. 19. The arcuate portion A of the bracket 311' fits compatibly within the pocket P' of the jamb section 10' bounded by sections 10*a*', 10*b*' and 10*c*' forming said pocket P' and allowing for the containment of the bracket 311' and hence the entire screen cassette C within the jamb section 10' disposed within a frame section 10' between a header H' and a sill S'. The header H' includes a void H1' and a channel H2' for receiving the glide portions 330' of the screen assembly to guide the screen assembly to and from the stored position. Likewise, the sill S' includes a channel S3' and a shelf S2'. The channel S3' is utilized for guiding the glide portion 330' on the bottom of the screen cassette C to and from the stored position. The shelf portion S2' is for supporting the bracket portion 311' on the top thereof when the cassette is installed in the jamb section. The use of the shelf S2' will be described in relation to FIGS. 50 through 55. Handle portions 340', 320' and 350' are provided with the cassette to complete the installation. Referring to FIG. 49, all of the components identified in relation to FIG. 48 are present. The guide portions 330' are clearly shown to be installed within the openings 322' via the lead portion 330*a*' to ensure that the screen S' will be guided within the channels S3' and H2' disposed with the sill S' and a header H' respectively. The leg portions 311*e*' and 311*d*' of the bracket 311' are clearly seen to retain the portion SX of the screen S' as the screen is paid out and accumulated on the roller 305'.

Figure 50:
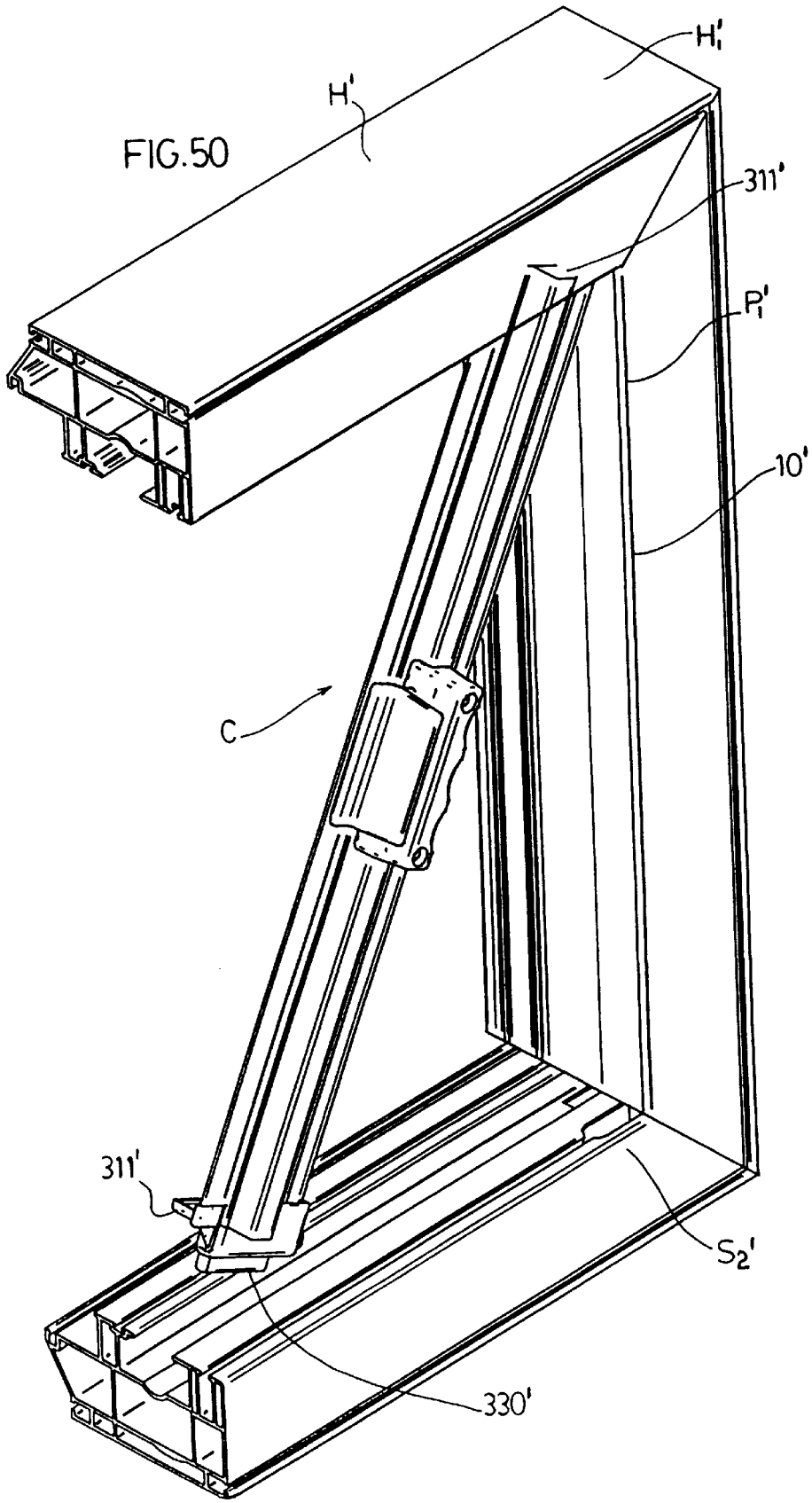
FIGS. 50 through 55 illustrate in a preferred embodiment of the invention the roll screen cassette being installed in a window frame illustrating the sequence of events taking place to complete such an installation.
Figure 51:
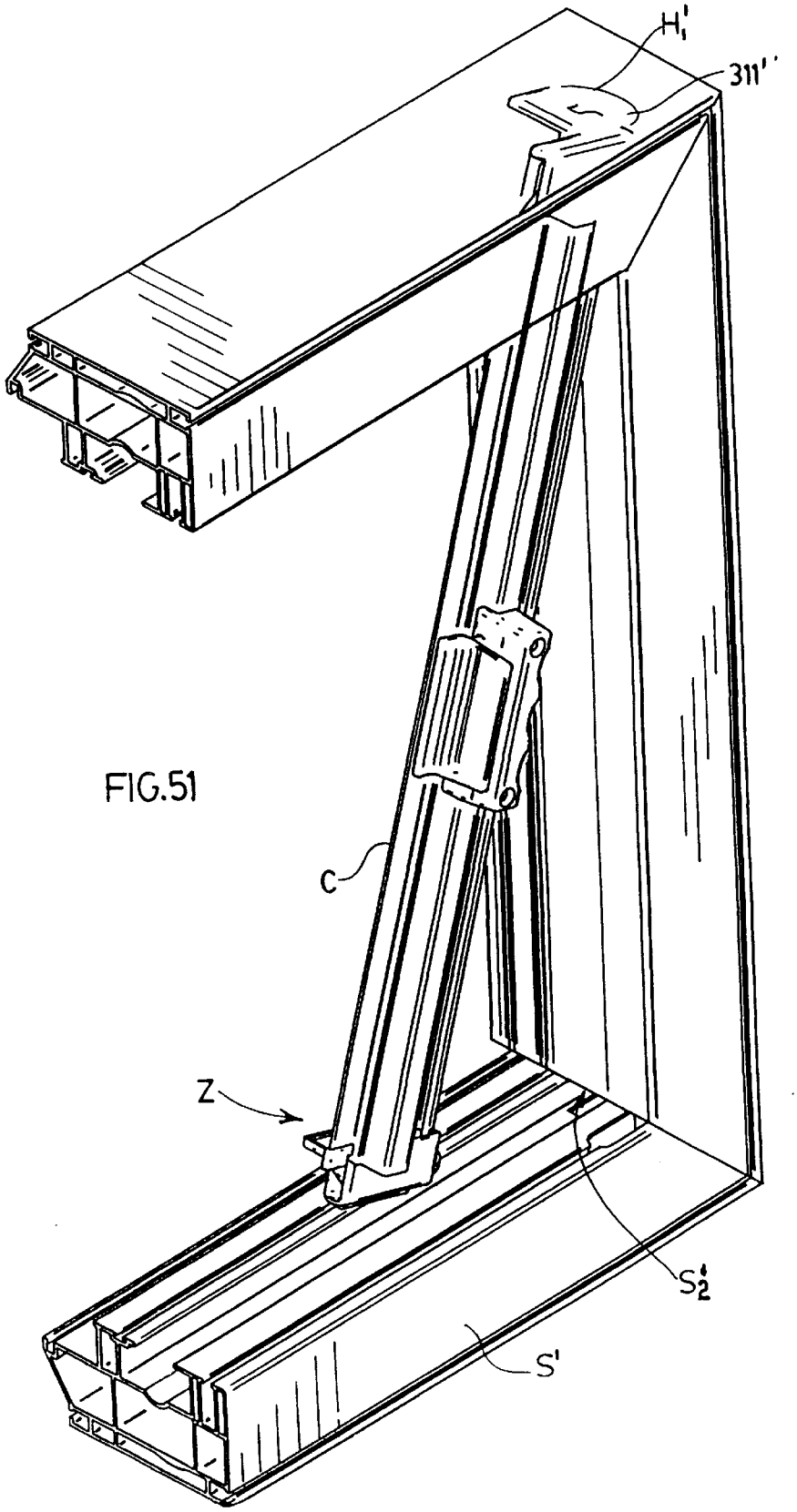
Figure 52:
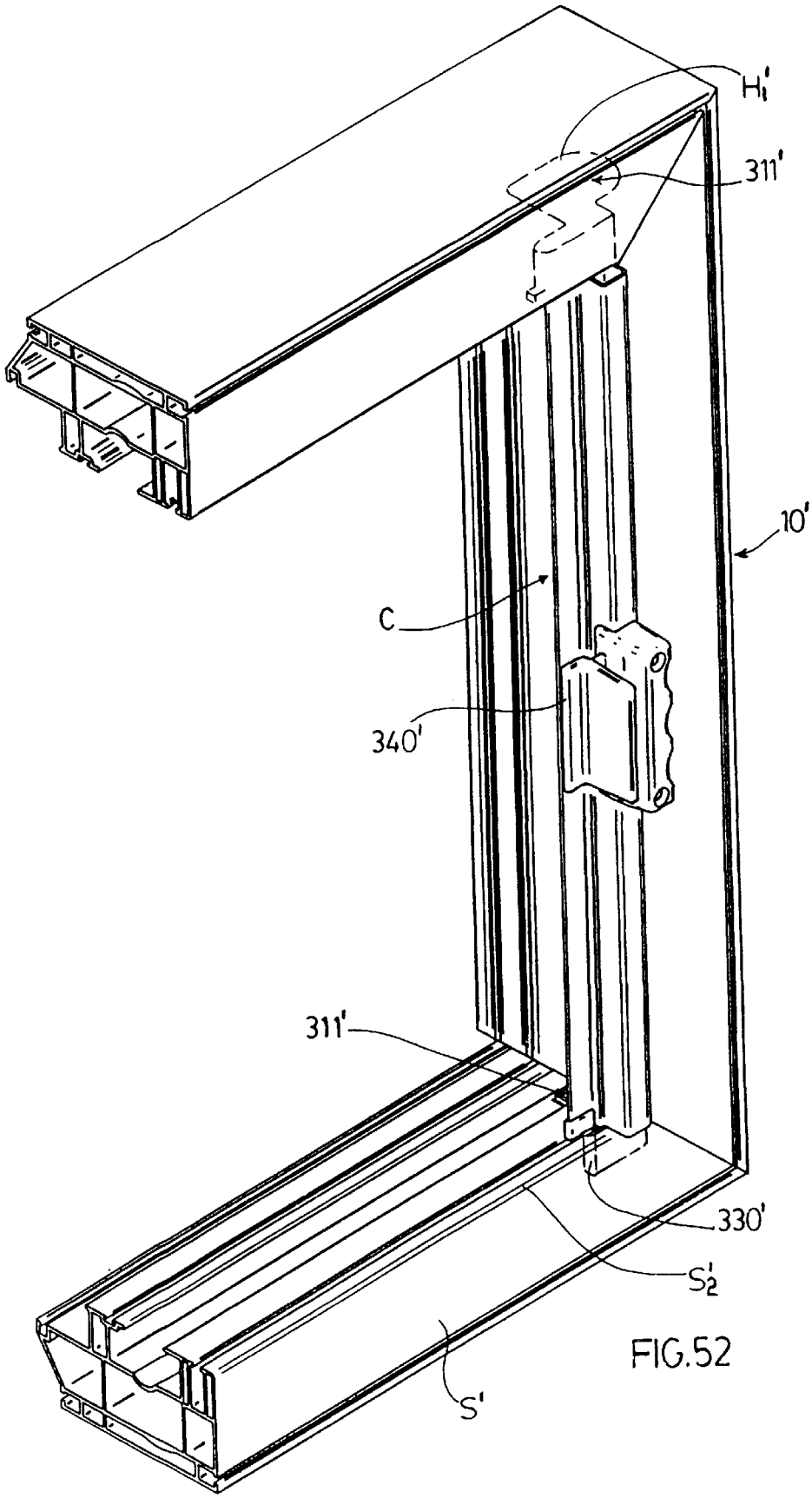
Figure 53:
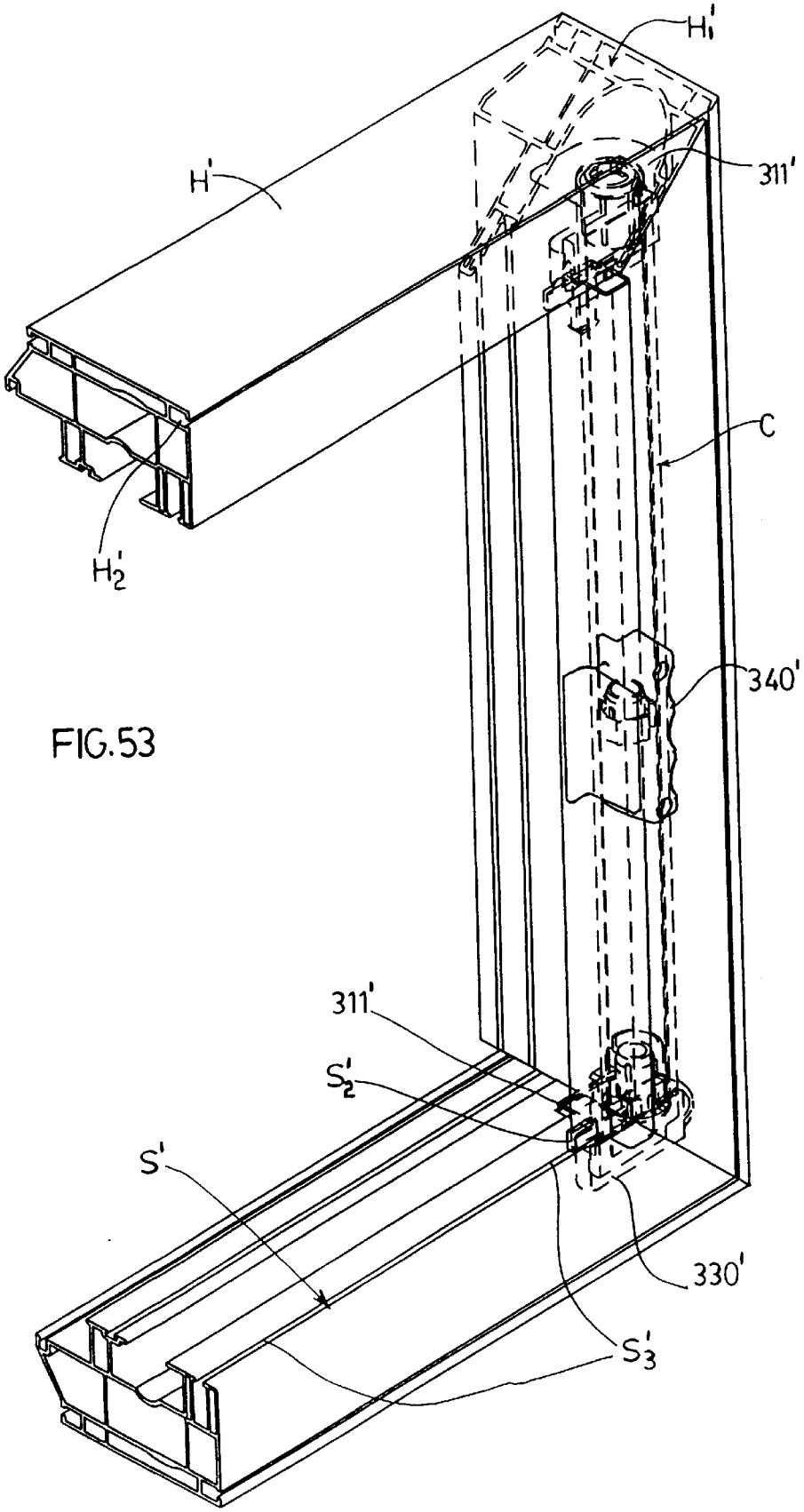
Figure 54:
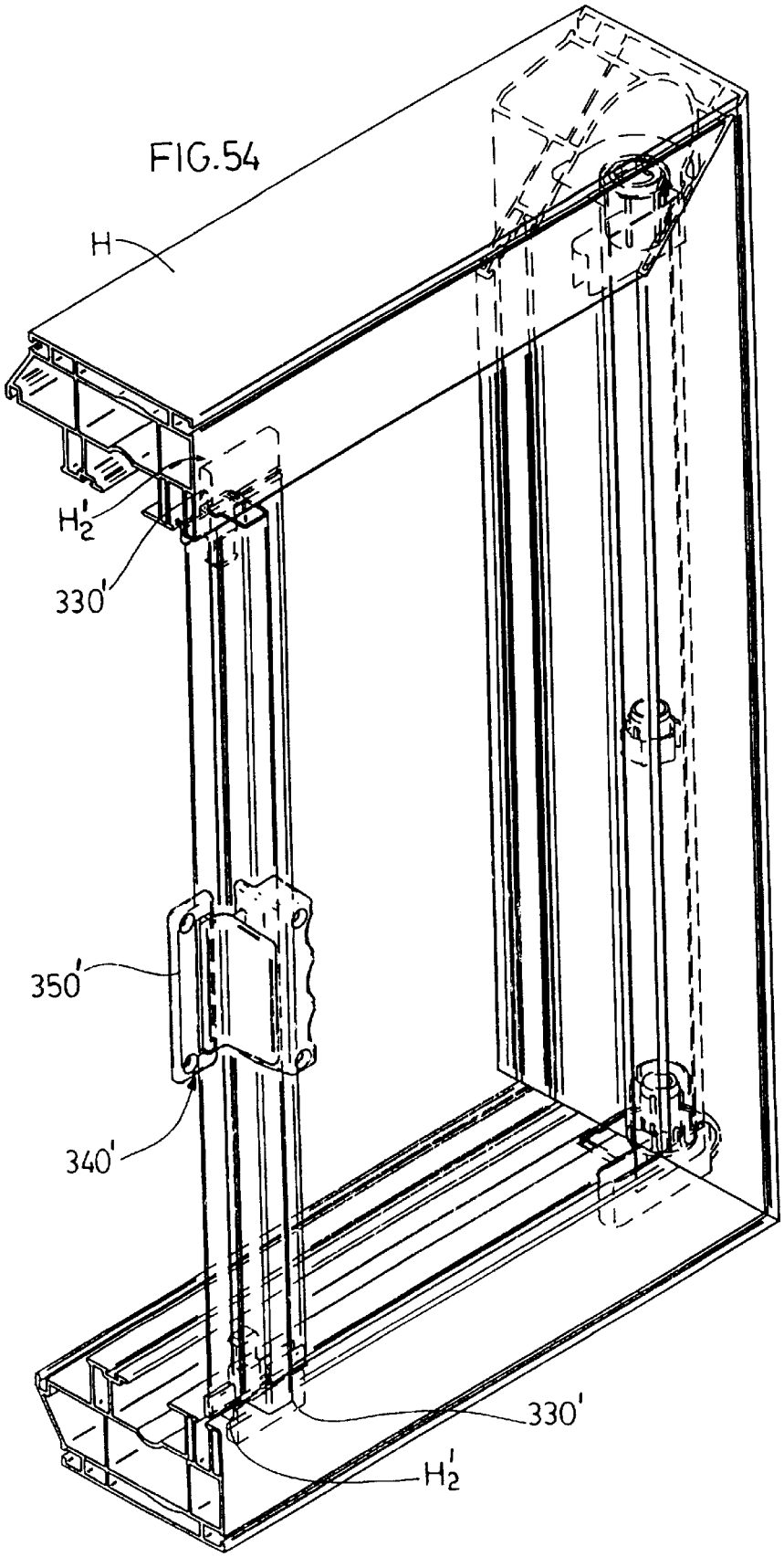
Figure 55:
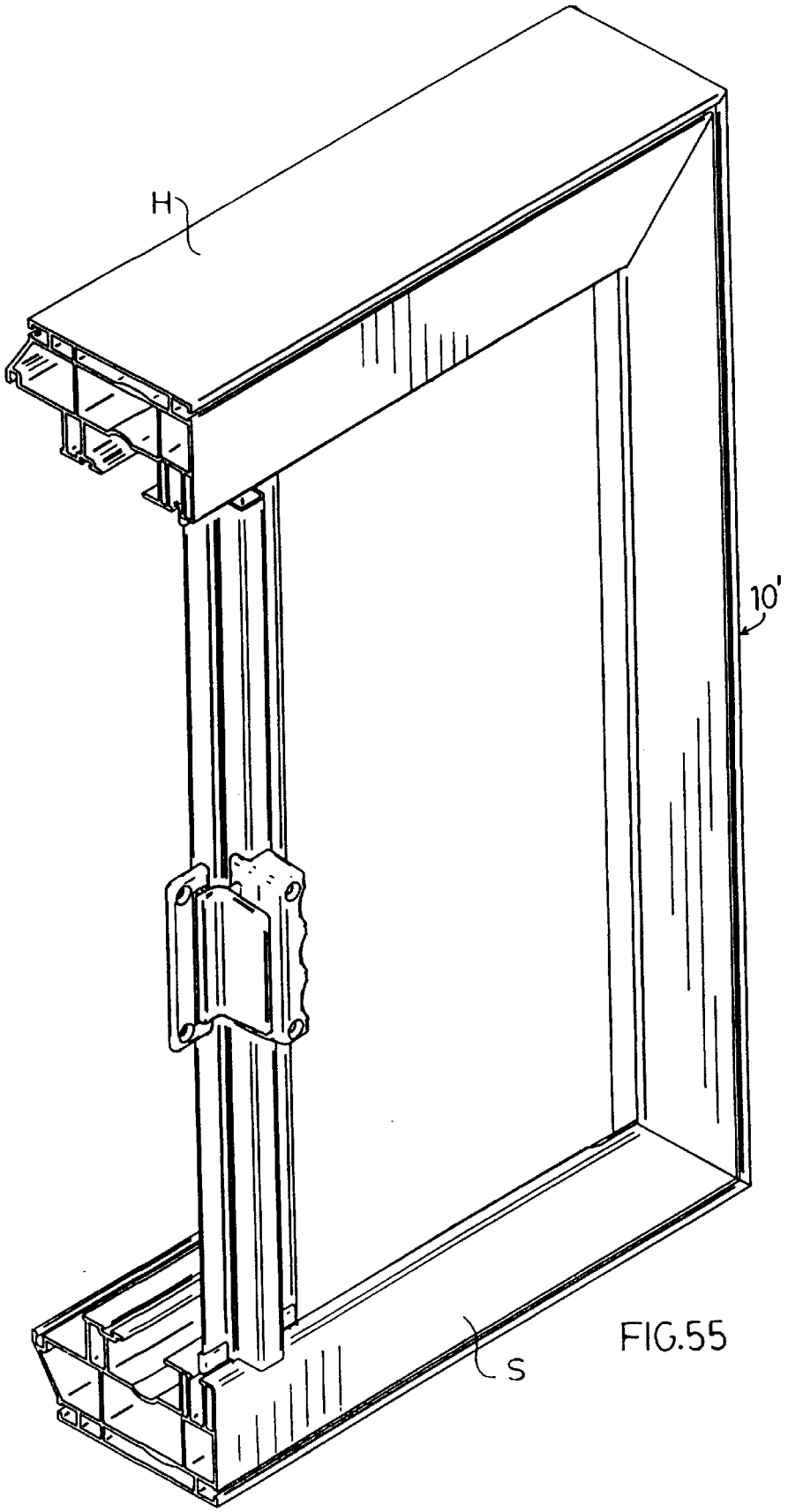
Figure 56:
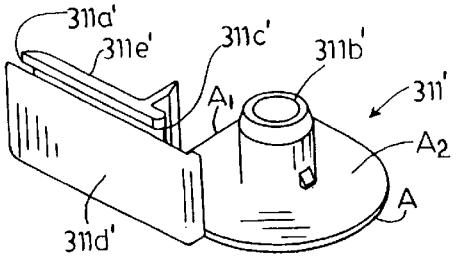
FIGS. 56 through 63 illustrate the various components of the pivot for the roll screen cassette C illustrating the bracket in perspective views, side views, end views, and top and bottom views in preferred embodiments of the invention.
Figure 57:
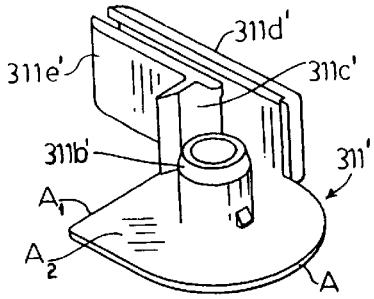
Figure 58:
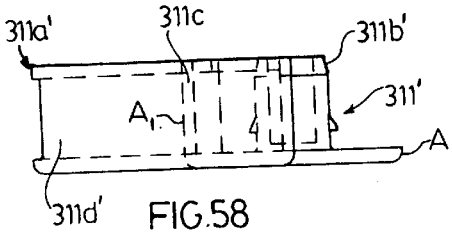
Figure 59:
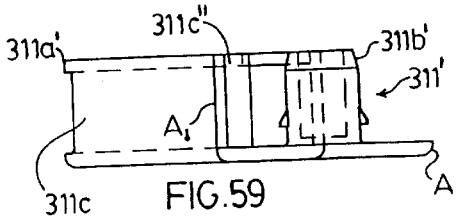
Figure 60:
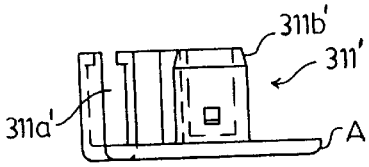
Figure 61:
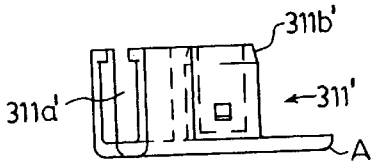
Figure 62:
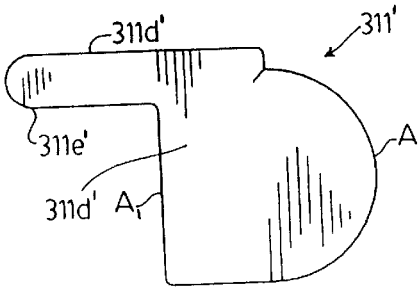

Referring now to FIGS. 48, 49 and particularly in relation to FIGS. 50 through 55, the screen cassette C is assembled in a complete form upon the brackets 311' having glides 330' provided therewith for installation within the jamb section 10' having the generally arcuate shaped pocket P' as best seen in relation to FIG. 48. The cassette C is oriented on an angle as shown in FIG. 50 in relation to the sill S' and the header H'. The sill includes a supporting shelf S2' which will support the lower bracket 311' of the cassette C. The upper bracket 311' therefore is inserted to the position shown in FIG. 51 within the void H1' so as to receive the entire upper bracket 311' in the void H1'. The bottom bracket of cassette C is then rotated about the top bracket in a direction Z toward the sill portion S' so as to avoid the shelf portion S2' and to finally end up in a position as best seen in FIG. 52 wherein the entire upper bracket 311' is disposed within the void H1' of the header H' while the lower bracket 311' and the glide 330' do not engage the portions of the sill portion S' but the entire cassette C is now disposed within the pocket P1' of the jamb section 10' in a parallel relationship thereto. The cassette is then moved downwardly in the direction illustrated so that the upper bracket 311' now enters the arcuate shaped pocket P1' of the jamb section 10' and the lower arcuate bracket 311' rests upon the shelf S2' while the glides 330' are contained within the channels S3' disposed with the sill S' and within the channel H2' within the header section H'. Gravity therefore keeps the arcuate bracket 311' in contact with the arcuate pocket P1' and secures the screen cassette C within the jamb section as is also very clearly seen in relation to FIG. 54 which illustrates the screen being paid out to an operating position. FIG. 55 illustrates the window assembly and the screen cassette without ghost lines to illustrate the esthetic appearance of the entire assembly. Standard framing sections for the header, sill and jambs may be provided in order to simplify the construction of the window and improve its appearance. It is also implied that the structure although illustrated with respect to a tilt and slide assembly would work equally well with any closure or window structure including for example but not limited to a double hung window, a casement window, a door, or a patio door.

Figure 63:
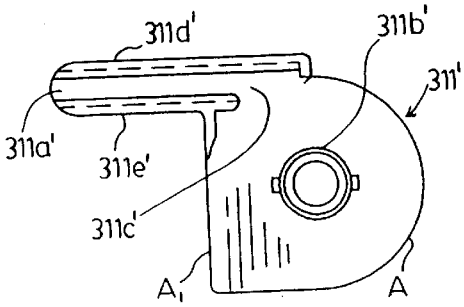
Figure 64:
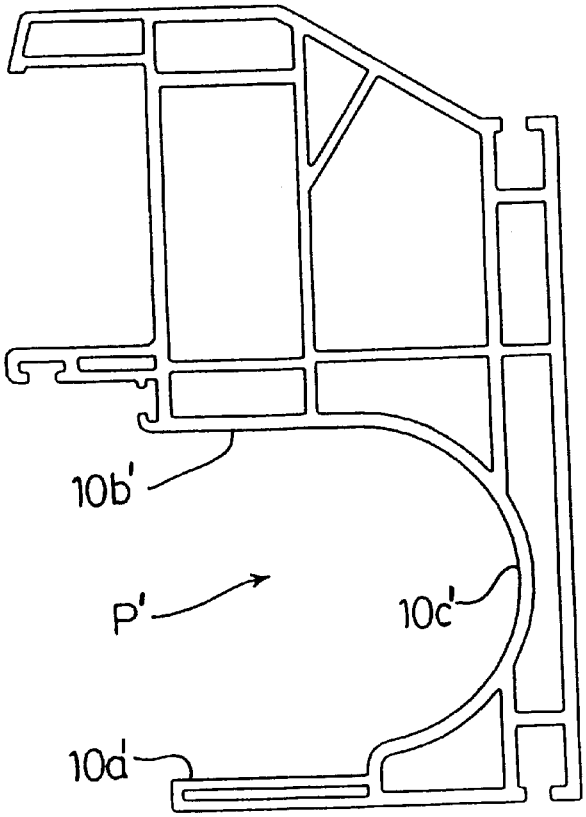
FIGS. 64 and 65 illustrate cross section and perspective views of the jamb section 10' showing the arcuate pocket P' within which the bracket 311' will be contained in use.
Figure 65:
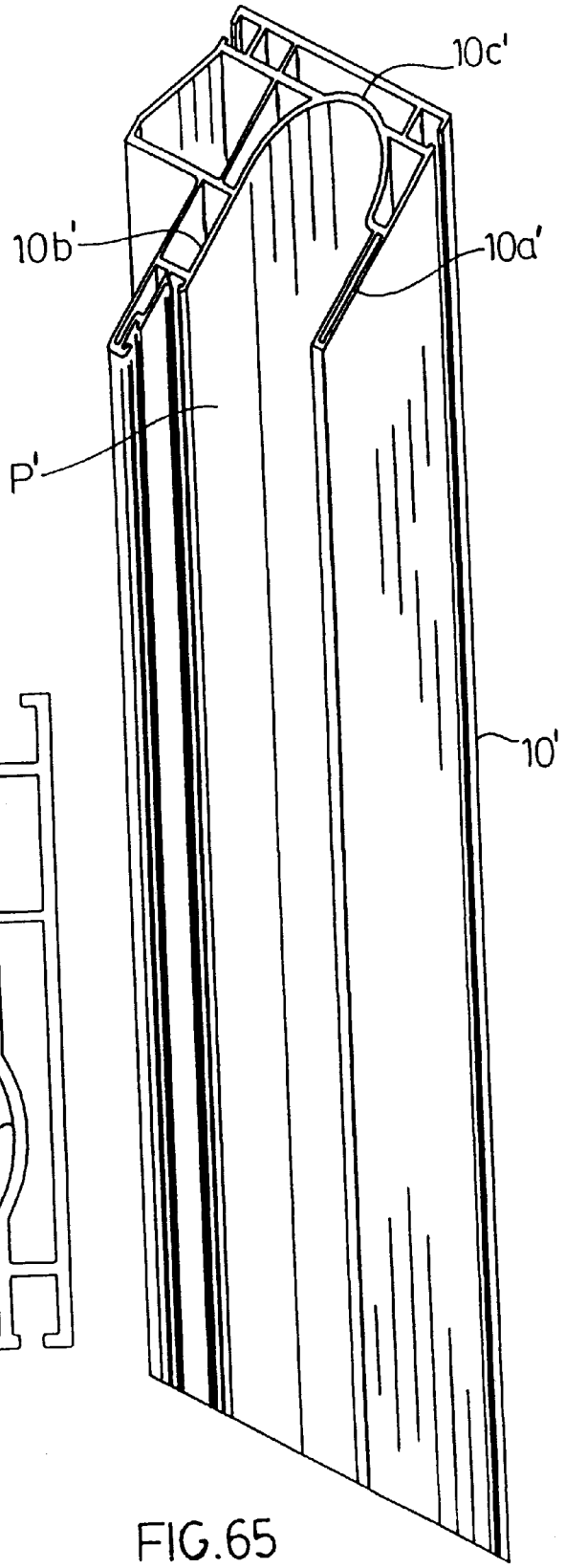

Referring now to FIGS. 64 and 65, there is illustrated in cross section and perspective the preferred construction of the jamb framing section including a pocket P' surrounded by pocket-forming sections 10*a*', 10*b*' and 10*c*'. The section 10*c*' provides for the arcuate section of the pocket compatibly shaped with the arcuate portion A of the bracket 311' as seen in FIG. 63.

Figure 66:
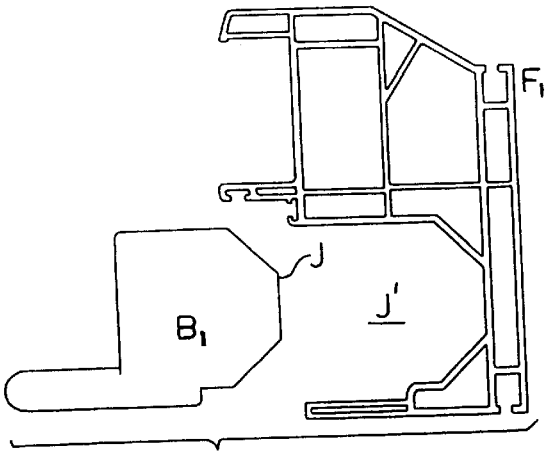
FIGS. 66, 67, 68 and 69 illustrate compatibly shaped brackets and pockets as examples of various embodiments of the invention without being restrictive.
Figure 67:
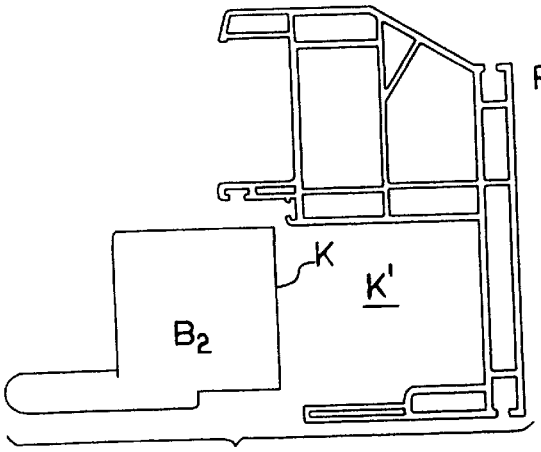
Figure 68:
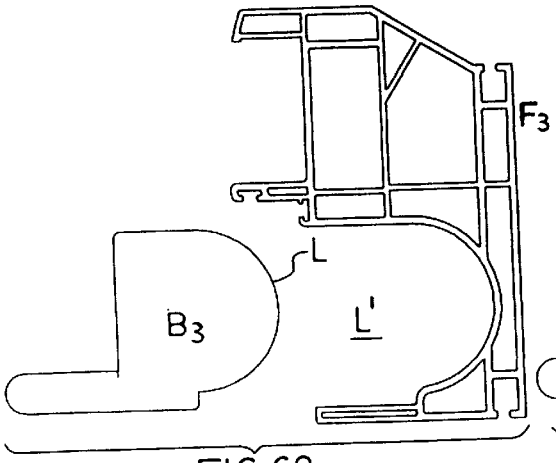
Figure 69:
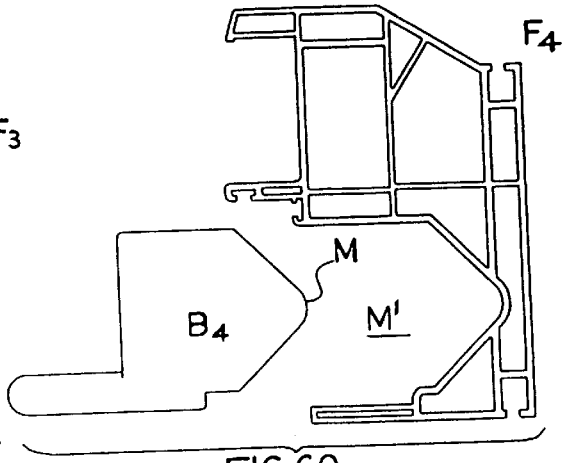

FIGS. 66 through 69 describe exemplary structures for combinations of the pocket and brackets. In FIG. 66 the jamb section F1 includes a generally hexagonally shaped pocket J' within which is contained in use the bracket B1 having a generally hexagonally shaped edge J compatible with the pocket J'. In FIG. 67 in like manner, jamb section F2 includes a square pocket K' for receipt of bracket B2 having a compatibly-shaped square edge K for receipt in said pocket K'. FIG. 68 includes a jamb section F3 and a bracket B3 including a pocket L' and a bracket having a leading edge shape L compatible with the pocket L' and describing arcuate portions described above in a preferred embodiment of the invention. FIG. 69 illustrates a jamb section F4 having a pocket generally in triangular shape M' for receipt of bracket B4 having a generally triangular-shaped edge. These FIGS. 66 through 69 are by way of example only. No limitations are implied. The essence is the compatibility of the shape of the pocket with the compatibility of the leading edge of the bracket.

All of the other limitations in manufacturing the cassette C are as previously described unless stated above in relation to FIGS. 48 through 69. The screen is manufactured in a similar manner from the same materials having the same edges and characteristics.

As many changes can be made to the invention without departing from the scope of the invention, it is intended that all material contained herein be interpreted as illustrative of the invention and not in a limiting sense.

What is claimed is:

1. A closure assembly comprising a frame for moveably retaining a closure member, said frame comprising header, sill, and vertical jamb sections having an interior, one of said sections including a hollow pocket formed within the interior of said section, said pocket having a first shape defined by an interior surface of said section, said assembly including in a roll screen substantially fully contained within said pocket and being pivotally supported upon at least one bracket, said at least one bracket having a leading edge compatible in shape with the first shape of said interior surface of said pocket, said at least one bracket utilized for removeably retaining the roll screen, said at least one bracket being prevented from rotation with respect to said frame only by said pocket having the first shape and the leading edge of said at least one bracket being compatible in shape with said pocket, wherein the compatible shapes of said pocket and the leading edge of said at least one bracket cooperate to prevent the at least one bracket from rotating with respect to the pocket and said frame when said roll screen is let out or taken in.

2. A closure assembly comprising a frame for moveably retaining a closure member, said frame comprising header, sill, and vertical jamb sections having an interior, one of said sections including a hollow pocket formed within the interior of said section, said pocket having a first shape defined by an interior surface of the section, said assembly including a roll screen substantially fully contained within said pocket and being pivotally supported upon a pair of brackets having a leading edge compatible in shape with the first shape of said interior surface of said pocket, said pair of brackets utilized for removeably retaining the roll screen, said pair of brackets being prevented from rotation with respect to said frame only by said pocket having the first shape and the leading edge of said pair of brackets being compatible in shape with said pocket, wherein the compatible shapes of said pocket and the leading edge of said pair of brackets cooperate to prevent the pair of brackets from rotating with respect to the pocket and said frame when said roll screen is let out or taken in.

3. The closure assembly of claim 1 or 2 wherein an edge of said section having said pocket and forming the frame further comprises a supplementary portion for being snap fit into a retaining portion provided with the section for closing the section.

4. The assembly of claim 1 or 2 wherein the shapes of the pockets and brackets respectively are arc shaped.

5. The assembly of claim 1 or 2 wherein said header includes a void positioned above the jamb section pocket for temporary receipt of the bracket to allow for the bottom bracket to be positioned so as to avoid contact with the sill section by raising the upper bracket into said void providing a temporary clearance for the bottom bracket to allow it to be rotated and positioned in the pocket of the jamb, said bottom sill portion of the frame which houses the bottom bracket includes a supporting shelf for the bottom screen bracket when the screen assembly is installed, wherein firstly said roll screen carrying the top and bottom screen brackets is positioned to engage the upper portion of the frame with the upper bracket extending into the pocket, said upper bracket subsequently being raised into the void provided with the header so that the bottom bracket clears the sill and the support shelf therein, said screen being subsequently pivoted around the top bracket so as to be parallel to the supporting jamb frame and finally the bottom bracket is subsequently dropped into position to contact the support shelf so that the upper and lower brackets engage with and are secured by the pocket of the jamb section when the screen is taken in or payed out.

6. A roll screen cassette installed within a closure assembly having a frame for moveably retaining a closure member, said frame including header, sill, and vertical jamb sections having an interior, one of said sections including a hollow pocket formed within the interior of said section, said pocket having a first shape defined by an interior surface of the section and for substantially fully containing the roll screen cassette, said roll screen cassette comprising a pair of brackets from which said roll screen is pivotally supported, said pair of brackets having a leading edge compatible in shape with the first shape of the interior surface of said pocket of said frame section, said pair of brackets utilized for removeably retaining the roll screen within said pocket of said section, said pair of brackets and roll screen being removeably held in position with respect to said frame only by said pocket and said leading edge of said pair of brackets wherein the compatible shapes of the leading edge of said pair of brackets and said pocket, when said cassette is installed in said frame section, cooperate to prevent the pair of brackets from rotating with respect to the pocket and said section when said roll screen is let out or taken in.

7. The cassette of claim 6 wherein said brackets are arc shaped.

8. A closure assembly comprising a retractable screen substantially fully contained within a frame including header, sill, and jamb framing sections, one of said framing section including a pocket having a first shape defined by an interior surface of the framing section, the screen accumulating on and paying out from a spring biased roll pivoting on brackets having a compatible shape with respect to the interior surface of the framing section, said brackets thereby being constrained from rotation within the pocket of said frame portion without the need of fasteners, wherein the screen is retractable for egress or cleaning purposes, and available as desired.

9. The closure assembly of claim 8 wherein a detent is disposed on an opposite frame section and engageable with a handle for the screen when in an operable position.

* * * * *